US006903716B2

(12) United States Patent
Kawabe et al.

(10) Patent No.: US 6,903,716 B2
(45) Date of Patent: Jun. 7, 2005

(54) DISPLAY DEVICE HAVING IMPROVED DRIVE CIRCUIT AND METHOD OF DRIVING SAME

(75) Inventors: Kazuyoshi Kawabe, Fukuoka (JP); Junichi Hirakata, Chiba (JP)

(73) Assignee: Hitachi, Ltd., Tokyo (JP)

( * ) Notice: Subject to any disclaimer, the term of this patent is extended or adjusted under 35 U.S.C. 154(b) by 265 days.

(21) Appl. No.: 10/382,925

(22) Filed: Mar. 7, 2003

(65) Prior Publication Data

US 2003/0169247 A1 Sep. 11, 2003

(30) Foreign Application Priority Data

Mar. 7, 2002 (JP) ..... 2002-061297

(51) Int. Cl.[7] ..... G09G 3/36

(52) U.S. Cl. ..... 345/99; 345/698; 345/100; 345/102; 345/213; 348/556

(58) Field of Search ..... 345/88–89, 97–100, 345/102, 213, 698, 699; 348/556

(56) References Cited

U.S. PATENT DOCUMENTS 5,627,559 A * 5/1997 Tsuboyama et al. ..... 345/97
5,844,539 A * 12/1998 Kitagawa ..... 345/100
6,236,388 B1 * 5/2001 Iida et al. ..... 345/698
6,486,864 B1 * 11/2002 Nakajima et al. ..... 345/92
6,600,469 B1 * 7/2003 Nukiyama et al. ..... 345/87
6,724,358 B2 * 4/2004 Ban et al. ..... 345/92
6,771,243 B2 * 8/2004 Hirohata ..... 345/89
2002/0158831 A1 * 10/2002 Kondoh ..... 345/97

* cited by examiner

*Primary Examiner*—Amr A. Awad
(74) *Attorney, Agent, or Firm*—Antonelli, Terry, Stout & Kraus, LLP

(57) ABSTRACT

In a display device, a first drive circuit supplies one and another first signals to plural adjacent scanning signal lines during first and second time intervals in a frame period, respectively. During the first time interval, a second drive circuit generates a second voltage corresponding to video data and supplies the second voltage to pixels associated with the adjacent scanning signal lines supplied with the first signal, and during the second time interval, the second drive circuit generates and supplies a second voltage to ones of the pixels associated with the adjacent scanning signal lines supplied with the first signal such that the pixels associated with the adjacent scanning signal lines supplied with the first signal produce luminance lower than that produced during the first time interval.

22 Claims, 40 Drawing Sheets

FIG. 38

| SPECIFICATION NAMES | HORIZONTAL RESOLUTION m | VERTICAL RESOLUTION n | ASPECT RATIO |
|---|---|---|---|
| VGA | 640 | 480 | 4 : 3 |
| XGA | 1024 | 768 | 4 : 3 |
| SXGA | 1280 | 1024 | 5 : 4 |
| UXGA | 1600 | 1200 | 4 : 3 |
| WVGA | 800 | 480 | 5 : 3 |
| WXGA | 1280 | 768 | 5 : 3 |
| WUXGA | 1920 | 1200 | 8 : 5 |

FIG. 39

| NUMBER OF EFFECTIVE SCANNING LINES | ASPECT RATIO |
|---|---|
| 480i | 16 : 9, OR 4 : 3 |
| 480p | 16 : 9 |
| 1080i | 16 : 9 |
| 720p | 16 : 9 |
| 1080p | 16 : 9 |

FIG. 40

| | NUMBER OF VERTICAL SCANNING LINES IN AN ARRAY | | | |
|---|---|---|---|---|
| | 4 : 3 | | 16 : 9 | |
| PIXEL ARRAY | EFFECTIVE | BLANK | EFFECTIVE | BLANK |
| VGA | 480 | 0 | 360 | 120 |
| XGA | 768 | 0 | 576 | 192 |
| SXGA | 960 | 64 | 720 | 304 |
| UXGA | 1200 | 0 | 900 | 300 |
| WVGA | 480 | 0 | 450 | 30 |
| WXGA | 768 | 0 | 720 | 48 |
| WUXGA | 1200 | 0 | 1080 | 120 |

FIG. 41

| | NUMBER OF VERTICAL SCANNING LINES OF VIDEO SIGNALS | | | | |
|---|---|---|---|---|---|
| | 4 : 3 | 16 : 9 | | | |
| PIXEL ARRAY | 480i | 480p | 1080i | 720p | 1080p |
| VGA | +240 | −120 | −180 | −360 | −720 |
| XGA | +528 | +96 | +36 | −144 | −504 |
| SXGA | +720 | +240 | +180 | 0 | −360 |
| UXGA | +960 | +420 | +360 | +180 | −180 |
| WVGA | +240 | −30 | −90 | −270 | −630 |
| WXGA | +528 | +240 | +180 | 0 | −360 |
| WUXGA | +960 | +600 | +540 | +360 | 0 |

FIG. 42

| CONTROL PARAMETERS | VALUES |
|---|---|
| NUMBER OF LINES WRITTEN INTO SIMULTANEOUSLY | 1, 2, 3, 4, · · · |
| NUMBER OF LINES BETWEEN SUCCESSIVELY SCANNED LINES | 1, 2, 3, 4, · · · |
| IMPULSE BLANKING | 1/2, 1/3, 2/3, 1/4, · · · |
| LIQUID CRYSTAL SPEED-UP-FILTER FACTOR | 1.0, 1.5, 2.0, · · · |
| GRAY-SCALE REFERENCE VOLTAGES | Vh(9 : 0), Vi(9 : 0) |
| INCREASING OF ASPECT RATIO | Enable, Disable |
| FOCUSING | Enable, Disable |
| FOCUS POSITIONS | (0, 0)~(640, 480) |

FIG. 43

| CONTROL PARAMETERS | VALUES |
|---|---|
| TUBE CURRENTS RELATIVE TO THAT IN CONTINUOUSLY TURNED-ON OPERATION | ×1, ×2, ×3, ×4, · · · |
| TURN-ON DUTY (PER FRAME) | 1/2, 1/3, 2/3, · · · |
| TURN-ON PHASE | $\pi/2$, $\pi/3$ · · · |
| TURNED-OFF LAMPS | No. 1, 2, 3, 4, · · · |

FIG. 44

| CONTROL PARAMETERS | VALUES |
|---|---|
| TRANSFER CLOCK | Low, High, · · · |
| SPEED-UP FILTER ENABLE | On, Off · · · |
| JUDGMENT THRESHOLD | Low, Medium, High, · · · |
| WRITE-IN CHARACTERISTIC | PER LINE, PER FRAME · · · |

FIG. 45

| CONTROL PARAMETERS | VALUES |
|---|---|
| UPPER INVALID AREA | 0~96, · · · |
| LOWER INVALID AREA | 672~768, · · · |

FIG. 46

| CONTROL PARAMETERS | VALUES |
|---|---|
| LEFT-SIDE INVALID AREA | 0~128, · · · |
| RIGHT-SIDE INVALID AREA | 1156~1280 |
| DRIVER SCALING | Enable, Disable |
| DRIVER FRAME BUFFER | Enable, Disable |
| DRIVER-TRANSFER BUS MODE | FULL, HALF |

DISPLAY DEVICE HAVING IMPROVED DRIVE CIRCUIT AND METHOD OF DRIVING SAME

BACKGROUND OF THE INVENTION

This invention relates to a liquid crystal display device driven by a switching element using amorphous silicon, polycrystalline silicon or the like for each pixel, an electroluminescent-type display device, and a display device provided with a light emitting element such as a light emitting diode and the like for each pixel. In particular, this invention relates to a display device that performs blanking processing.

Liquid crystal display devices have been widely used as display devices that retain light emitted from each of a plurality of pixels in a desired amount within a predetermined period of time (e.g., a period of time corresponding to 1 frame period) on the basis of video data inputted for each 1 frame period. In the liquid crystal display device of active matrix scheme, each of a plurality of pixels arranged in a two-dimensional form or in a matrix form is provided with a pixel electrode and a switching element (e.g., a thin film transistor) for supplying a video signal to the pixel electrode. The video signal is supplied from one of a plurality of data lines (also called video signal lines) extending in the longitudinal direction of a picture, for example, to a pixel electrode through the switching element. The switching element receives scanning signals at predetermined intervals (e.g., for each frame period) from one of a plurality of gate lines (also called scanning signal lines) intersecting the plurality of data lines and extending (e.g., in a horizontal direction in a picture) and supplies a video signal from one of the plurality of data lines to a pixel electrode. Accordingly, the switching element keeps the pixel electrode at a potential based on the video signal supplied to this pixel electrode in response to the previous scanning signal until it receives the next scanning signal, so that the pixel provided with this pixel electrode is maintained at a desired brightness level.

Such an operation stands in contrast to an impulse emission operation of a cathode-ray tube represented by a Braun tube where a phosphor arranged for each pixel is caused to emit light at the instant of receiving the video signal. Unlike the impulse light emission, the video displaying operation of the active matrix type liquid crystal display device as described above is also called sometimes hold-type light emission. In addition, such video display as performed by the active matrix type liquid crystal display device is also employed in the electroluminescent type (abbreviated as EL type) or a light emission diode array type display device and those operations can be described by replacing the aforesaid voltage control of the pixel electrode with the control of carrier injection to the electroluminescent element or the light emission diode.

Since the display device using such a hold-type light emission displays an image by retaining a brightness level of each of the pixels within a predetermined period of time to display the image, when the image to be displayed by the display device is replaced with a different image, for example, between a pair of the successive aforesaid frame periods, the pixel sometimes does not provide a sufficient response. This phenomenon can be explained by the fact that the pixel set to a predetermined brightness level in a certain frame period (e.g., a first frame period) keeps the brightness level associated with the previous frame period (the first frame period) in the next frame period (e.g., a second frame period) subsequent to the first frame period until the brightness level associated with the second frame period is set. In addition, this phenomenon can also be explained by the so-called hysteresis of the image signal in each of the pixels, in which part of the image signal (or an amount of electric charge corresponding to the image signal) sent to the pixel in the aforesaid certain frame period (the first frame period) interferes with the image signal (or an amount of electric charge corresponding to the image signal) to be sent to the pixel in the aforesaid next frame period (the second frame period). The technology for resolving such a problem as above in regard to the response performance of the image display in the display device using the hold-type light emission has been disclosed by Japanese Patent Publication Nos. 06-016223 and 07-044670, and Japanese Patent Laid-open Nos. 05-073005 and 11-109921, for example.

Among them, Japanese Patent Laid-Open No. 11-109921 makes a reference to the so-called blurring phenomenon in which a contour of an object becomes vague as compared with that of a cathode ray tube for light emitting the pixel in an impulse manner when moving images are reproduced by the liquid crystal display device (one example of the display device using the hold-type light emission). To obviate the blurring phenomenon, Japanese Patent Laid-open No. 11-109921 discloses the liquid crystal display device in which a pixel array (a group of pixels arranged in a two-dimensional manner) in a liquid crystal display panel is divided into two, upper and lower, segments in a picture (an image display area) and each of the divided pixel arrays is provided with a data line drive circuit. This liquid crystal display device performs the so-called dual scanning operation in which a video signal is supplied from the data line drive circuits arranged the respective pixel arrays while selecting a gate line of each of the upper and lower pixel arrays one by one, i.e. two, upper and lower, gate lines in total.

An upper phase and a lower phase are displaced while this dual scanning operation is being carried out in 1 frame period, a signal (the so-called video signal) corresponding to a displayed image at one phase and a signal of blanking image (e.g., a black image) at the other phase are inputted from the associated data line drive circuits to the pixel array. Accordingly, a period in which the image is displayed and a period in which a blanking display is carried out are given to both upper and lower pixel arrays in 1 frame period, whereby a period for holding an image in the entire picture area is shortened. With such an arrangement, the liquid crystal display device can also provide moving image display performance comparable to that of a Braun tube.

SUMMARY OF THE INVENTION

However, since the liquid crystal display device described above as the prior art has a configuration in which the liquid crystal display panel is divided into upper and lower halves, and a data line drive circuit is provided for each of the upper and lower segments, this liquid crystal display device cannot avoid disadvantages that parts cost and manufacturing cost are increased, the entire liquid crystal display device becomes larger in size with the increased number of component parts, and its structure becomes complicated. In addition, it is also apparent that a cost for making the liquid crystal display panel into a large-sized picture area and increasing its display definition is increased more than that of a usual panel. Further, the aforesaid liquid crystal display panel remarkably improves a moving image display characteristic and in turn it is not different from the usual liquid crystal display panel in view of a still image represented by a desktop image in a personal computer and the like. That is, this type of liquid crystal display panel becomes overqualified in an application of a monitor of a notebook personal computer and the like and this is limited to a high-class unit for an application of multi-media. For this reason, it becomes necessary to prepare some component parts specific to this type of liquid crystal display device or arrange a production line, with the result that efficiency in view of mass-production is inevitably decreased.

It is therefore an object of the present invention to provide a display device capable of restricting deterioration in image quality such as a blurring phenomenon generated in a moving image while restricting an increased-sized and complicated structure of the entire device.

The present invention relates to a display device for displaying an image by receiving video data per frame period. The display device in accordance with the present invention is provided with a data control circuit for inserting blanking data into the video data corresponding to one frame period, and generates a clock for scanning pixel lines (i.e. pixel rows in the display device) successively, so that the video data and blanking data are displayed (i.e. the video data and blanking data are supplied to pixels in the display device) during an arbitrary frame period (for example, a frame period succeeding the frame period during which the above-mentioned video data is being supplied).

An example of the display device to which the present invention is applicable is provided with a display panel having a plurality of pixels (display units) arranged in a matrix configuration, each of the pixels having an active element, a drain driver (a video signal drive circuit) for generating gray scale voltages in accordance with an image to be reproduced (video data supplied to the display device), a gate driver (a scanning signal drive circuit) for supplying a scanning signal to the active elements in a group of desired ones among the plural pixels such that the gray scale voltages are supplied to the pixels of the group, a data control circuit for generating blanking data during a time interval during which the video data corresponding to one frame period is being supplied to the display device, and a timing control circuit for generating a clock so that the gray scale voltages in accordance with the video data and signal voltages in accordance with the blanking data are supplied to the pixels of the group during the one frame period. For example, the above-mentioned group of desired ones among the plural pixels means a row of pixels arranged in a lateral direction on a display screen. A plurality of such rows of the pixels are arranged in the screen of a display device, and each of the active elements in the pixels in each of the rows receives an output from the drain driver. Such operation of supplying outputs from the drain driver to electrodes which contribute to image displaying in respective pixels (which are called pixel electrodes in the case of a liquid crystal display device) by opening and closing such active elements is called scanning per group of pixels (or scanning per pixel row, or scanning per pixel line). Each of the pixels is held at a desired brightness (light transmission, or light emission intensity) between two successive scannings. Operation of supplying signal voltages based upon pseudo video data different from the video data to plural pixels as in the case of gray scale voltages during a time interval between two times of supplying gray scale voltages the plural pixels based upon the video data is called insertion of blanking data into the video data.

In an example of the display device in accordance with the present invention, arranged in a display area formed with a plurality of pixels are a plurality of gate lines (which are also called scanning signal lines) extending from the gate driver or from a side formed with the gate driver of the display area, and a plurality of drain lines (which are also called data lines or video signal lines) extending from the drain driver or a side formed with the drain driver of the display area in a direction intersecting the plural gate lines. In the display area, each of the above-mentioned groups formed of ones among the plural pixels is a pixel row arranged along one of the plural gate lines, and the active elements provided in the respective pixels in the pixel row receive a scanning signal from the one of the plural gate lines. Ones of the plural pixels form a pixel column which receive video signals from one of the plural drain lines, and it is often that plural pixels forming one pixel row belong to pixel columns different from each other.

The above-mentioned video data corresponding to one frame period can be supplied to the display device in the form of data for interlaced odd-numbered and even-numbered fields. For example, a plurality of pixel rows are divided into a plurality of groups each comprising plural adjacent pixel rows, the odd-numbered field data correspond to odd-numbered groups of the pixel rows, and the even-numbered field data correspond to the even-numbered groups of the pixel rows.

The above-mentioned data control circuit can be configured so as to reduce or increase the size of video data corresponding to one frame period. For example, by using video signals corresponding to a group of pixels, video signals to be supplied to plural adjacent groups formed of plural pixels can be created. Such video data processing is called scaling. Further, in this case, blanking data can also be created for each of the plural groups of the pixels, or video signals corresponding to the blanking data can be created, and they can be supplied to each of the groups of the pixels.

Further, vertical resolution (for example, the degree of image definition in a direction of extension of the data lines) of video data corresponding to one frame period can be reduced by the data control circuit, and blanking having the similar vertical resolution can be inserted into the video data irrespective of the degree of reduction. For example, the size of video data corresponding to one frame period is scaled by using the data control circuit such that vertical resolution of the video data is reduced, and blanking data corresponding to the reduced video data can be inserted into the scaled video data. Data effective for displaying an image can be added to video data corresponding to one frame period by using the data control circuit, and if an expedient for changing modes of inserting blanking data into the video data is added to the data control circuit, a desired mode of inserting blanking data can be selected from among plural modes of inserting blanking data.

The above-mentioned timing control circuit can be configured so as to supply gray scale voltages to the drain driver via plural different systems, and in this case an expedient can be provided which select a group of gray scale voltages from one among the different systems.

The gate driver can be configured such that a plurality of pixel rows are divided into a plurality of groups each formed of plural adjacent pixel rows, and the plurality of groups of the pixels are successively scanned with all the pixel rows of each of the groups being scanned at one time, in any of the above-described display devices.

A signal voltage produced based upon the blanking data is selected to produce a gray scale level equal to that of a black level in gray scale represented by video data.

The above-described display devices can be provided with a light source device (a light source unit) for illuminating the display panel and a light source control circuit for controlling at least one of the amount of light irradiated onto the display panel from the light source device, the lighting time of the light source device, and the light-ceasing time of the light source device in timing with displaying of the above-explained blanking data. The light source device can be provided with a plurality of light sources controllable independently of each other, for example.

The above-explained gate driver can be configured such that each of the plural gate lines or each of output terminals of the gate drivers connected to the gate lines outputs a scanning signal (a gate selection pulse) plural times during one frame period. A first gate selection pulse for writing in video data and a second gate selection pulse for writing in blanking data can be included in the above-mentioned plural gate selection pulses outputted during one frame period.

Further, the above-explained gate driver can be configured such that at least one of the output terminals of the gate drivers or at least one of the gate lines connected to the output terminals of the gate drivers outputs a gate selection pulse only once during one frame period, and the remainder of the output terminals or the remainder of the gate lines output plural times during the one frame period. In this case, it is desirable that the at least one output terminal for outputting a gate selection pulse only once is provided separately from the remainder of the output terminals.

The drain driver can be configured such that it creates the above-explained blanking data.

Each of the above-explained present inventions is applicable to a hold-type active-matrix-driven display device which is provided with a pixel array in the form of a matrix having a plurality of pixels arranged in pixel rows extending in a first direction and pixel columns extending in a second direction intersecting the first direction, each of the plurality of pixels being provided with a switching element; supplies to the pixel array a first signal for controlling groups of switching elements in respective pixel rows from respective ones of a plurality of first signal lines extending in the first direction and arranged in the second direction, and supplies second signals to the switching elements (at least one of the switching elements supplied with the first signal from the first signal line) in the respective pixel columns from a plurality of second signal lines extending in the second direction and arranged in the first direction such that the pixels associated with the switching elements in the respective pixel columns produce specified display conditions. The above-mentioned first signal is called a scanning signal or a gate signal, and the above-mentioned second signal is called a data signal or a drain signal.

This display device is also provided with a first drive circuit for outputting the first signal to each of the first signal lines, a second drive circuit for outputting the second signal to each of the second signal lines, and a display control circuit for transferring to the first drive circuit a timing signal for the first drive circuit to output the first signal, and for transferring to the second drive circuit video data for the second drive circuit to generate the second signal therewith.

Video to be displayed on the display device is periodically supplied to the display control circuit as video information from the outside. In general, the period is called a frame period during which video is displayed over an entire area of the pixel array once. This video information is composed of lateral-direction data read out per horizontal scanning period during one vertical scanning period. Usually, the first and second directions of the pixel array correspond to horizontal and vertical scanning directions, respectively.

In the display device of the above configuration, in an embodiment of the present invention, one frame period includes a first time interval and a second time interval, the first drive circuit supplies one first signal to plural adjacent ones of the plurality of first signal lines during the first time interval and supplies another first signal to the plural adjacent ones of the first signal lines during the second time interval. During the first time interval, the second drive circuit generates the second voltage corresponding to the video data and supplies the second voltage to ones of the plural pixels associated with the plural adjacent ones of the first signal lines supplied with the first signal, and during the second time interval, the second drive circuit generates the second voltage and supplies the second voltage to ones of the plural pixels associated with the plural adjacent ones of the first signal lines supplied with the first signal such that the ones of the plural pixels associated with the plural adjacent ones of the first signal lines supplied with the first signal produce luminance lower than that produced during the first time interval.

In another embodiment of the present invention, the plurality of first signal lines are divided into a plurality of groups each comprising plural adjacent ones of the first signal lines, and one frame period includes at least two scanning periods. The first drive circuit supplies the first signal to the plurality of groups successively during each of the at least two scanning periods with all of the first signal lines of each of the plural groups being supplied with the first signal at one time. During at least one of the at least two scanning periods disposed at a beginning of the frame period, the second drive circuit generates the second voltage corresponding to the video data and supplies the second voltage to ones of the plural pixels associated with one of the plural groups of the first signal lines supplied with the first signal, and during at least one of the at least two scanning periods disposed at an end of the frame period, the second drive circuit generates the second voltage and supplies the second voltage to ones of the plural pixels associated with one of the plural groups of the first signal lines supplied with the first signal such that the ones of the plural pixels associated with the one of the plural groups of the first signal lines supplied with the first signal produce luminance lower than that produced during the at least one of the at least two scanning periods disposed at the beginning of the frame period.

In a similar manner, in a method of driving a display device including a pixel array having a plurality of pixels arranged in rows extending in a first direction and columns extending in a second direction intersecting the first direction, a plurality of first signal lines extending in the first direction and arranged in the second direction, and a plurality of second signal lines extending in the second direction and arranged in the first direction, the method comprises: (a) generating a video signal to be supplied to each of the plurality of pixels, and a scanning signal for determining a timing for supplying the video signals to the plurality of pixels, based upon video information per frame period supplied to the display device; (b) selecting the rows of the pixels successively during the frame period by outputting the scanning signal to respective ones of the plurality of first signal lines; and (c) supplying the video signals to ones of the plurality of pixels belonging to the selected rows of the pixels via the plurality of second signal lines, wherein the plurality of first signal lines are divided into a plurality of groups each comprising plural adjacent ones of the plurality of first signal lines, the method includes: (1) at least two scanning steps for outputting the scanning signal to the plurality of groups of the first signal lines successively, during the frame period with all of the first signal lines of each of the plurality of groups being supplied with the scanning signal at one time; (2) supplying the video signals to ones of the plurality of pixels associated with one of the plurality of groups of first signal lines supplied with the scanning signal by at least one of the at least two scanning steps disposed at a beginning of the frame period, and (3) supplying a voltage to ones of the plurality of pixels associated with one of the plurality of groups of first signal lines supplied with the scanning signal by at least one of the at least two scanning steps disposed at an end of the frame period such that the ones of the plurality of pixels associated with the one of the plurality of groups of first signal lines supplied with the scanning signal produce luminance lower than that produced during the at least one of the at least two scanning steps disposed at the beginning of the frame period.

In another embodiment of the display device in accordance with the present invention, when a first video data and a second video data are supplied to the display device of the above configuration, during a first frame period and a second frame period succeeding the first frame period, respectively, a first drive circuit supplies a first signal to a plurality of first-kind groups successively at least two times during the first frame period, and supplies the first signal to a plurality of second-kind groups successively at least two times during the second frame period, where a respective one of the plurality of first-kind groups comprises N adjacent ones of the plural first signal lines, a respective one of the plurality of second-kind groups comprises N adjacent ones of the N first signal lines, the respective one of the second-kind groups of the first signal lines differ from the respective one of the first-kind groups of the first signal lines, all of the first signal lines of each of the first-kind and second-kind groups are supplied with the first signal at one time, the respective one of the plurality of first-kind groups is displaced by n lines of the first signal lines from one of the plurality of second-kind groups which is nearest to the respective one of the plurality of first-kind groups, N is a natural number equal to or greater than 2, and n is a natural number smaller than N. The second drive circuit generates a second voltage corresponding to the video data and supplies the second voltage to ones of the plurality of pixels associated with one of the first-kind and second-kind groups of the first signal lines supplied with the first signal at at least one of the at least two times of supplying the first signal at a beginning of each of the first and second frame periods, and further the second drive circuit generates the second voltage and supplies the second voltage to ones of the plurality of pixels associated with one of the first-kind and second-kind groups of first signal lines supplied with the first signal at at least one of the at least two times of supplying the first signal at an end of each of the first and second frame periods such that the ones of the plurality of pixels associated with the one of the first-kind and second-kind groups of first signal lines supplied with the first signal produce luminance lower than that produced at the at least one of the at least two times of supplying the first signal at the beginning of each of the first and second frame periods.

In another embodiment of the display device in accordance with the present invention, a plurality of first signal lines are divided into a plurality of groups each comprising plural adjacent ones of the first signal lines, a display control circuit of the display device is successively supplied with video information per two successive frame periods, and thereby generating a timing signal for determining a timing for a first drive circuit to output a first signal per frame period, and generates video data used for generation of a second signal by a second drive circuit and blanking data for producing a gray scale level lower than a gray scale level produced by the video data, transfers the timing signal to the first drive circuit, and transfers the video data and the blanking data to the second drive circuit. The first drive circuit supplies the first signal to the plurality of groups successively at least two times during each of a first frame period of the two successive frame periods and a second frame period of the two successive frame periods succeeding the first frame period with all of the first signal lines of each of the plurality of groups being supplied with the first signal at one time, and the second drive circuit generates the second voltage corresponding to the video data and supplies the second voltage to ones of the plurality of pixels associated with one of the plurality of groups of the first signal lines supplied with the first signal at at least one of the at least two times of supplying the first signal in a former half of each of the two successive frame periods, and generates the second voltage based upon the blanking data and supplies the second voltage to ones of the plurality of pixels associated with one of the plurality of groups of the first signal lines supplied with the first signal at at least one of the at least two times of supplying the first signal in a latter half of each of the two successive frame periods. In one of the display devices of the above configuration, the display control circuit compares a second one of the video information corresponding to the second frame period with a first one of the video information corresponding to the first frame period, and generate the blanking data used in the latter half of the first frame period such that the blanking data provides luminance in ones of the plurality of pixels exhibiting a difference in gray scale level between the first and second ones of the video information, different from luminance in a remainder of the plurality of pixels. On the other hand, in another of the display devices of the above configuration, the display control circuit compares a second one of the video information corresponding to the second frame period with a first one of the video information corresponding to the first frame period, and generate the video data used in the former half of the second frame period such that the video data enhances a difference in gray scale level between the first and second ones of the video information in ones of the plurality of pixels exhibiting the difference.

The functions and advantages of the above-described present inventions and the details of the preferred embodiments of the present inventions will become clear from the subsequent explanation.

BRIEF DESCRIPTION OF THE DRAWINGS

In the accompanying drawings, in which like reference numerals designate similar components throughout the figures, and in which:

FIG. 38 is a table tabulating various pixel array specifications;

FIG. 39 is a table tabulating various video formats specified for digital broadcast;

FIG. 40 is a table tabulating various typical combinations of pixel arrays and aspect ratios;

FIG. 41 is a table tabulating various typical combinations of pixel arrays and aspect ratios;

FIG. 42 is a table tabulating control information and its examples store in a header region of FIG. 16;

FIG. 43 is a table tabulating control information for controlling of backlights;

FIG. 44 is a table tabulating control parameters added to the parameters of FIG. 42, in Embodiment 1;

FIG. 45 is a table tabulating control parameters in Embodiment 4; and

FIG. 46 is a table tabulating control parameters in Embodiment 5.

DETAILED DESCRIPTION OF THE PREFERRED EMBODIMENTS

Referring now to the liquid crystal display devices illustrated in Embodiments 1 to 11 and the accompanying drawings related to each of the embodiments, the specific embodiments of the display device in accordance with the present invention will be described.

<Embodiment 1>

Figure 1:
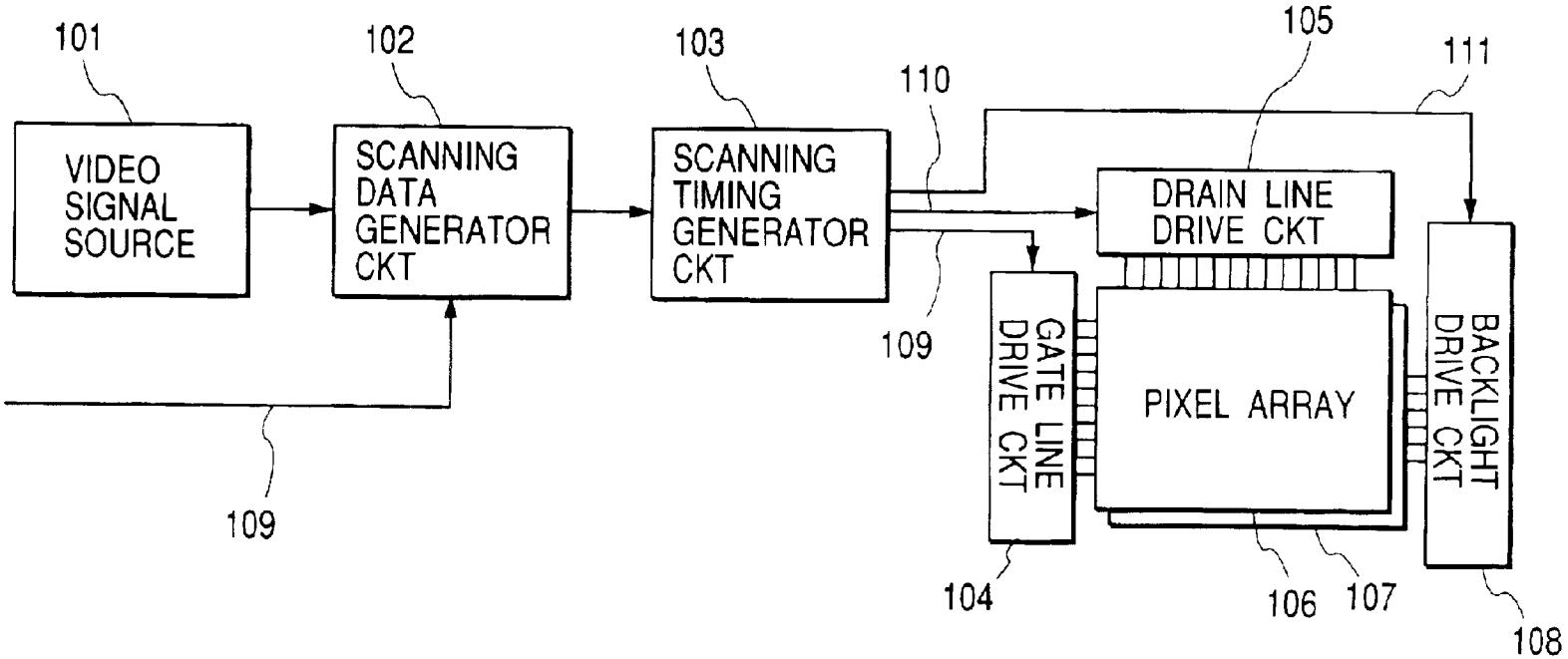
FIG. 1 is a system configuration diagram showing a display device of the present invention.

FIG. 1 is a block diagram showing a system provided with a liquid crystal display device in accordance with Embodiment 1.

This system is constructed as a part of a personal computer or a television set and includes not only a liquid crystal display device or a liquid crystal display module, but also includes a central processing unit (CPU) of the computer for transmitting video data to the liquid crystal display device or liquid crystal display module, a receiver of the television set, and a decoder of a digital versatile disc (DVD) and the like as a video signal source 101

The video data (video signal) generated by or reproduced by this video signal source 101 is received at an interface of the scanning data generator circuit 102, the format of the video data is converted and the picture of the liquid crystal display device is scanned a plurality of times to generate the video data suitable for reproduction. For example, the scanning data generator circuit 102 decomposes the data of the moving image transmitted continuously from the video signal source 101 into data of "picture" displayed on the picture area of the liquid crystal display device for each unit of time called a frame period or a field period described later. Accordingly, the scanning data generator circuit 102 can also be called a plural-time-scanning data generator circuit. The data of "picture" generated in this way is reproduced within the aforesaid unit of time by a plurality of pixels arranged two-dimensionally in the picture area of the liquid crystal display device. Each of the plurality of pixels is provided with an electrode (also called a pixel electrode) to which a voltage corresponding to the video data is applied and an active element or a switching element for applying a voltage to this electrode. In addition, timing of applying a voltage to the electrode is controlled by a scanning signal supplied to the active element or switching element. The voltage applied to each of the pixels in accordance with the video data is generated as a gray scale voltage (also called a video signal) by a drain line drive circuit 105 described later.

This scanning signal is generated by the gate line drive circuit (also called a gate driver or a scanning signal drive circuit) to which a timing signal (also called a clock) generated by a scanning timing generator circuit (a plural-time scanning timing generator circuit) 103 in accordance with the video data generated by the scanning data generator circuit 102. The scanning timing generator circuit 103 is often included in a control circuit of a liquid crystal display device or a liquid crystal display module together with the scanning data generator circuit 102 or part of the scanning data generator circuit 102. This control circuit is called a timing controller.

A picture area (a display area) of the liquid crystal display device having a plurality of aforesaid pixels arranged in a two-dimensional manner is indicated in FIG. 1 as a pixel array (a pixel element array) 106. In addition, a plurality of gate lines driven by the gate line drive circuit 104 and a plurality of drain lines driven by the drain line drive circuits 105 are arranged in the picture area in a matrix form (not shown). A thin film transistor (abbreviated as TFT) acting as the aforesaid active element is arranged at a position near an intersection between the gate line and the drain line so as to form the aforesaid pixel. The gate line drive circuit 104 is controlled by the scanning timing generator circuit 103 through the gate line control bus 109, and the drain line drive circuit 105 is controlled by the scanning timing generator circuit 103 through a drain line control bus 110. Incidentally, the pixel array 106 corresponds to the so-called liquid crystal display panel (a liquid crystal display element) in the liquid crystal display device or the liquid crystal display module. Further, a gate line control bus 109 connected to the scanning data generator circuit 102 inputs a signal determining an initial condition of the operation of the liquid crystal display device to the scanning data generator circuit 102.

Meanwhile, a backlight 107 is mounted on the rear side (a back surface) of the picture area as seen from a user of the liquid crystal display device and is driven by a backlight drive circuit 108 controlled by the scanning timing generator circuit 103 through a backlight control bus 111.

Figure 2:
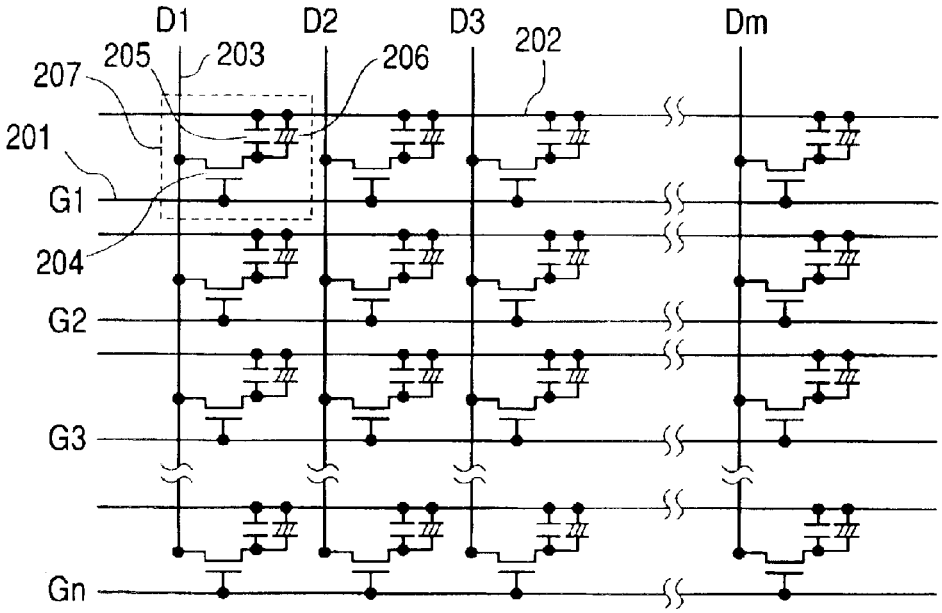
FIG. 2 is an equivalent circuit diagram of a pixel array of the present invention.

A plurality of pixels 207 (one of them is indicated by an area enclosed by a dotted line) are arranged to form a matrix with m×n. For instance as shown in FIG. 2, each of pixels 207 has a switching element 204 controlled by any one of gate lines G1 to Gn (n is a natural number) and receives a video signal from any one of drain lines D1 to Dm (m is a natural number) through the switching element. In the pixel 207 shown in FIG. 2, the thin film transistor (TFT) acting as a switching element 204 is provided at an intersection between the gate line 201 and the drain line 203. Reference numeral 201 denotes a gate line irrespective of the aforesaid addresses G1 to Gn and reference numeral 203 denotes a drain line irrespective of the aforesaid addresses D1 to Dn. A capacitor 206 composed of a liquid crystal and two electrodes holding this liquid crystal therebetween is formed in the pixel 207, and one of the electrodes forming the capacitor 206 is connected to a source of the TFT 204.

The aforesaid video signal is supplied as a gray scale voltage (described later) from the aforesaid drain line drive circuit 105 to the drain line 203 and applied to one of the electrodes forming the aforesaid capacitor 206 through the TFT 204 that is turned on or off with the scanning signal applied in sequence from the aforesaid gate line drive circuit 104 to the gate line 201. Incidentally, in the specification of the present invention, it is conveniently defined such that, irrespective of a potential between the capacitor 206 of the TFT 204 having a field effect transistor structure and the drain line 203, the former is called a source and the latter is called a drain. A holding capacitor 205 (Cstg type) in the pixel 207 is formed between the source of the TFT and a common signal line 202.

As long as the liquid crystal display device has a field effect transistor as an active element, the equivalent circuit shown in FIG. 2 is applicable irrespective of switching modes such as IPS (In-Plane Switching), TN (Twisted Nematic), MVA (Multi-domain Vertical Alignment) and OCB (Optical Compensated Birefringence). In addition, the equivalent circuit is applicable even if its channel layer is formed by any one of a-Si (amorphous silicon), p-Si (polycrystalline silicon) and pseudo single-crystal of silicon. On the other hand, in the case where the present embodiment is applied to an electroluminescent type display device that is represented by a TFD type or MIM type liquid crystal display device or an organic EL panel, the TFT 204 in the equivalent circuit in FIG. 2 is replaced with a diode element.

Figure 3:
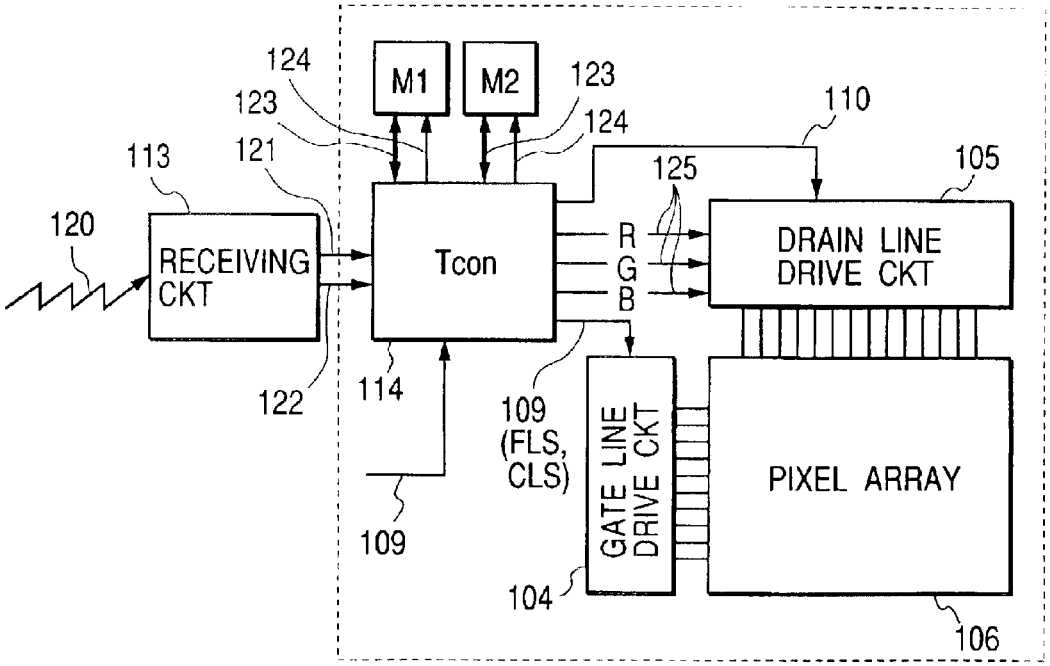
FIG. 3 is a block diagram showing a circuit configuration of an example of the display device of the present invention.

When a television video signal is received with such a display device, the block diagram of FIG. 1 can be revised as indicated in FIG. 3. In FIG. 3, a block enclosed by a dotted line frame belongs to the so-called display module and a receiving circuit 113 is connected to the display module as the so-called external circuit. The receiving circuit 113 receives television-broadcasting 120 and expands its compressed video data. Although the video data is transmitted as analogue data in an interlace mode with 60 Hz so as to reduce a load applied to the television broadcasting, the video data is sometimes transmitted in a progressive mode with 60 Hz or in digital data. When the video data is expanded in the receiving circuit 113, the data received through the interlace mode is converted into a progressive mode in some cases or the data received by the progressive mode is converted into the interlace mode in some cases. In addition, when the video data in the receiving circuit is expanded, the video data is converted while resolution of the video data is being matched with a resolution of the pixel element array 106 loaded in the display module.

The resolution of the pixel-element array 106 is defined by the number (m) of a plurality of pixels 207 arranged in a row direction (a horizontal direction) and the number (n) of a plurality of pixels 207 arranged in a column direction (a vertical direction), which pixels are arranged in an effective display area of the display device shown in FIG. 2, for example. Alternatively, the resolution of the pixel-element array may be defined by replacing the former number (m) of pixels and the latter number (n) of pixels with the number of drain lines 203 and the number of gate lines 201, respectively. The resolution of the pixel array is standardized as a display definition of the display device. For example, in the effective display area of the display device of XGA class, 1024 pixels are arranged along the row direction (the horizontal direction) and 768 pixels are arranged along the column direction (the vertical direction). However, in the case of the display device applicable to the color video display, the pixels arranged in the horizontal direction are divided into the primary colors of red (R), green (G) and blue (B), with the result that the number of pixels (m) in the horizontal direction is 3072, which is three times the aforesaid 1024 pixels. In the case of the effective display area of the display device of SXGA class having a higher display definition than that of XGA class, 1280 pixels (3840 pixels in the case of color display) are arranged in the horizontal direction and 1024 pixels are arranged in the vertical direction.

Meanwhile, the resolution of the video data inputted to the receiving circuit through television broadcasting is classified as a vertical resolution of **480*i* or 480*p* for 480 scanning lines (the pixel row composed of a plurality of pixels arranged in the horizontal direction) arranged in a vertical direction of the picture area, 720*i* or 720*p* for 720 scanning lines, and 1080*i* or 1080*p*** for 1080 scanning lines, for example. This vertical resolution corresponds to the number (n) of pixels (strictly speaking, the number of pixel rows) arranged in a column direction (a vertical direction) in the effective display area of the display device. Characters (i) and (p) affixed to the vertical resolutions indicate the video data received by the interlace mode and those received by the progressive mode, respectively. In the case where the number of pixel rows in the vertical direction of the video data received is different from that in the effective display area of the display device, the conversion of resolution, the so-called scaling is carried out by the aforesaid receiving circuit.

Each of the video data inputted to the receiving circuit is divided into odd line data and even line data; the odd line data means that the pixels in the display device corresponding to the video data belong to the odd pixel rows when counted in a vertical direction from the upper side in the effective display area; and the even line data means that the pixels in the display device corresponding to the video data belong to the even pixel rows when counted from the upper side of the effective display area. In the aforesaid interlace mode, the video data composed of odd line data and the video data of even line data are inputted alternatively to the receiving circuit for each field period. Each field period where the odd line data or even line data is inputted to the receiving circuit is 16.7 ms (millisecond), for example, and the odd line data and the even line data are inputted to the receiving circuit with the period of 33 ms (30 Hz in terms of frequency) are inputted to the receiving circuit. In contrast to this, in the aforesaid progressive mode, the odd line data and the even line data are inputted to the receiving circuit in the frame period of 16.7 ms (60 Hz in terms of frequency). The video data inputted to the receiving circuit in the interlace mode is expanded by the receiving circuit for each field period and the video data inputted to the receiving circuit in the progressive mode is expanded by the receiving circuit for each frame period and the aforesaid processing is performed. The processing for this video data is carried out in the video signal source 101 and part of the scanning data generating circuit 102 shown in FIG. 1. The expanded video data (display data) 121 and the associated timing signal 122 (also called a display control signal or an external clock signal) are sent to a timing controller 114 (also called a display control circuit) provided in the display module.

Figure 4A:
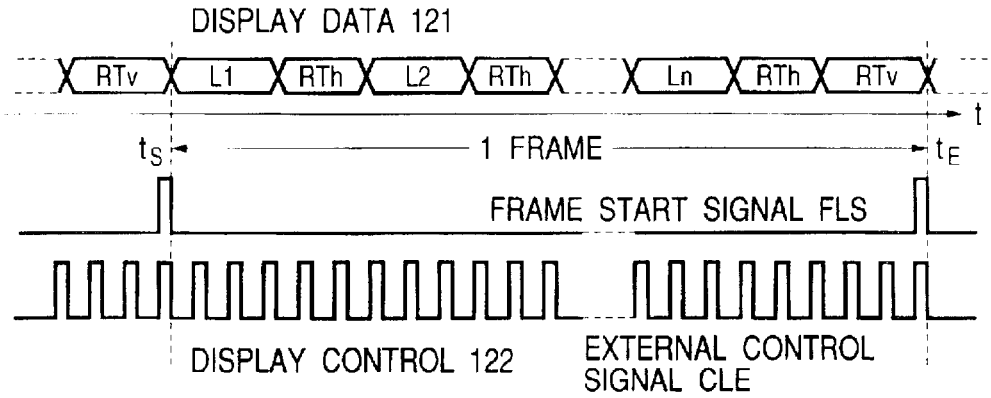
FIGS. 4A and 4B are illustrative diagrams showing a function of a display control circuit installed in the display device of the present invention, FIG. 4A being an eye diagram of video data and FIG. 4B being a configuration of a display control circuit.
Figure 4B:
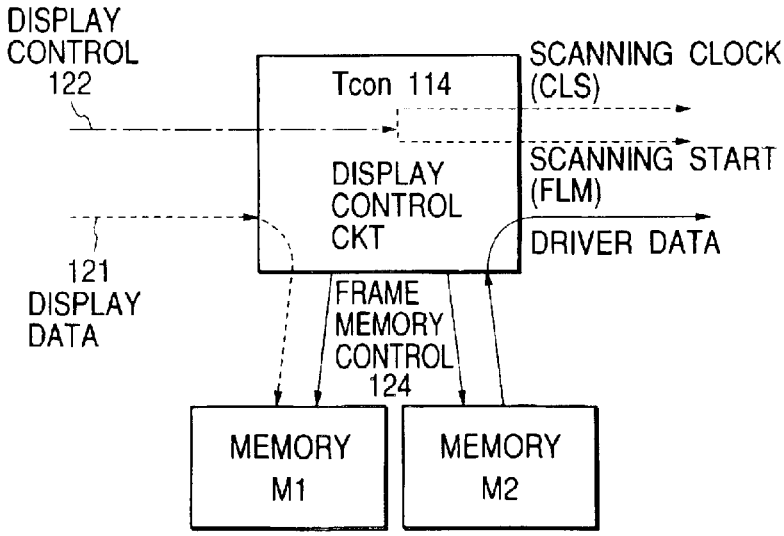

The video data 121 inputted to the timing controller 114 is once stored in any of either a memory M1 or a memory M2 for each frame period or field period described above and then transmitted to the aforesaid drain line drive circuit 105 in response to a clock signal generated by the display control signal (an external clock signal) 122 sent from the receiving circuit 113 to the timing controller 114. This state is schematically illustrated in FIG. 4. The memories M1, M2 for temporarily storing the video data 121 are each called a frame memory and a plurality of memories (at least two) are connected to the timing controller 114. Two memories arranged as indicated in FIGS. 3 and 4 or not less than four memories may be provided in accordance with a long or short period of time of the frame period or the field period and a period of time required for storing the video data in the memory for each period. The video data 121 is configured such that the data groups L1, L2, . . . Ln for each pixel row as indicated in FIG. 4A are arranged in series with a horizontal retrace period being held between the adjacent data groups, and a vertical retrace period RTh is provided immediately after the last data group in the vertical direction of the effective display area, followed by the video data 121 of the subsequent frame period. An eye diagram of the video data 121 shown in FIG. 4A indicates that of the progressive mode. In the interlace mode, the data groups of only either the odd lines (L1, L3, . . . Ln−1) or the even lines (L2, L4, . . . Ln) are arranged for each field period described above with the horizontal retrace period RTh being held between them. As shown in FIG. 4B, when two memories, a first memory M1 and a second memory M2, are connected to the timing converter 114, the video data 123 stored in the second memory (illustrated as M2 in FIG. 4B) in a certain frame period (a progressive mode) or a certain field period (an interlace mode) is read out of the second memory while the subsequent video data 123 is stored in the first memory (illustrated as M1 in FIG. 2) in the next frame period or field period subsequent to this frame period or field period, and then the video data 123 is supplied to a drain line drive circuit 105 (refer to FIG. 3) through a drain line control bus 110. The video data 121 is sometimes called a driver data at a stage in which it is read out of the memory. In addition, and in the driving operation of the display device in accordance with the present invention described below, a time required for storing the video data 123 corresponding to either the frame period or the field period may be allowed to differ from a time required for reading out data from the memory as a driver data in some cases.

The data groups for each pixel row forming the video data 121 inputted to the timing controller 114 in the display device applicable to the color video display are formed such that a datum associated with each of the pixels 207 arranged side by side in a horizontal direction of the pixel array 106 is arranged in sequence according to color, i.e., red (R), green (G) and blue (B). In FIGS. 5B and 5C are shown two examples of the data group L1 corresponding to the pixel groups PIX (1, 1) to PIX (m, 1) having switching elements driven by the gate line G1 in the display device provided with pixel array shown in FIG. 5A. Each of the pixels constituting this pixel array is identified by an address PIX (x, y) determined by the number (x) of the drain line for supplying a video signal to the pixel and the number (y) of the gate line controlling the switching element connected to the drain line. In addition, the pixel PIX (3N, y) having x as a multiple of 3 displays blue, the pixel PIX (3N−1, y) having x as the number in which 1 is subtracted from a multiple of 3 displays green and the pixel PIX (3N−2, y) having x as the number in which 2 is subtracted from a multiple of 3 displays red (where, N is a natural number and has a relation of $3N \leqq m$). FIG. 5B shows a mode called 1 pixel single interface acquisition in which the video data is received in sequence for each pixel in the case where one pixel unit in the display device is defined as a unit including the respective pixels for red display, green display and blue display. In contrast to this, FIG. 5C shows a mode called a 2-pixel parallel interface acquisition in which video data are received in parallel for each 2 pixels. When a frequency of the display control signal (an external clock signal) 122 is increased as a display definition of the display device is increased, the latter mode becomes advantageous and concurrently it is desired to add the aforesaid frame memory.

Meanwhile, the timing controller 114 processes the display control signal 122 inputted together with the video data 121 with a frequency divider circuit incorporated therein or the like and produces a frame memory control signal 124 for use in reading out the video data 123 from the memory, a clock signal for use in adjusting timing where a video signal (a voltage signal applied to the pixel) is produced by the drain line drive circuit 105 in accordance with the video data 121, and a scanning start signal FLM, a scanning clock signal CLS or the like for adjusting timing where the video signal is applied to each of the pixels in the pixel array. In the timing controller 114, a timing signal required for the display device (a display module) is produced by the scanning timing generator circuit 103 shown in FIG. 1 on the basis of the aforesaid external clock.

The timing controller 114 produces several kinds of gray scale voltages in accordance with the video data, in common to red, green and blue and sends them to the drain line drive circuit 105 so as to display a desired image at the pixel array 106 by the video data sent to the drain line drive circuit 105. In FIG. 3, although the gray scale voltage supply lines 125 for their respective colors are shown one by one, in practice, a plurality of gray scale voltage supply lines are provided for each color; for example, 18 gray scale voltage supply lines are provided for each color. In the drain line drive circuit 105, a gray scale voltage to be applied to each of the plurality of pixels included in the pixel row corresponding to the data groups is selected for each of the data groups of the aforesaid video data inputted to the drain line drive circuit. In the following description, the gray scale voltage applied to the pixel is also referred to as a video signal or a blanking signal in accordance to its object. A voltage suitable to the blanking signal may be selected from the plurality of gray scale voltages generated as described above and is applied to the pixel, while a voltage exclusive for the blanking signal may generated at the timing controller 114, drain line drive circuit 105 or a power supply circuit installed at the display device (a display module) and the like and this generated signal is applied to the pixel.

Inputting of the video data into the display device (display module) and the processing of the video data at the display device described above can be applied not only to a liquid crystal display device, but also to such a display device as one in which either an electroluminescent element (EL element) or a field emission element (FE element) is arranged for each pixel. Accordingly, although a drive mode of the display device in accordance with the present invention will be described under an assumption that the device is the liquid crystal display device, it is apparent that this drive state can be applied to the display device or the like using electroluminescent elements. Incidentally, although the liquid crystal display apparatus is sometimes provided with dummy pixels, dummy pixel rows and dummy pixel columns, on the periphery of the aforesaid effective display area, the pixels except those of the effective display area and their drive modes are omitted in the following description unless otherwise specified.

Figure 6:
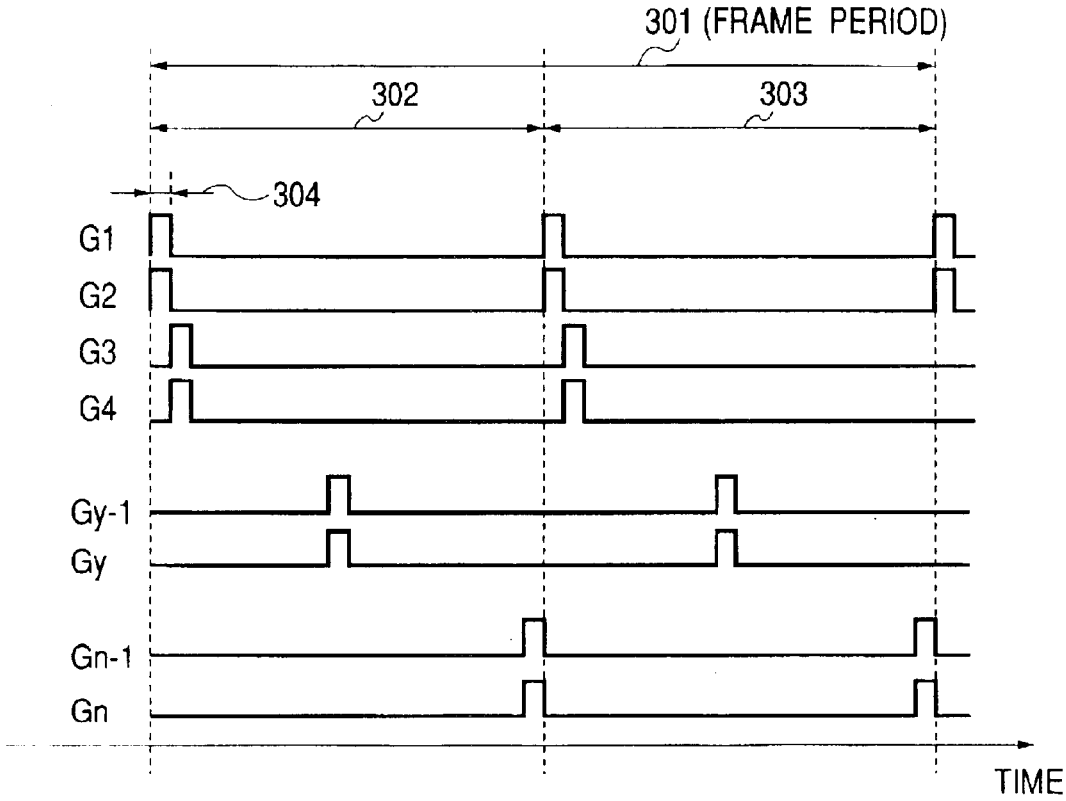
FIG. 6 is a timing chart for a gate selection pulse of a display device driven by 2-line simultaneous write-in and 2-line skip-scanning described in Embodiment 1 of the present invention.

FIG. 6 is a timing chart of output pulses of the gate line drive circuit 104 for driving the gate lines G1 to Gn in the liquid crystal display device having the pixel array 106 shown in FIG. 2. Waveforms of Gy−1 and Gy in FIG. 6 indicate output pulses outputted to the two gate lines (not shown in FIG. 2) arranged between the gate lines G4 and Gn−1 (y is a natural number and has a relation of $6<y<n-1$). This gate line drive pulse is operated such that a gate drive circuit control signal such as a clock or the like generated by the scanning timing generator circuit 103 shown in FIG. 1 is supplied to the gate line drive circuit 104 and this is generated within this gate line drive circuit.

In the case where the video data is inputted to the liquid crystal display device in the interlace mode, the video signal to be inputted to the pixel groups of the odd lines and the video signal to be inputted to the pixel groups of even lines are alternatively generated for each frame period 301 shown in FIG. 6. In addition, in the case where the video data (the aforesaid video data including not only moving images but also still images) is inputted to the liquid crystal display device in the progressive mode, the video signals to be inputted to all the pixels of the display area are generated for each frame period 301 shown in FIG. 6. In the case where a transmission frequency of the video data is 60 Hz, the frame period 301 is 16.7 ms millisecond). For such inputting of video data into the liquid crystal display device as above, the video signal generated by this operation is inputted to each of the pixels 207 (FIG. 2) arranged in the pixel array 106 for a video scanning period 302 of about 8.4 ms set at a front half of the frame period 301, and the blanking signal generated in correspondence with this frame period 301 is inputted to each of the pixels 207 (FIG. 2) arranged in the pixel array 106 for a blanking scanning period 303 set at a rear half of the frame period 301. The respective lengths of the video scanning period 302 and the blanking scanning period 303 are each ½ of the frame period 301 (16.7 ms) of the video data inputted to the interface (the timing controller 114 in the present embodiment) of the display device (display module).

Operation for inputting either the video signal or the blanking signal into the pixel in the pixel array as described above is referred to as data writing to the pixel. In addition, a plurality of pixels 207 arranged along the aforesaid gate line 201 (in other words, forming pixel rows) in the pixel array shown in FIG. 2 are selected through inputting of the scanning signal into the gate line 201 connected to active elements (TFT 204) arranged at these pixels, whereby either the video signals or the blanking signals are inputted to these plurality of pixels 207. For example, a plurality of pixels (pixel rows) along the gate line G1 are selected by a scanning signal having a pulse width of the gate selection period 304 indicated in the waveform G1 in FIG. 6 and a plurality of pixels (pixel rows) along the gate line Gy−1 are selected by a scanning signal having a pulse width of the gate selection period 304 indicated in the waveform Gy−1 in FIG. 6.

The active elements (switching elements, the TFT 204 in the present embodiment) arranged in each of the selected pixels are turned on within the scanning signal input period and then a voltage corresponding to the video signal or the blanking signal is applied to one of a pair of electrodes (also called the pixel electrode) forming the capacitor 206 in FIG. 2 through the active elements. The operation for selecting the pixel rows as described above is also called line selection. An operation for supplying the video signal to each of the pixels included in the selected pixels and applying a video signal (a signal voltage) to the pixel electrode arranged at each of the pixels is also called video writing to the line. The video writing to the line in the display device having the electroluminescent element arranged for each pixel is carried out such that a carrier (electron or positive hole) corresponding to the video signal is injected into the electroluminescent element through the active element controlled by the associated line (gate line or scanning signal line).

As described above, the operation in which either applying of voltage to the pixel electrode or carrier injection into the electroluminescent element in each of the pixel groups driven by either a specified gate line or a specified scanning signal line and the like is carried out for the video signal and for such another object as blanking signal or the like is called data writing to the line. The line used in the following description means a signal line for controlling the active element arranged at a specified pixel group such as a gate line or a scanning signal line etc. unless otherwise specified. In addition, the operation of writing data into the line means that the active element is controlled by the gate line or the scanning signal line specified as the specified line, and a predetermined voltage is applied to a pixel electrode connected to this active element or a predetermined amount of carriers is injected into a light emitting element such as an electroluminescent element connected to this active element.

In the case of performing the drive mode shown in FIG. 6, two adjacent gate lines (e.g., G1 and G2, or Gn−1 and Gn) are selected simultaneously and the same video signal is written to the pixels in the adjacent pixel rows for each pixel column. In view of the fact that a gate selection period 304 is substantially coincident with an image writing period for the selected pixel row, the driving mode shown in FIG. 6 is carried out such that a plurality of pixel rows are selected simultaneously within a conventional video writing period in which the pixel row is selected by one line and a image is written the pixel row, and then the images are written into these pixel rows. The conventional video writing period is defined as a period required for inputting an image data (a video data) corresponding to one frame period or one field period to the display device (a liquid crystal display module) from the receiving circuit shown in FIG. 3.

As shown in the timing chart of FIG. 6, an operation for always simultaneously selecting the gate lines in the display array 106 for each two lines and writing an image for each of the pixel groups each having the active elements controlled by the associated line in these two lines is also called 2-lines simultaneous write-in or 2-lines skip-scanning. In addition, an operation in which if the number of gate lines selected simultaneously is N (N is a natural number not less than 3) and an image is written for each pixel group in N lines is also called N-lines simultaneous write-in or N-lines skip-scanning.

In the operation of the 2-lines simultaneous write-in (2-lines skip-scanning), gate lines G1, G2 are selected simultaneously within the video write-in period 302, images are written into the two pixel rows, then gate lines G3, G4 are selected while skipping the gate lines G1, G2 and images are written into the two pixel rows. The same images are written for each pixel column to the two pixel rows corresponding to the pair of gate lines and to the two pixel rows corresponding to the gate lines G3, G4 within the period in which the gate lines G1, G2 are selected.

This 2-lines simultaneous write-in operation will be described as follows in reference to a driver data output from the timing converter 114 in FIG. 4B and the pixel array in FIG. 5A.

At first, in the case where driver data is outputted in the interlace mode, the pixel groups PIX(1, 1), PIX(2, 2), . . . PIX(m, 1) corresponding to the gate line G1 and the pixel groups PIX(1, 2), PIX(2, 2), . . . PIX(m, 2) corresponding to the gate line G2 are selected and the video signal to be supplied to any one of these pixel groups are supplied to two pixel groups. For example, a video signal to be supplied to PIX(5, 1) in the first row is supplied to both the pixels of pixel PIX(5, 1) in the first row and pixel PIX(5, 2) in the second row, and a video signal to be supplied to PIX(m−1, 1) in the first row is supplied to both the pixels of pixel PIX(m−1, 1) in the first row and pixel PIX(m−1, 2) in the second row. Then, the pixel groups PIX(1, 3), PIX(2, 3), . . . PIX(m, 3) in the third row corresponding to the gate line G3 and the pixel groups PIX(1, 4), PIX(2, 4), . . . PIX(m, 4) in the fourth row corresponding to the gate line G4 are selected and a video signal to be supplied to any one of these pixel groups in the third row or pixel groups in the fourth row is supplied to both the pixel groups of the third row and pixel groups of the fourth row. For example, a video signal to be supplied to the pixel PIX(5, 3) in the third row is supplied to both the pixel PIX(5, 3) in the third row and the pixel PIX(5, 4) in the fourth row, and a video signal to be supplied to the pixel PIX(m−1, 3) in the third row is supplied to both the pixel PIX(m−1, 3) in the third row and the pixel PIX(m−1, 4) in the fourth row. Subsequently, a similar operation is repeated until it reaches the gate line (Gn in FIG. 2) arranged at an end part of the effective display area of the display device.

Also in the case where the driver data is outputted in the progressive mode, supplying of the video signal to the pixel group corresponding to the gate line G1 and the pixel group corresponding to the gate line G2 or the pixel group corresponding to the gate line G3 and the pixel group corresponding to the gate line G4 is carried out in the substantial same procedure as that of the aforesaid interlace mode. However, the driver data outputted in the progressive mode prohibits occurrence of the video signals in the pixel groups corresponding to any one of the odd-numbered gate lines G1, G3, G5, . . . or the even-numbered gate lines G2, G4, G6, . . . because the video signals in the pixel groups corresponding to all gate lines arranged in the effective display area of the display device are generated by the drain line drive circuit.

When such video writing into the pixel groups of two rows corresponding to a pair of gate lines is carried out at the same speed as that of video writing into the pixel group in one row corresponding to one conventional gate line, the video writing (video writing corresponding to either one frame or one field) into the pixels (hereinafter referred to as a pixel array) corresponding to all the gate lines arranged in the effective display area is completed in a half of the period of time required for the conventional video writing (one frame period or one field period). As described above, the period of time for writing the video into the pixel array of the display device is often dependent on a period of time required for inputting the video data 121 corresponding to one frame or one field to the display device. Accordingly, introduction of the 2-lines simultaneous write-in operation in accordance with the present invention in the display device enables the remaining half of one frame period or one field period where the video data 121 is inputted to this display device to be utilized as a scanning period in which another signal can also be written into the pixel array. This is also apparent from the fact that the video writing in the frame period 301 (corresponding to either one frame period or one field period in which the aforesaid video data 121 is inputted to the display device) described in reference to FIG. 6 is completed in the front half of the frame period 301, i.e., in the video scanning period 302 and a period of time used for the blanking scanning period 303 is generated in the rear half of the frame period 301.

In accordance with the present invention, the blanking data (black data is preferable) is supplied to the pixel array through the aforesaid simultaneous write-in (2-line skip-scanning) in this new generated scanning period (the blanking scanning period 303 in FIG. 6). In other words, in accordance with the present invention, an image is formed in a period of time corresponding to one frame period or one field period and the image is blanked from the pixel array with the blanking data in the rear half of this period of time. In a liquid crystal display array for performing a hold-type displaying operation by carrying out both displaying of the image and blanking display at the pixel array in one frame period, an impulse type displaying characteristic found in a Braun tube is reproduced in a pseudo manner, whereby its moving image display performance is improved. Further, the aforesaid black data is a pseudo-video signal for decreasing (e.g., making minimum) a light transmission in the liquid crystal layer in the liquid crystal display device. In addition, this black data is a signal for discharging carriers injected into the electroluminescent element in the display device having the electroluminescent element.

When the blanking data is written into the array, a full scanning period for the video data and the blanking data can be further shortened by a scanning method different from that of the video data writing-in operation if the 2-line simultaneous write-in and 2-line skip-scanning is performed at the time of writing-in of the video data and if the 4-line simultaneous write-in and 4-lines skip-scanning is performed at the time of writing-in of the blanking data. However, as an interval error between a video signal applying time for the pixel group corresponding to each of the gate lines and a blanking signal applying time among the gate lines (scanning signal lines) is made low, non-uniformity in display at the picture of the display device is suppressed, so that the above scanning method is carried out by the same scanning method for the video data writing-in operation and the blanking data writing-in operation in the present embodiment.

Figure 7:
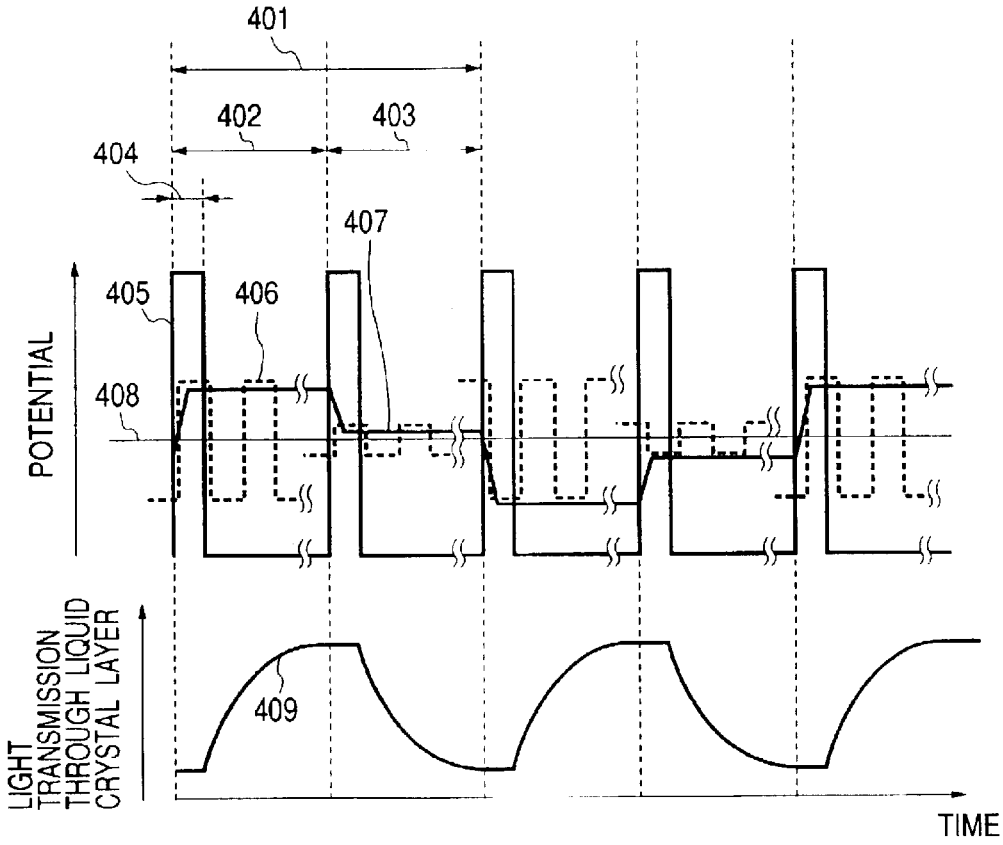
FIG. 7 is a diagram showing each signal line driving waveform of the liquid crystal display device driven by 2-line simultaneous write-in and 2-line skip-scanning and an optical response waveform of the liquid crystal described in Embodiment 1 of the present invention.

FIG. 7 shows each of signal line drive waveforms based on one pixel of the pixel array and an optical response waveform in a liquid crystal. Reference numeral 401 denotes one frame period; 402 a video data writing-in period arranged in the front half of the frame period 401; and 403 a blanking period arranged in the rear half of the frame period 401. In addition, reference numeral 404 denotes a gate selection period in one line that coincides with the writing-in period of the video signal or the blanking signal for the pixel controlled by the selected gate line. A solid curve 405 indicates a gate line drive waveform. The gate line is selected twice within one frame period 401 by performing the 2-line simultaneous selecting operation (2-line skip-scanning) at a timing indicated in FIG. 6. A dotted curve 406 indicates a drain line drive waveform that is drawn on the assumption of providing dot inversion driving in a normally black mode. A polarity of the drain line drive waveform 406 with respect to a common level 408 (a potential of the counter electrode described above) is inverted every gate selection period 404. However, since the gate lines are selected by two lines in each of the gate selection periods and the image is written simultaneously in the pixel rows associated with of the respective gate lines, the display device is driven under a 2-line dot inversion. A polarity of voltage (a writing polarity) applied to the aforesaid pixel electrode is also inversed in response to the inversion of the polarity of the drain line drive waveform 406 with respect to the common level 408. Such a periodical inversion of the write-in polarity as described above is called an alternation of writing-in polarity. Although it is not necessarily required to make the alternation of writing-in polarity as indicated in FIG. 7 every time the writing-in for each of the lines is carried out, it may be carried out every n-time of writing-in operations or for each frame period 401.

In the present embodiment, since the same data is written in the plurality of lines in a simultaneous manner, this operation can be completed within the conventional writing-in period. However, simultaneous writing-in of data into the plurality of lines causes the number of pixel electrodes to which a voltage is applied to increase twice or more in the liquid crystal display device, it is highly probable that the writing-in current required for this operation is increased more than that of the prior art. However, in view of supplying capability of writing-in current of the drain line drive circuit 105, inversion of the aforesaid writing-in polarity for each frame period 401 enables an increase in the required writing-in current value to be suppressed, so that the writing-in characteristic is maintained while suppressing a load on the display module, thereby improving the display module. The waveform 406 of the drain line drive voltage output from the drain line drive circuit 105 to the drain line 203 is changed into an alternation form in such a way that the video signal and the blanking data are written in the same polarity for each one frame period (a signal voltage corresponding to each of the data being set to a higher or lower level than a potential of the aforesaid common level 408). For this reason, in the case where the same data is always written in each of the blanking periods for each frame period, the polarity of voltage signal corresponding to the blanking data is inversed for each frame period 401, whereby a dc-induced image retention generated when the same polarity is kept over the plurality of frame periods is suppressed.

The solid curve 407 denotes a source voltage waveform, the solid line 408 denotes a common level and then a differential voltage between them is applied to the liquid crystal. In the case where a liquid crystal cell provided in each pixel is assumed to be a capacitor 206 shown in FIG. 2, a potential of one electrode (pixel electrode) positioned on a side of the TFT 294 in a pair of electrodes forming this capacitor is represented by the source voltage waveform 407 and a potential of the other electrode (opposite electrode) positioned on a side of the common signal line 203 is represented by the common level 408 in a pair of electrodes. A solid curve 409 indicates an optical response waveform of liquid crystal. When the image is written into the pixel within the front half of one frame period 401 or a write-in period 402, a light transmission of the liquid crystal layer corresponding to this pixel starts to response of display of the image as indicated by the optical response waveform 409. In FIG. 7, a light transmission in the liquid crystal layer is saturated with a value required for a pixel corresponding to this liquid crystal layer immediately before the video writing-in period 402 is completed. However, a light transmission in the liquid crystal layer corresponding to a pixel displaying either black or color near black is scarcely increased in this video writing-in period 402.

After this operation, when the blanking data is written into the pixel in the rear half of one frame period 401 or the blanking period 403, the light transmission of the liquid crystal layer is gradually decreased and it is changed to a black level immediately before the end of the blanking period (or one frame period 401). In this way, each of the light transmissions in the liquid crystal layer corresponding to the pixel is set to a desired value in accordance to a video response for each frame period and subsequently the light transmission is set to the minimum value in accordance to black response. These operations are repeated to provide an optical characteristic similar to an impulse type optical characteristic to the liquid crystal display element having a hold-type display characteristic, thereby improving its moving image displaying performance.

The light transmission of the liquid crystal layer shows a steep impulse-like variation with respect to a video signal as an optical response characteristic of the liquid crystal composition constituting this liquid crystal layer is made faster and also a convergence to a minimum value (the so-called black level) with respect to the blanking signal is made faster. For this reason, when an optical response in the liquid crystal is made faster, an image (in particular, a moving image) reproduced in the display device becomes clearer. However, it is possible that a holding characteristic of an electric field applied to the liquid crystal layer for a frame period is impaired. In the case where a still image is reproduced by a liquid crystal display device, for example, it is not necessary to change brightness of most of the pixels constituting the pixel array, so that it is desirable that the light transmission in the liquid crystal layer is also kept (held) at a predetermined value over a plurality of frame periods.

As a result of the adaptation of the display device for performing a hold-type displaying operation to the moving image display as described above, it may be expected that the contrast or display-uniformity of the displayed image is deteriorated when the display device is mounted in a hold light emitting type monitor for a personal computer and the like. In the liquid crystal display device in accordance with the present embodiment, liquid crystal composition having a well-balanced state between the response to an electric field signal and a holding characteristic is applied to the liquid crystal layer described above so as to enable the liquid crystal display device to be used in both a television receiver and a monitor. If the liquid crystal device in accordance with the present embodiment is exclusively used for displaying a moving image in a television receiver and the like, it is desired that the liquid crystal composition showing a high-speed optical response characteristic be used for the liquid crystal layer.

In the foregoing description in accordance with the present embodiment, it has been assumed that a pixel array (a liquid crystal display element) in a normally black mode (the lower a voltage applied to a pixel electrode, the lower a light transmission of the liquid crystal layer) is driven by dot inversion driving. However, also in the case of a pixel array (a liquid crystal display device) operated in a normally white mode (the lower a voltage applied to a pixel electrode, the higher a light transmission of the liquid crystal layer), this pixel array is operated by the common inversion driving so as to achieve the same effect as that obtained by the pixel array in the normally black mode. In order to further improve an image quality of the displayed image, a gray scale controlling function described below is added to the aforesaid liquid crystal display device in accordance with the present embodiment.

An optical response characteristic in a liquid crystal layer is dependent on either a gray scale voltage value applied to the liquid crystal layer or its applying time. Due to this fact, probably, there arises the possibility that the relationship between a gray scale data inputted to the liquid crystal display panel and brightness characteristics (γ-characteristics) of the liquid crystal display panel is dependent on the following two cases: one case where only a video signal is written into each of lines forming a pixel array for each frame period or each frame field as described above (hereinafter conveniently referred to as impulse type operation or impulse type scanning); the other case where the video signal and the blanking signal are written in sequence to each of the lines forming the pixel array in accordance with the present invention.

In view of this possibility, the present embodiment additionally provides means for applying a gray scale voltage suitable for an impulse type operation (for example, another gray scale voltage generating circuit different from that described below) in addition to the gray scale voltage applying means installed in the prior art liquid crystal display device (e.g., the gray scale voltage generating circuit for generating a gray scale voltage suitable for the hold-type operation) in order to correct a deviation in γ-characteristics generated between the hold-type operation and the impulse type operation of the liquid crystal display device. As one example for generating a gray scale voltage suitable for performing an impulse type operation, a combination of a gray scale voltage dividing resistor (generating much more gray scale voltage from a grayscale voltage inputted to a drain line drive circuit) arranged in the drain line drive circuit 105 such as a drain driver IC is changed over by a switch in compliance with the aforesaid operating system (including at least two kinds of hold-type system and impulse type system) and thereby a γ-characteristic curve (e.g., a curve indicating each of the gray scales and either a voltage applied to its corresponding pixel electrode or an electric field applied to a liquid crystal layer) is changed. In addition, as another example for generating a gray scale voltage suitable for impulse type operation, a scanning timing generator circuit 103 for generating a gray scale voltage (refer to FIG. 1 which is also called a plural-time scanning timing generator circuit) in a display control circuit for supplying a plurality of kinds of gray scale voltages to the drain line drive circuit (a display control element such as a timing controller and the like) is divided to at least two types, for hold-type operation and for impulse type operation. A reason why at least two kinds of operating systems are provided in the liquid crystal display device in any of the examples consists in the fact that there are many types of the impulse type operation as described below and the γ-characteristics may deviate in dependence on settings of the operating conditions.

Figure 8:
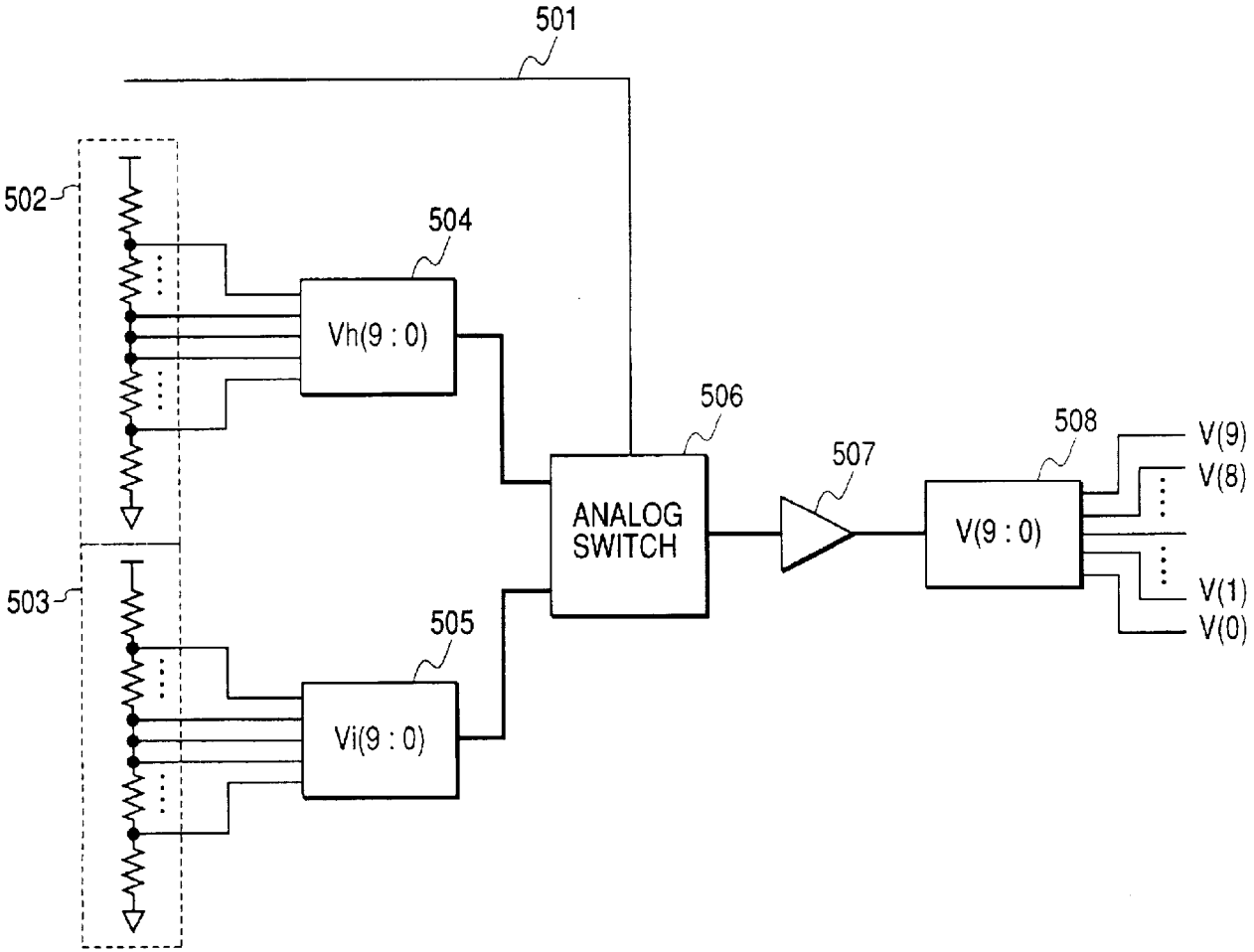
FIG. 8 is a schematic diagram of a gray scale voltage generator circuit described in Embodiment 1 of the present invention.

In the present embodiment, there is employed another example described above in which the gray-scale-voltage groups generated by the scanning timing generator circuit in accordance with an operating mode of the liquid crystal display device are switched, and the details thereof will be described later in reference to FIG. 8. FIG. 8 shows a group of circuit blocks related to a production of the gray-scale-voltage group in the display control circuit for the liquid crystal display device (liquid crystal display module) in accordance with the present invention. The gray scale voltage outputted from a bus line 508 called a selected gray-scale-voltage group arranged at the final stage of the circuit block group has ten types of value ranging from a level 0 (denoted as V(0)) to a level 9 (denoted as V(9)) (in the present specification, such a gray-scale-voltage group showing this versatility as above is denoted as a V (9:0). Five types of gray scale voltage in ten types are positive voltage signals whose voltages are higher than the aforesaid common level voltage and the remaining five types are negative voltage signals whose voltages are lower than the aforesaid common level voltage.

The circuit block groups are arranged at the scanning timing generator circuit in the display control circuit, and the ten types of gray-scale-voltage groups as described above are devidedly generated for the hold-type operation and impulse-type operation. Each of the gray scale voltages for the hold-type operation is outputted from between each pair of resistor elements of a voltage divider having a plurality of resistor elements connected in series called ladder resistors 502. Each of the gray scale voltages for impulse type operation is outputted from between each pair of a plurality of resistor elements forming the voltage divider constituted by the ladder resistors 503. Although both the ladder resistors 502, 503 have a similar constitution to each other, plotting the gray scale voltages to the respective levels ranging from the level 0 to the level 9 forms γ-characteristic curves different from each other. The gray-scale-voltage groups outputted from the ladder resistors 502 are inputted to an analog switch 506 through a gray-scale-voltage bus 504 constituted by ten signal lines for use in transferring each of the gray scale voltages, and the gray-scale-voltage groups outputted from the ladder resistors 503 are inputted to the analog switch 506 through the gray-scale-voltage bus 505 constituted by ten signal lines for use in transferring each of the gray scale voltages.

A selection signal line 501 is also connected to the analog switch 506 and a signal transmitted through this selection signal line causes the analog switch 506 to acknowledge an operation status of the liquid crystal display device (selected from both the hold type scanning and the impulse type scanning). The analog switch 506 selects the gray-scale-voltage groups transmitted from the ladder resistors 502 through the gray-scale-voltage bus 504 when the liquid crystal display device is in the hold-type operation status, and, selects the gray-scale-voltage groups transmitted from the ladder resistors 503 through the gray-scale-voltage bus 505 when the liquid crystal display device is in the impulse-type operation status. The gray-scale-voltage groups selected by the analog switch 506 are supplied to the drain line drive circuit 105 through the selected gray-scale-voltage group bus 508 after they are outputted to a buffer 507 arranged at the subsequent stage.

The selected gray-scale-voltage group bus 508 has ten signal lines arranged for each of the gray scale voltages in the same manner as that of the gray-scale-voltage buses 504, 505. The structure of any of the bus lines corresponds to the drain drive circuit that causes the liquid crystal display panel to perform the color video display drive of 64 scales. Accordingly, if the drain drive circuit that causes the liquid crystal display panel to perform the color video display drive of 256 scales is mounted, these bus line widths are widened.

As described above, gray scale voltages corresponding to the predetermined gray scale levels are allowed to depend on whether the liquid crystal display device is operated by a hold-type scanning or an impulse-type scanning, so that the γ-characteristics suitable for the respective scanning methods are set. Consequently, a deviation in the optical characteristics in the impulse-type scanning is corrected. In addition, the liquid crystal display device operated by the impulse type scanning also enables the generation of steep γ-characteristics as found in a Braun tube and its video quality is improved.

Figure 9:
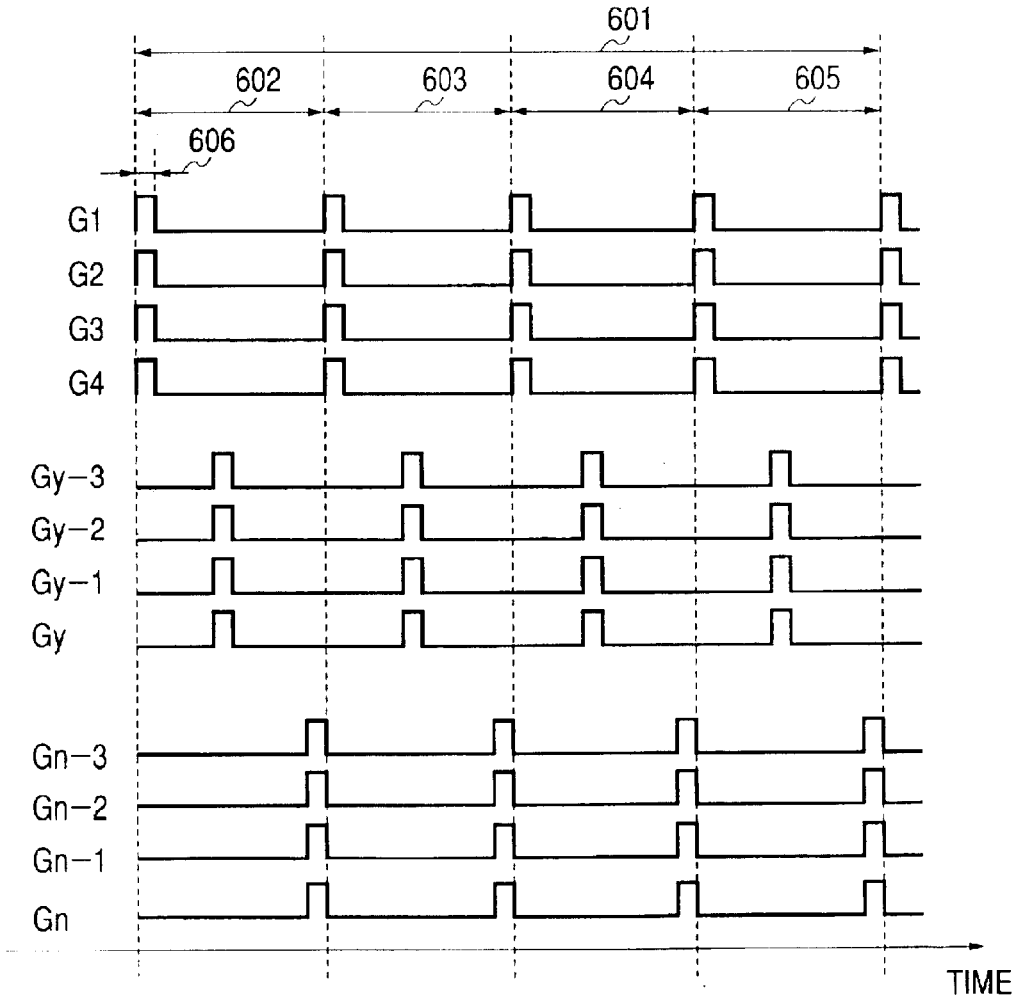
FIG. 9 is a timing chart of a gate selection pulse of a display device driven by 4-line simultaneous write-in and 4-line skip-scanning described in Embodiment 1 of the present invention.

Further, another application example of the present embodiment can operate the liquid crystal display device by the following scanning method. FIG. 9 indicates gate selection pulse timing in the pixel array of the liquid crystal display panel when the data is simultaneously written for each four lines. Two video scanning periods 602, 603 each having ¼ period (about 4.2 ms) of the frame period are set in the front half of the frame period (16.7 ms) 601 and similarly two blanking scanning periods 604, 605 each having a ¼ period (about 4.2 ms) of the frame period 601 are set in the rear half of the frame period 601. When the gate selection period (denoted by reference numeral 606 in FIG. 9) is fixed, it is possible to complete the scanning of one picture in a ¼ period of one frame period by writing the video simultaneously in four lines described in this application example as compared with the prior art scanning method for writing a video in one line for each gate selection period. Accordingly, in the application example, the remaining, ¾, frame period can be assigned to writing-in of the blanking signal to the line or a fast-responding filtering process and the like, and thus, the scanning area of one frame period can be effectively utilized.

Figure 10:
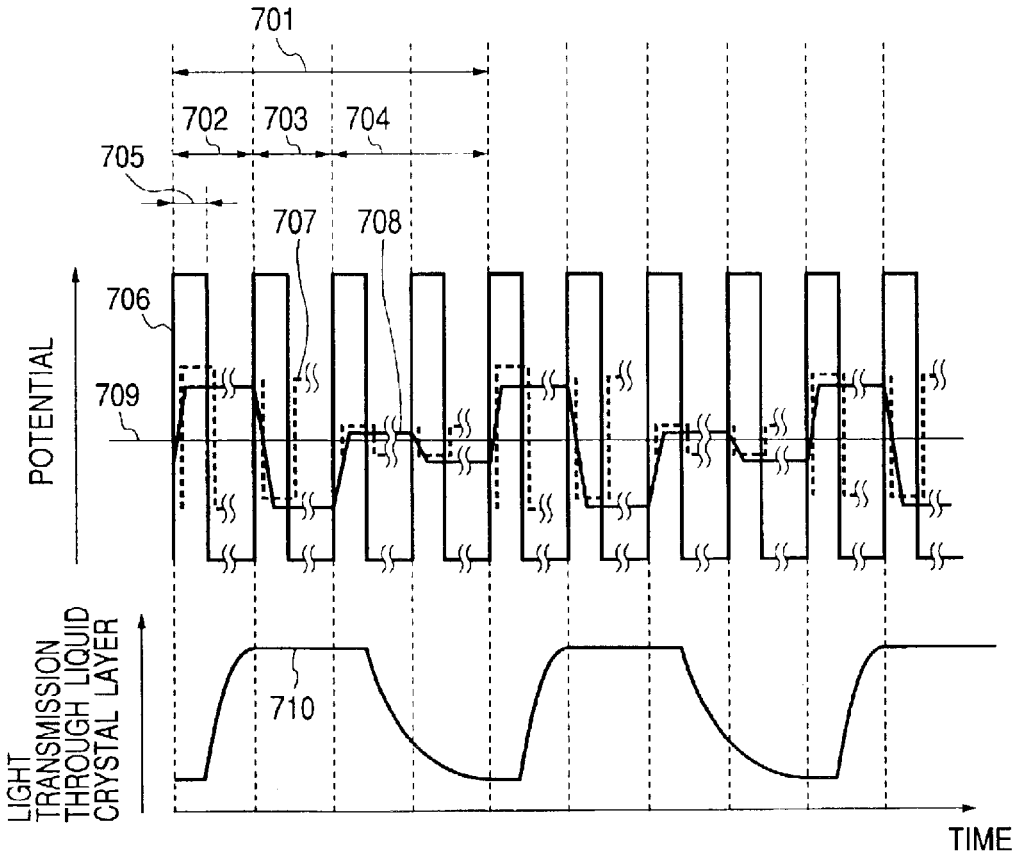
FIG. 10 is a diagram showing each signal line driving waveform of the liquid crystal display device driven by 4-line simultaneous write-in and 4-line skip-scanning and an optical response waveform of the liquid crystal described in Embodiment 1 of the present invention.

FIG. 10 illustrates waveforms of voltages on the signal lines and of optical response of a liquid crystal layer in an application example of the present embodiment where the response to writing video information into the signal lines is improved by employing a liquid crystal speed-up filter in the liquid crystal display device. The liquid crystal speed-up filter increases voltages applied to pixels in the liquid crystal display panel (the pixel array) according to a filter factor. The liquid crystal speed-up filter having such a function is used for a so-called overdrive-operation of the liquid crystal display device in which video data are written into the pixel array of the liquid crystal display device more than twice per frame period.

When the over driving scheme is employed, video signals per frame period are supplied to respective pixels in a display area of the display device more than twice in one frame period (or in another frame period succeeding the one frame period). Therefore, each of times one pixel can use for taking in a video signal via its active element once, which is a time duration during which the active element is in an ON state, is shortened, and consequently, although the active element of each pixel is turned on more than twice per frame period, the amount of electric charge taken into one pixel is limited because of the short duration of one turned-on state of the active element. The liquid crystal speed-up filter increases the amount of charge taken into one pixel by one turn-on of the active element by increasing a video signal voltage, and thereby accelerates orienting of liquid crystal molecules into a desired orientation in the case of the liquid crystal display device.

The frame period 701 shown in FIG. 10 is divided in sequence to a video write-in period (the first video write-in period) 702 having a ¼ period of the frame period 701, to which the liquid-crystal-response-speed-up process is applied, a video write-in period (the second video write-in period) 703 having a ¼ period, and a blanking signal write-in period 704 having a ½ period. The gate selection period 705 of each of the lines is set to a substantial same length in each of the aforesaid three kinds of write-in periods. In addition, the gate selection period 703 is set to a substantial same length as that when the liquid crystal display device is driven in such a way that the video is written in sequence for each one line over the frame period 701.

A voltage signal having the gate waveform (a scanning signal waveform) 706 is applied to the gate line (a scanning signal line) 201 as shown in FIG. 2 and is brought from a low state to a high state in the aforesaid gate selection period 705, whereby the active element such as the TFT 204 controlled by this gate line 201 or its branch line is turned on. A signal voltage indicating the drain drive waveform 707 is applied to the drain line (a video signal line) 203 and this signal voltage is applied to the pixel electrode through the active element turned on by the gate line 201. However, if the active element is not turned on by the gate line 201, the signal voltage applied to the drain line 203 is not applied to the pixel electrode. Accordingly, a variation in potential at the pixel electrode is indicated as a source waveform 708 in the same manner as that of the electrode (conveniently called a source electrode) opposite to the drain line of the active element (TFT in the present application example) connected to the pixel electrode. As described above in reference to FIG. 2, the pixel electrode arranged at each of the pixels 207 forms a capacitor 206 together with a liquid crystal layer and a counter electrode (also called a common electrode) facing the pixel electrode with the liquid crystal layer held therebetween. In addition, as described in reference to FIG. 7, the counter electrode is set to a potential called a common level. Accordingly, an electric field corresponding to a difference between a potential indicated by the source waveform 708 and a potential of the common level 709 in FIG. 10 is formed in the liquid crystal layer and a light transmission of the liquid crystal layer is varied as indicated in the optical response waveform 710 in FIG. 10.

The optical response waveform 710 of the liquid crystal layer indicates that a light transmission of the liquid crystal layer in the ¼ frame period changing over from the blanking display state in the previous frame period to the video display state of the frame period subsequent thereto is steeply increased as compared with that in the video write-in period 402 in FIG. 7. As described above, this phenomenon is generated by the fact that a voltage for apparently speeding-up an optical response of the liquid crystal layer is generated with a liquid-crystal-speed-up filter in the first video write-in period 702 and this voltage is applied to the drain line. That is, in the present application example, the video signal is generated with the liquid-crystal-response-speed-up filter so that its rising characteristic is improved.

In the liquid crystal display device of the present applied example, the blanking signal at the end of the frame period is written into each of the lines for each frame period. If a voltage (a black level signal) making a light transmission of the liquid crystal layer minimum is applied to each of the pixels (a pixel electrode arranged in the liquid crystal layer) as this blanking signal, the effective display area (a pixel array) of the liquid crystal display device is displayed black at the end of the frame period (in other words, before the video in the subsequent frame period is written into each of the lines). Accordingly, in this case, it is possible to control an optical response of the liquid crystal layer in accordance with the write-in of the video signal supplied in the subsequent frame period into each of the lines by setting an initial rising value of light transmission of the liquid crystal layer to a black level. Therefore, it is also possible to simplify a combination of filter factors of the aforesaid fast responding filter and realize this filter circuit by a low scale of integration in circuit. In addition, an inversion repetition period of a write-in polarity can be completed in each of a video write-in period (composed of the aforesaid first video signal write-in period 702 and the second video signal write-in period 703) and a blanking signal write-in period 704 as indicated by the source waveform 708 in FIG. 10. Due to this fact, since frequency of the ac electric field in the liquid crystal layer can be increased by inverting twice in one frame period a direction of an electric field (a voltage gradient between a pixel electrode and a counter electrode) generated in the liquid crystal layer, occurrence of dc induced image retention is suppressed, which prevents deterioration of liquid crystal.

Figure 11A:
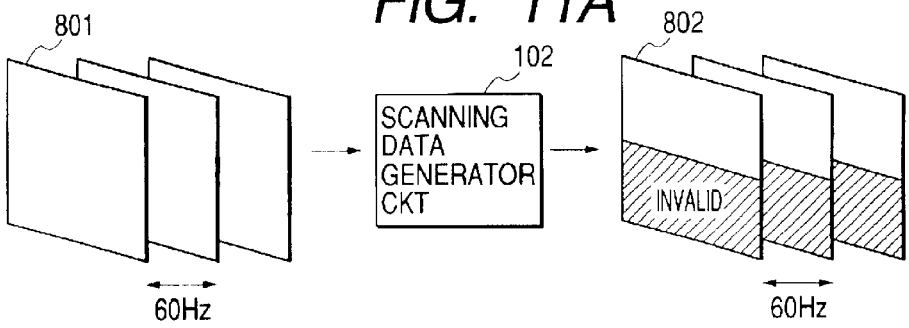
FIGS. 11A and 11B are diagrams illustrating a video data generator process in the display device driven by 2-line simultaneous write-in and 2-line skip-scanning described in Embodiment 1 of the present invention.
Figure 11B:
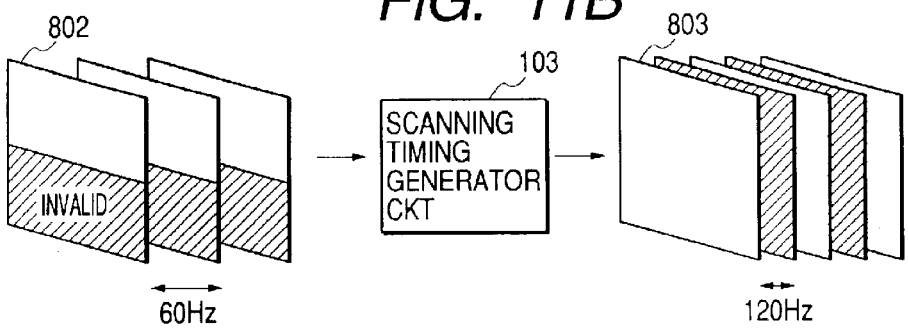

The scanning timing generator circuit (plural-time scanning timing generator circuit) 103 indicated in FIG. 1 for generating gate line drive timing has been described so far. Operation of the scanning data generator circuit (plural-time scanning data generator circuit) 102 for generating video written into each of the lines in accordance with this drive timing will be described while referring to timing generated by the scanning timing control circuit 103 described above. FIGS. 11A and 11B indicate a process in which the scanning data generator circuit 102 and the scanning timing generator circuit 103 generate video when both the video display and blanking display are realized in one frame period by the aforesaid 2-line simultaneous write-in process (2-line skip scanning). The video generated by the scanning data generator circuit defined herein means video transferred to the scanning timing generator circuit 103, and the video generated by the scanning timing generator circuit 103 means the video generated on the pixel array 106 by scanning.

FIG. 11A shows a process in which the scanning data generator circuit 102 generates a video image and FIG. 11B shows a process in which the scanning timing generator circuit 103 generates a video image. The scanning timing generator circuit 103 generates timing (also called a scanning clock) controlling the gate line drive circuit 104, selects simultaneously a plurality of gate lines arranged at the display array 106 for each two lines under this timing as shown in FIG. 6 and writes the same data in the pixel groups in two rows controlled by any one of these two lines. For this reason, the number of times of scanning for the video data supplied by the plural-times scanning data generator circuit 102 becomes half of a vertical resolution of the display array. Accordingly, in the case where the video image 801 supplied from the video signal source 101 to the scanning data generator 102 shown in FIG. 1, for example, has the same resolution as that of the pixel array 106 (in other words, having the same vertical resolution as that of the number of gate lines in the pixel array 106), the plural-times scanning data generator circuit 102 compresses the original video 801 in a vertical direction into its half size, adds an invalid video image of the remaining half to make an intermediate video image 802. One video image 801 supplied from the video signal source 101 shown in FIG. 11A corresponds to a video data in one frame period. In the case where the resolution of the video image 801 supplied from the video signal source 101 is different from that of the pixel array 106, the video data for each frame period is processed on video processing such as scaling or process conversion between the interlace process and the progressive process, the resolution is made equal to that the pixel array 106 and then the vertical resolution is compressed to a half value to generate a video image 802.

One video image 802 shown in FIG. 11A corresponds to video data obtained by the compression of the video data of the video image 801 in one frame period and a half of the video image 801 is converted into the invalid video image (data not used in video display). In the present application example in which the liquid crystal display device is driven by the 2-line simultaneous write-in operation, the video data to be inputted to the pixel rows of odd-numbered lines (G1, G3, . . . , Gn−1) or even-numbered lines (G2, G4, . . . , Gn) in the pixel array shown in FIG. 2 is made invalid. Although information to be written into each of lines in the pixel array along a longitudinal direction (written into the pixel groups in each of the lines as the aforesaid video signal) is arranged for each one row, the effective lines in one data of the video image 802 are filled in the upper section of one video data in such a manner as to fulfill a vacant row address generated by the process in which the line made invalid is removed. Accordingly, taking one video image 802 in which data in even-numbered lines is invalid as an example, information corresponding to the odd-numbered lines G1, G3, . . . Gn−1 in the pixel array are arranged in sequence from the upper section of the video image 802 in a longitudinal direction. In this case, information at the final line Gn−1 of the odd-numbered line is arranged at a n/2th row address from the upper side, for example, and the row addresses subsequent to ((n/2)+1)th row are made invalid.

When this video image 802 is inputted to the scanning timing generator circuit 103, a timing signal corresponding to the so-called 2-line simultaneous write-in operation (in the case of the present applied example) is generated by the scanning timing generator circuit 103. When this timing signal (also called a scanning clock) is inputted to the gate line drive circuit 104, the gate line drive circuit 104 drives the gate line of the pixel array 106 with the timing shown in FIG. 6. The driving of the gate line is carried out once for each pulse of the timing signal (also called a clock pulse), for example. In the present application example in which the liquid crystal display device is driven by the 2-line simultaneous write-in operation, if n gate lines are arranged in the pixel array 106 as shown in FIG. 2, a pulse of the timing signal is generated by at least n/2 times in order to complete the scanning (an operation for sending the scanning signal once to all the number of (n) of gate lines described above) for the entire pixel array 106. The scanning signals are sent to the gate lines G1, G2 in accordance with the first pulse, the gate lines G2, G4 in accordance with the second pulse and the gate lines Gn−1, Gn in accordance with the (2/n)th pulse.

The drain line drive circuit 105 generates a video signal for each row address from data of one video image 802 in accordance with this gate line drive and outputs it to each of the drain lines 203 arranged at the pixel array 106. As described above, in the present application example in which the liquid crystal display device is driven by the 2-line simultaneous write-in operation, one of the odd-numbered lines (G1, G3, . . . Gn−1) and the even-numbered lines (G2, G4, . . . Gn) of one video data 801 having the same vertical resolution as that of the pixel array 106 is arranged in sequence in the row address group ranging from the upper first row to (n/2)th row of one video data 802 and the other lines are removed. Due to this fact, the drain line drive circuit 105 repeats n/2 times a production of the video signal for each line belonging to any of groups on the basis of information corresponding to only one of the odd-numbered lines and the even-numbered lines of the aforesaid one video data 801.

The video write-in operation into each of the lines corresponding to the aforesaid example of driving the gate line is described as one example of making the even-numbered lines for the video data 801 invalid. Each of the video signals for the line G1 of the video data 801 is supplied to the pixel groups of two rows corresponding to the gate lines G1, G2 in accordance with the aforesaid first pulse; each of the video signals for the line G3 of the video data 801 is supplied to the pixel groups of two rows corresponding to the gate lines G3, G4 in accordance with the aforesaid second pulse; and each of the video signals for the line Gn−1 of the video data 801 is supplied to the pixel groups of two row corresponding to the gate lines Gn−1, Gn in accordance with the aforesaid (n/2)th pulse. With such an arrangement as above, a video image (hereinafter also called a target video image) illustrated in FIG. 11B as a white ground sheet 803 is displayed at the pixel array 106. This target video image 803 is completed at the time of end of the video scanning period 302 in FIG. 6.

After completion of the video write-in into the pixel array 106 as described above, the voltage signal corresponding to the invalid video present at the row address subsequent to ((n/2)+1)th address from the upper side of said one video 802 is supplied from the drain line drive circuit 105 to the pixel array 106 in the same manner as that for the afore said video signal. This operation is carried out in the blanking scanning period 303 in FIG. 6. In this case, the invalid video image is meant by a fictitious image data not used in displaying video or an image. The invalid video image is formed by generating the dummy video data in the scanning data generating unit 102 in a step for compressing the aforesaid one frame period (one) video data 801, for example, and inputting this data to the row address subsequent to ((n/2)+1)th address from the upper side of one video 802 generated at this compression step. The dummy video data is meant by data for generating the aforesaid blanking signal after being inputted to the drain line drive circuit 105. In the liquid crystal display device, for example, the so-called black data is used as the dummy video data in which a voltage signal making the light transmission of the liquid crystal layer minimum is applied from the drain line drive circuit 105 to the drain line 203. A process for feeding such black data as above into one video image 802 after compression is also called black insertion in the present specification.

In another example of the method for forming the dummy video image, the aforesaid one video image 802 is inputted to the scanning timing generator unit 103 and the row address subsequent to ((n/2)+1)th address from the upper side of this video image 802 is masked with the dummy data. In accordance with this method, even if information fed, from the upper side, to the first row address to (n/2)th row address is written into the ((n/2)+1)th row address to the nth row address from the upper side of the one video image 802 when one video image 802 is generated by compression of one video data 801 at the aforesaid scanning data generator unit 102, this information can be substantially eliminated from the ((n/2)+1)th to the nth row address. The dummy data herein described is used for applying the blanking signal (a signal voltage set irrespective of the video image 801 inputted to the liquid crystal display module) from the aforesaid drain line drive circuit 105 to the drain line 203 in the same manner as that for the aforesaid dummy video and this dummy data can be set as the aforesaid black data. However, the dummy data is not inputted to the row addresses of ((n/2)+1)th to nth addresses from the upper side of the aforesaid one video 802. Therefore, the feature of the dummy data is different from that of the video data of the aforesaid dummy data. That is, the aforesaid dummy data is utilized for generating a signal voltage in the drain line drive circuit 105 in a period in which the signal voltage can be generated by the drain line drive circuit 105 in accordance with information stored at the row addresses of ((n/2)+1)th to nth addresses from the upper side of the aforesaid one video 802 in place of this information.

The invalid video data generated as described above (the lower half, displayed in black, of one video 802 in FIG. 11B) is inputted to the drain line drive circuit 105 and the blanking signal is applied to the drain line 203 in response to the gate line drive adapted for the 2-line simultaneous write-in operation in the same manner as that of the aforesaid video scanning period 302. Blanking signal write-in operation into the pixel array on the basis of the invalid video data is carried out in accordance with the timing of the blanking scanning period 303 shown in FIG. 6. In the case where the aforesaid video scanning period 302 is completed by applying of the scanning signals to the gate lines Gn−1, Gn in accordance to a pulse of the (n/2)th scanning clock counted from a starting time of the frame period 301, the blanking scanning period 303 is started by applying of the scanning signals to the gate lines G1, G2 with a pulse of the (n/2+1)th scanning clock and applying of the blanking signal to the pixel groups of two rows corresponding to the gate lines G1, G2 by the former application. In this case, the blanking scanning period 303 is finished by applying of the scanning signal to the gate lines Gn−1, Gn in accordance with the pulse of the n-th scanning clock counted from the starting time of the frame period 301 and at the same time the video image illustrated as a hatched sheet 803 in FIG. 11B (hereinafter also called a blanking video, a black video) is displayed at the pixel array 106.

One video data 801 shown in FIG. 11A is one immediately before a compression process is performed on the video data, and it has the same vertical resolution as that of the pixel array 106 (having the number of (n) of gate lines 201) as described above. When information arranged in a vertical direction of one video data 801 is written into the pixel array 106 for each one line in accordance with a pulse of the scanning clock, the video write-in operation for the pixel array 106 is completed with n-th pulse of the scanning clocks. When it is assumed that a period of time required for write-in operation of one video data 801 into the pixel array 106 is 16.7 ms (60 Hz in terms of frequency), the present application example for performing the 2-line simultaneous write-in operation shows its required period of time of 8.4 ms (120 Hz in terms of frequency) because the video scanning period 302 is completed with n/2 pulse of the scanning clock as described above. Accordingly, the video write-in speed into the pixel array 106 in accordance with the present embodiment is two times that for write-in to the pixel array 106 without compressing one video data 801.

Further, in the case where the video signals or the blanking signals are written while the pixel groups corresponding to four lines (corresponding to four gate lines) are selected simultaneously in reference to the present application example in which the liquid crystal display device is driven by the 2-line simultaneous write-in operation, a selection pulse is supplied to the gate line of the pixel array 106 with the timing shown in FIG. 9, so that one picture scanning period required for writing the video and the blanking signal can be shortened to ¼ of one frame period of the video data before compression. In this case, the gate line drive circuit 104 supplies a pulse for selecting four lines (e.g., gate line groups G1, G2, G3, G4 also including a gate line not shown) with the timing shown in FIG. 9 in accordance with one pulse of the scanning clock, skips over the aforesaid four lines (gate line groups G1, G2, G3, G4) in accordance with the next one pulse of the scanning clock subsequent to the above scanning clock, and selects the next four lines (e.g., gate line groups G5, G6, G7, G8 not shown) adjacent to the four lines. The scanning timing generator circuit 103 controls the operation of such a gate line drive circuit 104 as above. Since the same data is written into the pixel groups of four rows for each four lines, the video transmitted by the scanning data generator circuit 102 to the scanning timing generator circuit 103 may be one in which an original video data (a video data inputted to the scanning data generator circuit 102) is compressed to ¼ in a vertical direction.

Figure 12A:
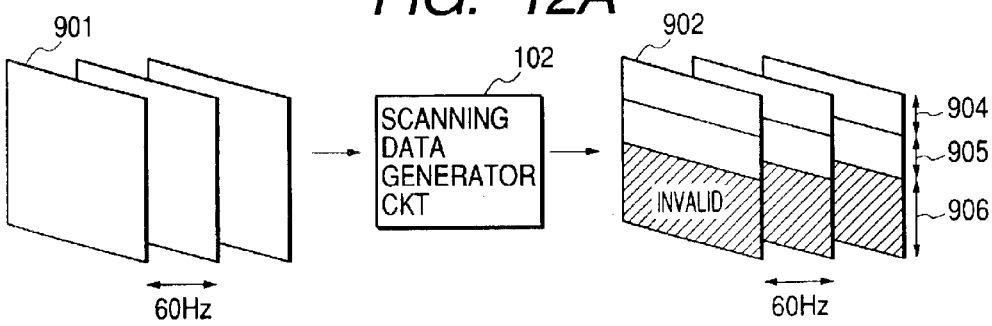
FIGS. 12A and 12B are diagrams illustrating a video data generator process in the display device driven by 4-line simultaneous write-in and 4-line skip-scanning described in Embodiment 1 of the present invention.
Figure 12B:
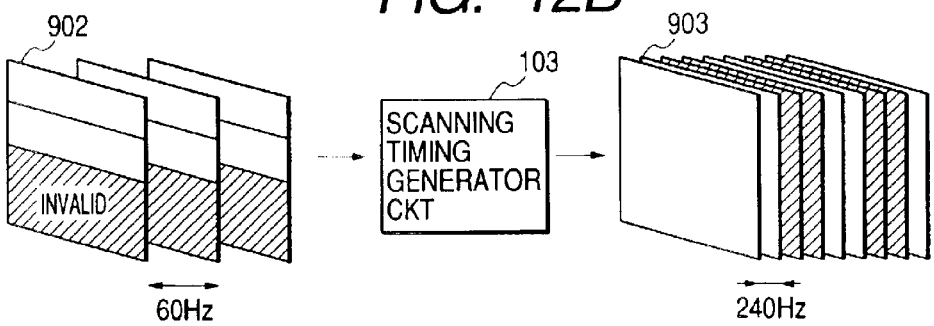

FIGS. 12A and 12B are diagrams for showing an operation of the liquid crystal display device by the 4-line simultaneous write-in operation (4-line skip scanning), i.e. a process in which a video image is generated by the scanning data generator circuit (plural-time-scanning data generator segment) 102 and the scanning timing generator circuit (plural-time-scanning data generator circuit) 103 in the application example in which the video data written into the pixel array by this operation is processed with the liquid-crystal-response-speed-up filter. An advantage obtained by the video processing performed with the liquid-crystal-response-speed-up filter has already been described in reference to FIG. 10.

The scanning data generator circuit 102 compresses to ¼ a vertical resolution of an original image 901 inputted to this circuit. In one example of this compressing process, data of the original image 901 which has the same vertical resolution as that of the pixel array or which is processed to have such a vertical resolution other than data corresponding to (multiple number of 4)th line in the pixel array is made invalid. That is, data included in the original image 901 is divided into four groups in accordance with the associated lines of the pixel array. In addition, data belonging to three groups are made invalid and data belonging to the remaining group is arranged in sequence from the upper side in a vertical direction in one intermediate video 902 (refer to FIG. 12A) generated by the compression process for each one line to which each of data belongs. This process is carried out such that the data corresponding to three line groups made invalid is removed in reference to an example in which one video image 802 making data in even-numbered lines invalid during the 2-line simultaneous write-in operation described in reference to FIG. 11A. At this time, a vacant row address corresponding to the removed data in one intermediate video 902 (corresponding to one frame period of the original image 901) is filled and data corresponding to the remaining line (in this case, (multiple number of 4)th line) is filled toward the upper side of the intermediate video image 902. Such processing is repeated at least twice and video images 904, 905 composed of only data at the specified line of the original image 901 (in this case, identified by the multiple number of 4) are generated in sequence at the intermediate video image 902 compressed to ¼ in a vertical direction.

In the present application example, the original image data constituting the video image 904 (data only at (multiple number of 4)th line, for example, selected from the original image 901) is emphasized by the fast-responding filter in order to speed-up the response (rising of light transmission) of the liquid crystal at the start of one frame period. In contrast to this, the original video data constituting the video image 905 is not subjected to such an emphasizing process. Accordingly, in the present application example, the video image 904 and the video image 905 are conveniently distinguished from each other as an emphasized image and a non-emphasized image, respectively.

The intermediate video 902 is generated in such a way that the emphasized video 904, non-emphasized video 905 and invalid video 906 resulting from the vertical compression of the original image into ¼ from the upper side of one video image corresponding to one frame period of the original image are arranged in sequence and then the intermediate video image 902 is transferred to the scanning timing generator circuit 103 shown in FIG. 1. Then, the scanning timing generator circuit 103 receiving the intermediate video image 902 having the data area generated by vertically compressing the original image 901 to ¼ supplies the aforesaid scanning clock and on the basis of this a selection timing for driving the gate line of the pixel display array 106 through the 4-line simultaneous write-in (4-line skip scanning) process shown in FIG. 9. Accordingly, in the present application example, the video signal is supplied twice in the ¾ frame period (a ¾ length of one frame period of the original image 901) or the front half of one frame period, the blanking signal is supplied twice in the remaining period or the rear half of the one frame period to the pixel array 106 in sequence. With such an arrangement as above, the video image 903 (formed by video images 904, 905 resulting from the vertical compression of the original image by a process similar to that for the aforesaid target video image 803, and indicated by two white ground sheets) is formed twice and a blank video image 903 (formed as a black video image and indicated by two black ground sheets, for example) is formed twice in sequence in the picture of the display device, as shown in FIG. 12B. In the present application example, in the case where the number of lines in the pixel array 106 is defined as (n) and the data of the intermediate video image 902 is inputted to the drain line drive circuit 105 row by row in a vertical direction for each one pulse of the aforesaid scanning clock signal to supply a signal voltage to the pixel array 106, each of the aforesaid video image 903 and the aforesaid blank video image 903 is formed at the display picture (the pixel array 106) with n/4 pulse of the scanning clock signal. Accordingly, the data of the original image 901 sent to the scanning data generator circuit 102 with a frequency of 60 Hz is inputted to the drain line drive circuit 105 for each one line, a signal voltage corresponding to the data is supplied to the pixel array 106, and each of the video image 902 and the blank video image 903 is formed in a display picture in a ¼ period of time (4.2 ms and 240 Hz in a frequency) of a period of time required for forming a video image in the display picture.

In addition, the invalid video image 906 in the present application example is not limited to one generated by the scanning data generator circuit 102 as described above. The invalid video image may be formed in the following manner. An operation for generating the aforesaid non-emphasized video 905 by the scanning data generator circuit 102 in a period where the invalid video 906 is generated is repeated, the non-emphasized video 905 is stored in an area where the invalid video 906 of the intermediate video 902 should be inputted, the intermediate video 902 is inputted to the scanning timing generator circuit 103, and the area to be made as the invalid video image 906 is masked with the blanking data.

A basic system configuration and an operation of each of the component elements thereof that represent the present invent ion have been described above. Subsequently, some points to be considered in particular when this basic system is applied to a product such as a television receiver or the like will be described and a method for providing a countermeasure by the system configuration of the present invention will be described in detail.

A point to be considered at first consists in the possibility that the vertical resolution of an image displayed in video equipment is reduced because the method in accordance with the present invention is a scanning method for writing the same scanning data in a plurality of lines. Accordingly, it is also argued that the number of lines to be written simultaneously is preferably as less as possible. However, a trend in recent years shows that a display array having a higher resolution goes mainstream and various kinds of video formats such as digitalized broadcasting, broadband broadcasting, and video services or the like are realized. In view of such a trend in era as described above, the aforesaid argument can resolved by considering the optimum formation of the embodiment of the present invention applicable to a product such as video equipment and the like in consideration of a relation between a resolution of the display array and a video format. Subsequently, on the occasion of discussing the countermeasure, a combination of the display array and the video format will be explained at first.

As regards a standard in product of the liquid crystal display device, FIG. 38 lists the specification names (classes), their associated horizontal resolutions (the number of pixels m arranged in a horizontal direction in the picture area) and vertical resolutions (the number of pixels n arranged in a vertical direction in the picture area) in regard to a pixel matrix of typical pixel array having an aspect ratio in the number of pixels arranged along each of a lateral direction (a horizontal direction) and a vertical direction (a vertical direction) in the display picture (composed of the pixel array shown in FIG. 2) being the lateral direction : the vertical direction=4:3 and a pixel matrix of the pixel array having an aspect ratio of which is being standardized in accordance with a wide picture area in recent years. In FIG. 38, since the pixel is indicated in the unit called square pixel, three kinds of pixels having different display colors are arranged along the horizontal direction of the picture for each pixel in the liquid crystal display device applicable to the color video display (refer to FIG. 5A) and the number of pixels arranged in the horizontal direction in the picture area of the pixel matrix in each class becomes three times a numerical value m indicated in FIG. 38. Thus, the aspect ratio represents a ratio between the number of pixel units (square pixels) including three kinds of pixels having different display colors along the horizontal direction in the display picture and the number of pixel units (square pixels) along the vertical direction in the display picture.

For example, the pixel array with a class (resolution) of XGA (Extended Graphics Array) has a pixel matrix such as (a horizontal resolution)×(a vertical resolution)=1024×768, so that an aspect ratio of the pixel array becomes 4:3. On the other hand, the pixel array with a class of WXGA (Wide Extended Graphics Array), which can be also called a wide version of class XGA, forms a matrix of 1280×768, so that an aspect ratio has a longer lateral size as compared with that of XGA class. A trend in which the aspect ratio has a longer lateral size as described above is caused by some reasons that the aspect ratio in the video signal format is becoming wide toward 16:9 or that an adaptation for multi-media is also penetrated into the liquid crystal display device and the like.

FIG. 39 indicates a video format standardized in digital broadcasting.

Affix letter (i) attached to the end part of the number of effective scanning lines means that the video data having a vertical resolution of the number of effective scanning lines is transmitted or received through the scanning of an interlace process. In addition, affix letter (p) attached to the end part of this number of effective scanning lines means that the video data having a vertical resolution of this number of effective scanning lines is transmitted or received through the scanning of a progressive process. As described above, since the video image to be transmitted or received in practice by the interlace scanning in one field period is only data of either the odd-numbered line or even-numbered line, the vertical resolution is half of that of the video image to be transmitted or received through a progressive scanning. In order to keep compatibility with a displaying standard of the prior art personal computer and the like while coping with the trend of the wide formation of the video format or the multimedia targeted liquid crystal display device, the plural-time-scanning data generator circuit 102 shown in FIG. 1 is provided with each of both interfaces. Due to this fact, it becomes possible to display the video image having different formats in the same pixel array such as the video image of **1080*i* or the video image of a personal computer and the like in the pixel array having XGA resolution, for example. However, 1080*i* has only 540 scanning lines with 60 Hz (per one field period) with respect to the fact that a vertical resolution of XGA is 768, an aspect ratio of XGA is 4:3 and a video format of 1080*i*** has an aspect ratio of 16:9, so that several displaying methods are possible unlike the case of displaying the video of a personal computer, etc.

Referring to FIGS. 13A to 13D and FIGS. 14A to 14D, an example of methods for displaying video images having different formats at one pixel array will be described.

Figure 13A:
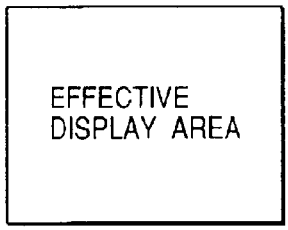
FIGS. 13A to 13D are diagrams illustrating an example in which a wide image is displayed on a picture area (a pixel array) of a non-wide display device.

FIGS. 13A to 13D illustrate display image areas in the case where the video image whose aspect ratio is coincident with an aspect ratio of 4:3 represented by XGA or the video image whose aspect ratio is larger than the same is displayed. In FIG. 13A, a video image generated by either the video data having an aspect ratio coincident with the aspect ratio of the pixel array or the video data having an aspect ratio adjusted to coincide with that of the pixel array is displayed using the entire area of the display picture (pixel array) effectively.

Figure 13B:
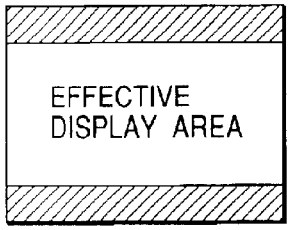

In FIG. 13B, the horizontal resolution of video data is adjusted to coincide with the horizontal resolution of the pixel array in order to keep a wide aspect ratio of the video data. Each of the video signals generated by the video data adjusted in this way is applied to the pixels in the pixel array associated with their respective addresses and then an effective display area (its definition is different from the aforesaid effective display area) is formed in the display screen (pixel array). Although surplus display areas (indicated by hatched lines) not contributed to a video display are generated on the upper side and lower side of the effective display area in the display screen, these areas are padded with blanking data.

Figure 13C:
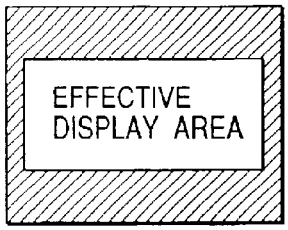

FIG. 13C shows a display screen obtained by applying a video signal for each one pixel generated from video data to each of the pixels in the pixel array, that is, by allowing the resolution of a pixel array to be completely coincident with a resolution of a video signal. Thus, surplus display areas (indicated by hatching) are generated along the horizontal direction and the vertical direction of the display area in such a manner as to enclose the pixel groups (effective display areas) in the pixel array to which the vide signal based on the video data is applied. The surplus display areas are padded by the blanking data in the same manner as that shown in FIG. 13B. Although the video data indicated in FIG. 13C, which has the wider aspect ratio, has the aspect ratio of 4:3, if the horizontal resolution and the vertical resolution of the video data are different from those of the pixel array, a similar display image might be generated.

Figure 13D:
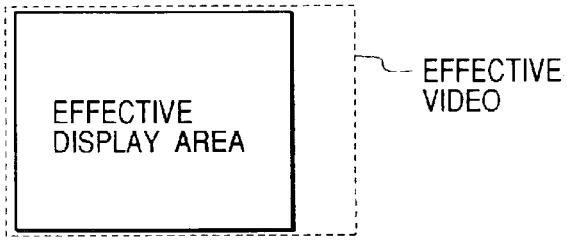

FIG. 13D indicates a display screen obtained by adjusting the vertical resolution of video data to coincide with that of the pixel array so as to keep the wider aspect ratio of the video data and by generating the video signal in such a manner as to utilize all vertical resolutions (pixel rows) of the pixel array. The video data is also extended in the horizontal direction by application of the aforesaid adjustment so as to be compatible with the wide image area, so that the video to be generated with the video signal generated by this video data is allowed to reach a frame area shown by a dotted line indicated as an effective video. Accordingly, the pixel columns to which part of the video signals should be applied are not present in the pixel array and all the video images in the horizontal direction (in the frame denoted as the effective display area) cannot be generated. As regards such a problem, a system configuration is employed in which the display portion of the effective video image caused by the pixel array can be selected and part of the entire area is properly displayed.

Figure 14A:
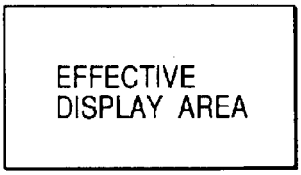
FIGS. 14A to 14D are diagrams illustrating an example in which a non-wide video is displayed on a picture area (a pixel array) of a wide display device.

FIGS. 14A to 14D illustrate a method for displaying the case where the wide video image or the video image having not widened aspect ratio (e.g., 4:3) is displayed at the pixel array (display screen) with an aspect ratio (e.g., 16:9) represented by WXGA in contrast to the example described in reference to FIGS. 13A to 13D. FIG. 14A shows a display screen in which the video having an aspect ratio coincident with that of the pixel array is displayed over the entire area of the display picture area or the video having an aspect ratio different from that of the pixel array is extended in the horizontal direction and displayed.

Figure 14B:
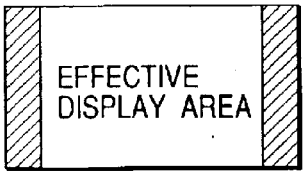

Referring to FIG. 14B, video data having a narrower aspect ratio in the horizontal direction than that of the pixel array is adjusted in such a manner that the vertical resolution of the video data is coincident with the vertical resolution of the pixel array. The video signals generated from the video data after being adjusted are applied to the associated pixels corresponding to their respective addresses in the pixel array and the effective display area (similarly defined in the same manner as that defined in reference to FIG. 13B or 13C) is formed in the display screen (pixel array). Such a display process is also called complete-vertical-resolution displaying. Although the surplus display areas (indicated in black)

not contributed to the video display on the right and left sides (along the horizontal direction of the pixel array) are generated in the effective display areas, these areas are padded with the blanking data or the like.

Figure 14C:
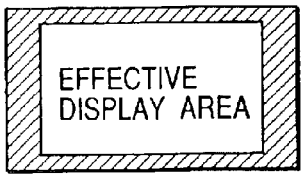

FIG. 14C shows a display screen in which a video signal for each one pixel generated from the video data is applied each pixel in the pixel array and this display image corresponds to that in FIG. 13C. Accordingly, the surplus display areas (indicated by patching) enclosing the pixel groups (effective display areas) to which the video signals are applied in the pixel array are padded with the blanking data in the same manner as that of the pixel array shown in FIG. 13C. Although the video data shown in FIG. 14C shows that an aspect ratio in the horizontal direction is narrower than that of the pixel array, a similar display picture is generated when the horizontal resolution and the vertical resolution are lower than that of the pixel array even in the case where the video data has the same wide aspect ratio as that of the pixel array.

Figure 14D:
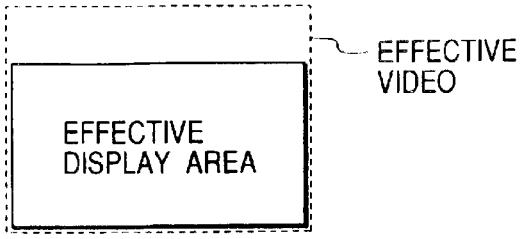

FIG. 14D shows a display screen obtained by adjusting video data having a narrower aspect ratio in the horizontal direction than that of the pixel array in such a manner that the horizontal resolution of the video data is coincident with that of the pixel array and generating the video signal so s to utilize the entire horizontal resolutions (pixel columns) of the pixel array. Such a display process as described above is also called a complete-horizontal resolution display. Since the aspect ratio of the video data extends in a vertical direction with respect to that of the pixel array, aforesaid adjustment causes the video data to extend also in the vertical direction, with the result that the video image to be generated by the video signal produced by the extended data protrudes the display screen (in a frame denoted as an effective display area) in a vertical direction. Due to this fact, there is employed a system in which part of the video image is selected properly for displaying as described above in reference to FIG. 13D.

FIGS. 40 and 41 show an example of typical combination when video images having aspect ratios of 4:3 and 16:9 are displayed in their respective pixel arrays each having the horizontal resolution and the vertical resolution shown in FIG. 38. FIG. 41 classifies this combination in dependence on the kinds of video formats shown in FIG. 39.

In this case, a method for displaying the video image in each of the pixel arrays is selected in the following manner in accordance with an aspect ratio in a horizontal direction between each of the pixel arrays and a video image (a video data) displayed in the pixel array. In the case where an aspect ratio of the video image in a horizontal direction is wider (broader) than that of the pixel array, the video image is generated at the pixel array by the displaying method described above in reference to FIG. 13B. In the case where an aspect ratio of the pixel array in a horizontal direction is wider than that of the video image, the video image is generated at the pixel array by the displaying method described above in reference to FIG. 14B.

In FIG. 40 shows results in which the number of scanning lines usable for video displaying in the pixel array (formation of the effective display area indicated in FIG. 13A or FIG. 14B) and the number of scanning lines (for padding operation) required for the blanking area not contributed to video displaying are calculated in the video displaying performed by each of the pixel arrays set in this way.

In the case where a video having an aspect ratio of 4:3 is displayed at a pixel array of WVGA class having a horizontal resolution of 800 and a vertical resolution of 480 (an aspect ratio=5:3), for example, an aspect ratio of the video image along the horizontal direction is narrower than that of the pixel array, so that a vertical resolution of the video is allowed to coincide with that of the pixel array (a vertical resolution: 480) as described in reference to FIG. 14B and a video Image with a horizontal resolution of 640 is generated at the pixel array. Accordingly, although the surplus display areas not contributing to the video display are generated on the right side and the left side of an area displaying the video image (an effective display area) in the pixel array (a display screen), such surplus displaying areas as above are not generated at the upper and lower portions of the area displaying the video image. Therefore, it is not necessary that the surplus displaying areas in the pixel array generated along the vertical direction are padded with the blanking data, so that the number of gate lines (the vertical scanning lines) to be driven only for displaying blank also becomes 0. On the other hand, in the case where a video image having an aspect ratio of 16:9 is displayed at a pixel array of WVGA class, since the aspect ratio of the video image along the horizontal direction is wider (wide) than that of the pixel array, a horizontal resolution of the video image is allowed to coincide with that (a horizontal resolution of 800) of the pixel array as described in reference to FIG. 13B and the video image with a vertical resolution of 450 is generated in the pixel array. Accordingly, of 480 gate lines (vertical scanning lines) arranged in the pixel array (display picture), 30 gate lines other than 450 gate lines corresponding to the vertical resolution of the aforesaid video generate surplus display areas not contributing to the video displaying in the pixel array (e.g., on the upper side and lower side of the area (effective display area) displaying the aforesaid video). Due to this fact, the number of gate lines (vertical scanning lines) to be driven only for displaying blank also becomes 30 when the surplus display area produced along the vertical direction of the pixel array is padded with the blanking data.

Meanwhile, the video data transmitted or received through digital broadcasting is based on any one of standards of video formats as shown in FIG. 39 and its vertical resolution is determined by the number of effective scanning lines assigned to their respective standards. Accordingly, in the case where such a video data as described above is displayed at the pixel array, the number of vertical scanning lines contained in the effective display area (refer to a column of "effective" in FIG. 40) are probably different from a vertical resolution for each frame period of the video data to be inputted thereto (480 for 480*p*, 720 for 720*p* and 1080 for 1080*p*), or a vertical resolution for each field period of interlace process (240 for 480*i* and 540 for 1080*i*) even if the effective display area is set in the pixel array in accordance with each of the aspect ratios. Accordingly, when the video data is written into one line in the aforesaid effective display area (shown in FIG. 13B or FIG. 14B) of the pixel array for each one line along the vertical direction, a surplus state or lack state appears in the number of the latter lines (the number of scanning lines) with respect to the number of former lines (the number of scanning lines). FIG. 41 is a table providing a summary of the number of lines for each of the standards of video formats. For example, in the case where the number of scanning lines in the pixel array is surplus with respect to those of video data (a value of "+" in FIG. 41 indicates the surplus number of scanning lines), the surplus number of scanning lines is filled with the video data by the aforesaid N-line simultaneous write-in operation (N-line skip scanning, N is a natural number not less than 2), whereby the entire effective display area at the pixel array can be effectively used in a video display. However, in the case where the number of pixel arrays is lack with respect to the number of scanning lines of the video data (a surplus number of scanning lines is indicated by "–" value in FIG. 41), part of the video data in a vertical direction is not allowed to enter the effective display area even if the video data for each one line is written in one line of the pixel array. For this reason, deterioration in video image displayed in the pixel array is inevitable as long as the display process described above in reference to FIG. 13D is not provided (in other words, as long as it is restricted to the display process described in reference to FIG. 13B or FIG. 14B).

A surplus or lack state of the number of scanning lines of the video data and that in the effective display area in the pixel array will be described more practically in reference to FIG. 40 and FIG. 41 referring to a pixel array of XGA class and a pixel array of WXGA class, respectively.

In the case where the video data having an aspect ratio of 4:3 is displayed at a pixel array of XGA class (a horizontal resolution=1024, a vertical resolution=768 and an aspect ratio=4:3), all the vertical resolution (768 lines) in the pixel array can be utilized in the effective display area because both aspect ratios are equal to each other, resulting in that the number of blanking lines becomes 0 (padding with the blanking data is not required). In the case where this pixel array displays 480*i* video data with an aspect ratio of 4:3, 528 scanning lines other than 240 effective scanning lines in the effective display area used in the interlace process for each field is supplemented with 480*i* video data, whereby the video image can be displayed in the entire area of the pixel array without padding 768 scanning lines in the effective display area with the blanking data.

In the case where the video data with an aspect ratio of 16:9 is displayed at the pixel array of XGA class, the aspect ratio of the video data in the horizontal direction is wider than that of the pixel array. Accordingly, the horizontal resolution of the video data is adjusted to coincide with the horizontal resolution 1024 in the pixel array as described above in reference to FIG. 13B in order to keep a wide aspect ratio of the video data. With such an arrangement, the vertical resolution of the effective display area in the pixel array becomes the product of the horizontal resolution and the aspect ratio, 1024×(9/16)=576 and the remaining scanning lines in the pixel array, 768–576=192 lines, are padded with the blanking data as the blanking area. In the case where the video data of 1080*i* with an aspect ratio of 16:9 is displayed in this effective display area, 36 scanning lines other than 540 effective scanning lines in the effective display area used in the interlace scanning for each field are supplemented with 1080*i* video data, whereby the video image is displayed with 576 scanning lines in this effective the blanking data, with the result that the aspect ratio of 1080*i* video data displayed in this pixel array can be maintained.

On the other hand, in the case where the video data having an aspect ratio of 4:3 is displayed at a pixel array of WXGA class (a horizontal resolution=1280, a vertical resolution=768 and an aspect ratio=5:3), the vertical resolution in the displayed area becomes 768 lines in the same manner as that of XGA class. In this case, since the horizontal resolution of the video data becomes 768×(4/3)=1024, the aspect ratio is maintained by padding the blanking data having width of total 1280–1024=256 dots on the right and left sides along the horizontal direction in the pixel array. In addition, it is also possible to extend the video data in place of the blanking data in the horizontal direction for displaying.

In the case where the video data with an aspect ratio of 16:9 is displayed in a pixel array of this WXGA class, the number of dots of the video data in the horizontal direction is maintained in such a manner as to coincide with that (1280) of the pixel array, causing the vertical resolution (the number of effective vertical lines required for displaying the video data) to become 1280×(9/16)=720 lines. Due to this fact, 768 lines arranged in a vertical direction of the pixel array, 720 lines contribute to a formation of the effective display area shown in FIG. 13B and the remaining lines 48 (=768–720) are padded with the blanking data for example. Accordingly, when the video data with an aspect ratio 16:9 of the video format 1080*i* is displayed in the pixel array of WXGA class, 720–540=180 lines in the effective display area that is surplus with respect to the vertical resolution of 540 of the video data for each field period need a supplement of the video data. However, since the number of blanking lines relative to the number of vertical effective lines is as small as 48 lines, the pixel array is utilized in a relative effective manner.

Then, a vertical resolution of the displayed video image to which the aforesaid embodiment (and its application example) of the present invention is applied will be discussed in reference to an operation of the display device for generating video data in the effective display area formed in each of the pixel array of XGA class and the pixel array of WXGA class and each of the pixel arrays as described above.

At first, it is assumed that a video image of 480*i* having an aspect ratio equal to that of a pixel array of XGA class is displayed in the pixel array. The video signal of 480*i* has its vertical resolution of 240 since the number of effective scanning lines required for scanning with a frequency of 60 Hz for each field period is only 240 lines. Accordingly, a vertical resolution (768) of the pixel array of XGA class becomes not less than 3 times that of the video data of 480*i* for each field period. Therefore, even if this video data is inputted to the pixel array by 2-lines simultaneous write-in operation (2-line skip scanning) or the like to supplement a video signal to the surplus scanning lines in the pixel array, deterioration in video quality is relatively less generated since information of the video data in a vertical direction is not lost. That is, in the combination of the pixel array and the video data, the video data and black data are scanned in sequence in the pixel array in accordance with the aforesaid embodiment of the present invention to cause the pixel array to perform a blanking display operation for each field period, whereby an improvement of moving image display characteristic and its image quality can be accomplished.

Next, an example will be discussed in which video data of 1080*i* having an aspect ratio different from that of a pixel array of XGA class and having a higher vertical resolution than that in the effective display area formed at the pixel array in dependence on the aspect ratio is displayed. In this example, the vertical resolution of the effective display area of the pixel array with respect to the vertical resolution of 1080 lines of the video data becomes 576 lines as shown in FIG. 40. When the video data is displayed at the pixel array by the 2-line simultaneous write-in operation (2-line skip scanning), the scanning lines in the effective display area of the pixel array contributable to the display of the video data (540 lines in terms of the vertical resolution) supplied for each field period are only half (288 lines) of the aforesaid vertical resolution. That is, since 540 scanning lines are required for displaying 1080*i* video data for one field period inputted to the display device with a frequency of 60 Hz, the video information corresponding to scanning lines 540–288=252 lacked in the effective display area of the pixel array is lost for each field period. Accordingly, in the combination of this pixel array and the video data, although the blanking display operation for the pixel array for each field period in accordance with the aforesaid embodiment of the present invention contributes to an improvement in moving image quality, an effect in terms of the entire display quality is not necessarily sufficient.

Figure 15:
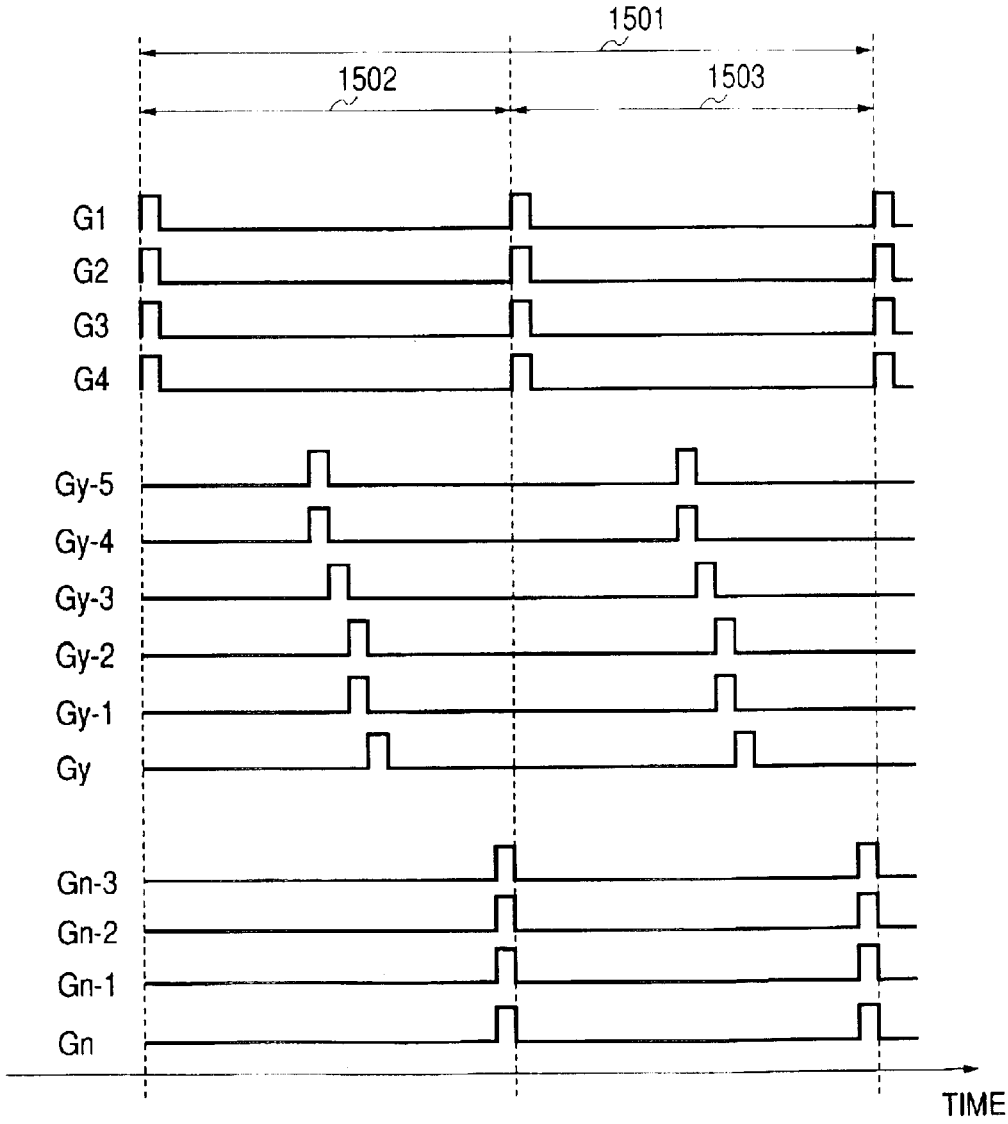
FIG. 15 is a timing chart of a gate selection pulse preferable for simplifying invalid area scanning in Embodiment 1 of the present invention.

In view of the foregoing, some optional examples are proposed as operations for displaying video data suitable for improving an effect of blanking operation in the pixel array in accordance with the present invention, the present inventor has considered several options. FIG. 15 is a diagram illustrating a scanning method as one of the optional example for improving displaying video quality by use of a basic system of the present invention described in reference to FIG. 1. In FIG. 15, ½ of the frame period 1501 is assigned to the video writing-in period 1502 and the remaining ½ is assigned to the blanking period 1503. As described above, in the case where the video image having an aspect ratio different from that of the pixel array (for example, displaying a video image having an aspect ratio of 16:9 at the pixel array with an aspect ratio of 4:3), part accommodating a difference between the aspect ratios of the pixel array and the video data, and this cannot be utilized in the effective display area. Therefore, the vertical resolution of the original image (refer to reference numeral 801 in FIG. 11A) inputted to the display device is inevitably substantially reduced in such a manner that it is allowed to coincide with that of the effective display area of the pixel array.

In view of the foregoing, FIG. 15 shows that lines G1 to G96 (only G1 to G4 are shown in FIG. 15) and lines G672 to G768 (only Gn−3 to Gn are shown in FIG. 15) in the blanking scanning area formed to adjust an aspect ratio of the video data in the pixel array having the vertical resolution of 768 lines are operated by 4-line simultaneous write-in operation (4-line skip scanning). Of course, these operations may be carried out such that the data is written simultaneously in additional N lines (N>4) and a skip-scanning every N lines may be carried out. In particular, since blanking-write-in supplies the same data (signal voltage) for each scanning signal to a plurality of pixels, it is apparent that the scanning lines of the original video image (video data) can be reproduced effectively if lines of as many as possible are written in simultaneously. When 192 lines in the aforesaid blanking scanning area are padded with blanking data for each 4 lines, it will take 48-time-scanning to finish the data inputting into the blanking scanning area.

Since the aforesaid frame period 1501 is also a period for completing the scanning corresponding to the vertical resolution (768 times in this case) of the pixel array, if the video data and the blanking data are written into the pixel array in the front half 1502 and the rear half 1503 of this period, respectively, the period assigned to both the operations is a period for completing the scanning of 384 times. Since it is necessary to input data into the aforesaid respective blanking scanning areas for both the video write-in period 1502 and the blanking period 1503, if this is completed by the scanning of 48 times scanning as described above, the remaining scanning of 336 times (=384−48) enables the video data or the blanking data to be inputted into the aforesaid effective display area. In the case where a video having an aspect ratio of 16:9 is displayed at a pixel array having a vertical resolution of 768 lines and an aspect ratio of 4:3, the data is inputted in 576 lines constituting the effective display area of the pixel array in a scanning period corresponding to the aforesaid 336 lines. Therefore, of the scanning of 336 times, 240 times are carried out by the 2-line simultaneous write-in operation (2-line skip scanning) and the remaining scanning of 96 times are carried out for each one line (in such a way that data corresponding to one line is inputted for each one line in the pixel array).

FIG. 15 shows an example in which the aforesaid scanning for each one line and the 2-line simultaneous scanning are alternatively carried out in a certain area. More specifically, the number of simultaneous write-in lines is made different in such a way that the same data is written at Gi−5, Gi−4 (i is an arbitrary natural number satisfying a relation of 102≦i≦671 in FIG. 15), only one line for Gi−3, the same data is written at subsequent Gi−2, Gi−1 and only one line for a subsequent Gi. In this case, since the number of times of scanning for each one line is as small as 96 times, the scanning for each one line is carried out once in a plurality of times of 2-line simultaneous scanning so that this scanning is dispersed as many as possible. It is quite natural to say that a desired video cannot be obtained unless the video data and the timing signal adapted for each of the scanning for each 1-line and 2-line simultaneous scanning are generated in the plural-time scanning data generator unit 102 and the plural-time scanning timing generator unit 103, respectively, in FIG. 1. In such an arrangement, also in the case where the original image having an aspect ratio different from that of the pixel array is displayed in the pixel array in the system of the present embodiment shown in FIG. 1, it is possible to suppress a lack of information in the original image arranged in the vertical direction to a minimum.

In place of the displaying method described above in reference to FIG. 15, it may also be possible to employ a method for making full use of the vertical resolution of the original image in display (hereinafter also called a finder display) as seeing it through the so-called view finder of a camera, that is, information of the original image shown in FIG. 13D in a horizontal direction is removed from the pixel array (displaying image area). In this case, since the number of scanning lines required for displaying the video data is expanded twice by the 2-line simultaneous write-in operation, it is possible to display the original image of 384 lines in the pixel array having a vertical resolution of 768 lines. However, since the aspect ratio of the pixel array in the horizontal direction is narrower than that of the original image, its horizontal resolution is lack for displaying the original image. Due to this fact, although the entire original image cannot be displayed at once in the pixel array, the display device is provided with a selection means in such a way that a user can select the displaying area. This selection means will be described in detail later. In this way, it is possible to restrict a reduction in vertical resolution by providing several options in the present invention and enabling them to be selected.

Further, a description will be made of an example in which a video image (its aspect ratio=16:9) according to a format of **1080*i* is displayed at the pixel array of WXGA class. In the pixel array of WXGA class, the number of lines in the effective display area (vertical resolution) capable of displaying the video data having an aspect ratio of 16:9 as shown in FIG. 13B is 720 (refer to FIG. 40**). When the scanning of 2-line simultaneous write-in (2-line skip scanning) is carried out in the effective display area, 360 scanning lines of the original image can be reproduced at the pixel array. In this way, the effective display area can be assured wide in a horizontal direction in the wide pixel array (a display picture having a relatively large aspect ratio in the horizontal direction). Accordingly, when the video data is displayed at such a pixel array by application of the present embodiment to the pixel array, the vertical resolution corresponding to the video data is also easily maintained at the effective display area, with the result that not only an improvement in moving image quality of the displayed video image but also an improved effect of image quality are achieved.

Although the effect of the present embodiment of the present invention in view of the moving image display at the pixel array has been described in the foregoing, the contents of broadcasting are not limited to the moving image, but they contain many still images. In addition, some display device users demand to watch a moving image in favor of the vertical resolution. Further, the vertical resolution is preferentially always applied in some cases if the display device has a function of reproducing and displaying the video image photographed with a digital camera or the like at the display device (or audio visual equipment having the display device mounted thereon). In addition, either the display device or the audio visual equipment has several display modes shown in FIGS. 13A to 14D and the displaying method can be changed over in dependence on the contents, whereby how to use or enjoy the contents can be matched with the preference of a user.

In a practical example, when sports live broadcasting is received in accordance with a format of 1080*i* and displayed at a pixel array having an aspect ratio of 4:3, after the entire video in a moving image mode as indicated in FIG. 13B is displayed, only the video image that a user wants to watch is extracted by focusing a specified person or area and changing it over to the display shown in FIG. 13D. In this case, the previous optional function can be applied in view of a feature that the displaying video quality as a moving image is improved. In addition, in the reproduction of the recorded video of digital broadcasting, when a moving image to be reproduced is brought to a still image by a function of temporarily stopping the reproduced moving image, an operation of the display device is changed over to a mode in which the still video data is inputted into the pixel group corresponding to one line in the pixel array for each one line (the blanking scanning in the present embodiment is not performed), the vertical resolution of the original image is reproduced at the display picture to a maximum by processing such as interlace/progressive conversion or the like, resulting in that a user can enjoy a more clear video image.

In view of these features, the system of the present embodiment is provided with a changing-over means capable of changing-over a moving image mode utilizing a blanking effect caused by plural-line simultaneous write-in operation and a still image mode for making full use of the vertical resolution by scanning for each one line described above. In addition, the system of the present embodiment is provided with several kinds of display modes as shown in FIGS. 13A to 14D, a function of properly changing-over the modes, a function of focusing a specified area of the original image, a function of zooming-in to or zooming-out of the specified area in the original image and a view finder moving function of properly moving the displayed area of the original image and the like.

Such a changing-over of the display functions described above is carried out in such a way that the aforesaid gate line control bus 109 as shown in FIG. 1, for example, is provided with a line for transmitting a signal to instruct changing-over of pixel array control and this signal is inputted to the scanning data generator circuit 102. The control changing-over signal (hereinafter called a control changing-over signal) for the pixel array (a display panel) is transmitted by the audio visual equipment user or the like to the scanning data generator circuit 102 through an external controller such as a remote control device or the like accompanied with this equipment and the aforesaid modes are changed over in response to the control change-over signal.

This scanning data generator circuit 102 generates a video image scanned for each one line in a still image mode and generates a video image (a white ground portion in an intermediate video image 802 shown in FIG. 11A or an intermediate video image 902 shown in FIG. 12A) scanned for every number of lines to which data is written simultaneously (every number of lines to be skipped for each one scanning) in a moving image mode. Each of the videos is subjected to a scaling process (accommodating for a difference between the number of pixels in a horizontal direction and/or a vertical direction generated at the video image and the pixel array) or the conversion between an interlace process and a progressive process in accordance with the pixel array 106 displaying the video images. In addition, the aforesaid blanking area is added to the video image so as to accommodate for a difference between the aspect ratio of the video image and that of the pixel array in accordance with a display mode of the video image at the pixel array. This blanking area is subjected to padding with the blanking data as described above, for example. The video image generated in such a way as described above and subjected occasionally to the processing as described above is transferred from the scanning data generator circuit 102 to the scanning timing generator circuit 103.

Since a video image generated by the scanning data generator circuit 102 and a timing signal generated by the scanning timing generator circuit 103 correspond to each other, a timing generated by the scanning timing generator circuit 103 is sometimes changed over when the aforesaid movie-still mode switching or a display mode switching at the pixel array as shown in FIGS. 13A to 13D or FIGS. 14A to 14D is carried out while the video is generated at the pixel array. Due to this fact, it is preferable that the control switching signal line 109 connected to the aforesaid scanning data generator circuit 102 is constructed also to supply a signal to the scanning timing generator circuit 103. When the control switching signal line 109 is connected to both the scanning data generator circuit 102 and the scanning timing generator circuit 103, the display control system including these circuits is probably complicated because its function is caused to follow the aforesaid movie-still mode switching, a variation in display modes at the pixel array, changing of kinds of pixel arrays used for displaying a video image or the like. For example, the display control circuit 114 and its peripheral wiring shown in FIG. 3 lead to the increased number of wiring and the complicated wiring pattern, whereby an expanding characteristic of the display control system is probably deteriorated. In view of a technical trade-off in the control switching to such a scanning timing generator circuit 103 in the present embodiment, information (including video control information, information needed for generating the aforesaid timing signal) requisite for displaying the data in the pixel array is added to video data (the aforesaid intermediate video) to be transmitted to the scanning timing generator circuit 103 from the scanning data generator circuit 102 in place of connecting the control changing-over signal line 109 to the scanning timing generator circuit 103. One example of the video data generated in this way is indicated in FIG. 16 in the same manner as the intermediate video images 802, 902 shown in FIG. 11A or FIG. 12A, respectively.

The original images 801, 901 shown in FIG. 11A or FIG. 12A include a data area for an electron beam scanning within a cathode ray tube called a retrace period other than video data so as to allow for displaying the original images 801, 901 in the cathode ray tube. The video data for each frame period is displayed at the display picture of the cathode ray tube by repeatedly scanning electron beams in a horizontal direction at a display picture and displacing the scanning positions in sequence in the vertical direction of the display picture for each horizontal scanning so as to scan the electron beams over all the pixels in the display image. When it is assumed that the horizontal scanning with the electron beams are carried out repeatedly at the display picture from the left side to the right side and the entire area of the display picture is scanned from the left upper side to the right lower side, the electron beams must be returned from the right end to the left end in the display picture for each horizontal scanning, and from the right lower end to the left upper end of the display picture. A period required for each of the operations is the aforesaid retrace period, and it is defined such that a period required for each horizontal scanning is called a horizontal retrace period and a period required for each frame period is called a vertical retrace period. Such retrace periods are not needed in the display device (a liquid crystal display device, an electroluminescent type display device and the like) provided with an active element for each pixel in view of its operational principle. Therefore, although the presence of the retrace period has been ignored in the above description in reference to FIGS. 11A to 12B, the aforesaid retrace period can also be utilized in the scaling for data of the original image in generating the aforesaid intermediate video images 802, 902.

Figure 16:
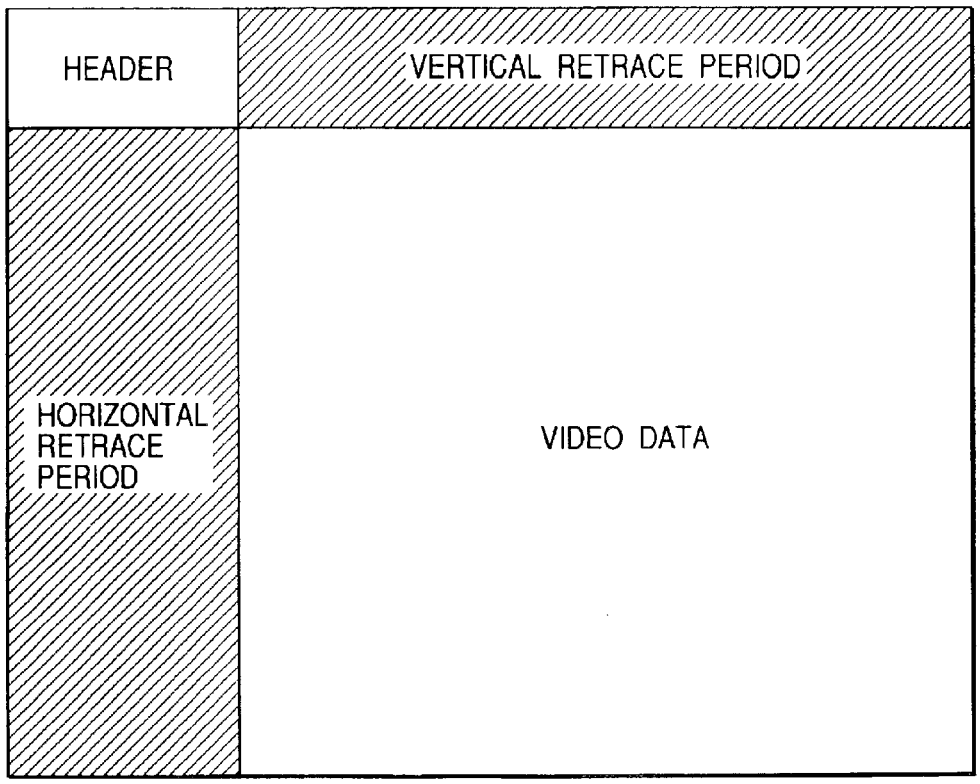
FIG. 16 is a schematic diagram showing a schematic state of a video format with display control information described in Embodiment 1 of the present invention.

In the case of video data shown in FIG. 16 (generated as the intermediate video images 802, 902, for example), part of the area corresponding to the retrace period is assigned to the aforesaid video control information. In FIG. 16, the data concerning the video image itself generated at the image area of the display device is assigned to a white ground area denoted as a video data, the data corresponding to the aforesaid horizontal retrace period is assigned to a left side black ground area of the video data, and the data corresponding to the aforesaid vertical retrace period is assigned to the upper side black ground area of the video data. In addition, a white ground area denoted as a header is formed at part of the black ground area (the left upper side of the video data) corresponding to the vertical retrace period. As described above, a sheet of the video data (intermediate video images 802, 902) generated by the scanning data generator circuit 102 is read out in sequence from its upper side by the scanning timing generator circuit 103 for each one scanning period, and converted into either a target video image or a blank video image 803, for example. Although the scanning timing generator circuit 103 also processes the video data of one sheet in the same manner as described above shown in FIG. 16, the processing steps have a following feature added thereto.

In the case where the video data shown in FIG. 16 is generated, the scanning timing generator circuit 103 recognizes the control information stored to the header area at the beginning of a frame period and generates a timing signal corresponding to it. At this stage, the scanning timing generator circuit 103 does not recognize information stored in the header area as information corresponding to the video signal supplied to the pixel array such as intermediate video images 802, 902. Then, the circuit recognizes the video data and processes it into data corresponding to production of the video signal (or blanking signal) in the drain line drive circuit in reference to the timing signal generated at the beginning of a frame period. Accordingly, as shown in FIG. 16, it is not necessary to provide new wiring in the display control system by a format for adding control information concerning its reading-out operation to the video data in the step for converting the original image into a video data suitable for the video display and blank display for each frame period in accordance with the present invention. In addition, this format transmits mode-selecting information of the video display at the pixel array to the scanning timing generator circuit 103 by use of the retrace period of the original image, so that it is not necessary to extend the period of time for transferring the data from the scanning data generator circuit 102 to the scanning timing generator circuit 103. If a control signal such as a horizontal synchronizing signal or a vertical synchronizing signal inputted to the display device together with the original image is inputted to the scanning timing generator circuit 103, it might also be possible to cause the scanning timing generator circuit 103 to recognize both production of the video data and control information concerning this production by use of these control signals. Further, control information and the video data corresponding to this control information are transmitted to the scanning timing generator circuit 103 in this order, accuracy and speed in recognition and processing of the video data in the scanning timing generator circuit 103 are improved.

An example of the kind of control information stored in the header area in FIG. 16 and each of the set values are collected in FIG. 42.

Several pieces of control information of various kinds of control information can be set in cooperation to each other, or their set values can be set separately for each piece of control information. When the video data is generated in the format to which its control information is added, a fundamental setting of information parameters concerning a display mode switching at a pixel array can be attained and these parameters can be expanded and set as well at the user's request of the display device or video equipment having this display device mounted without adding any surplus wiring to the display control system.

On the other hand, in the periods for the vertical retrace period and the horizontal retrace period (a black ground data area not utilized in transmittance of control information) shown in FIG. 16, the scanning timing generator circuit 103 stops production of timing signal or processing of video data or performs time adjustment for these processing. In the time adjustment, the surplus retrace period can be utilized for production of timing signal corresponding to the expanded and set display mode parameters.

In the present embodiment and the application example in which the system configuration shown in FIG. 1 has been mainly described above, displaying characteristics of a moving image and a still image can be freely controlled in accordance with the combination of the respective resolutions of the pixel array and the video image, arrangement of means for causing a user to select these display conditions can enhance a displaying performance of the moving image with the pixel array, flexibility, general applicability and expanding characteristic of the entire display device.

<Embodiment 2>

The system (for controlling the video display of the display device) described in reference to Embodiment 1 causes each of the pixels arranged in the effective display area of the display device to perform video display and blanking display in one frame period. Therefore, when this system is applied to the liquid crystal display device, a luminance of the displayed image is reduced due to a response characteristic of liquid crystal or an aperture ratio of each of the pixels formed at the liquid crystal display panel. In addition, in the case where a light source (a fluorescent lamp, a light emitting diode and the like) installed at a light source device (also called a backlight, a backlight system or a backlight unit) for allowing light to enter the liquid crystal display panel is also lit continuously in the aforesaid blanking display period, light emitting efficiency of the light source is decreased. Thus, the present embodiment improves lighting control for the backlight in the liquid crystal display device provided with the system described in reference to the embodiment 1 above.

Figure 17:
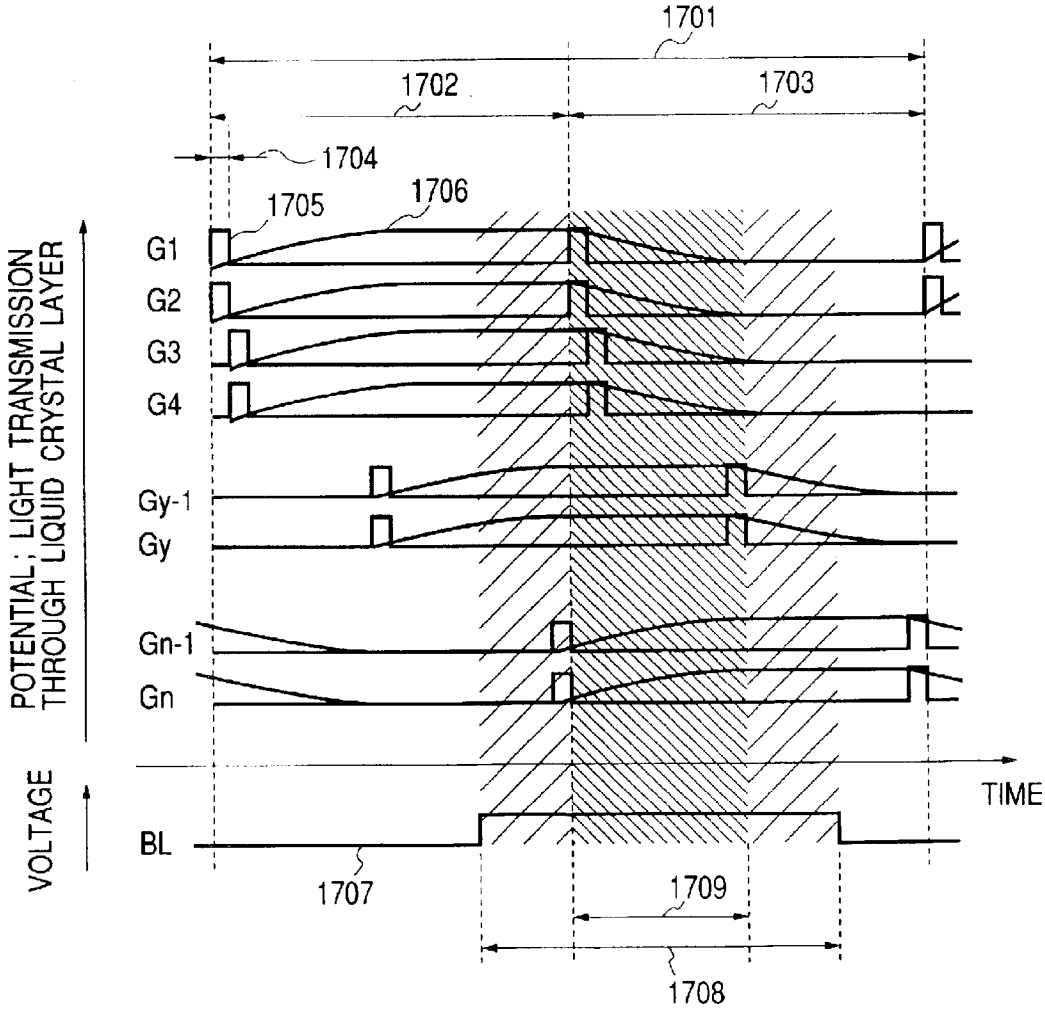
FIG. 17 is a view for showing a timing chart of each of a gate selection pulse and a backlight blinking of the liquid crystal display device driven by the 2-line simultaneous write-in and 2-line skip-scanning in Embodiment 2 of the present invention.

FIG. 17 indicates a lighting timing between a gate selection pulse (a pulse of clock signal selecting each of the pixel rows) in the pixel array and a backlight caused by the 2-line simultaneous write-in and the 2-line skip scanning described above in reference to FIG. 6 in which either the video signal or the blanking signal is inputted in sequence for each two pixel rows in the pixel array. The front half of the frame period 1701 of the video data inputted to the liquid crystal display device (a period corresponding to ½ of the frame period 1701) is assigned to a period 1702 where the video signal is written into the pixel row, and the rear half of the frame period 1701 of the video data inputted to the liquid crystal display device (a period corresponding to ½ of the frame period 1701) is assigned to a period 1703 where the blanking signal is written into the pixel row. The pixel rows are each selected in one-line selection period 1704 determined by a width of the gate selection pulse (gate pulse) 1705 corresponding to each of the pixel rows, and either the video signal or the blanking signal is supplied to the pixel groups constituting each of the pixel rows. Liquid crystal layers associated with G1, . . . Gn each provide an optical response indicated by a waveform 1706 by supply of a voltage signal to each of the pixel rows. In the present embodiment using a liquid crystal display panel operated in a normally black mode, the larger an electric field applied to the liquid crystal layer of each of the pixels, also the higher a light transmission of the liquid crystal layer. In the liquid crystal display panel operated in a normally white mode, the larger an electric field applied to the liquid crystal layer of each of the pixels, the lower a light transmission of the liquid crystal layer. Accordingly, although an optical response waveform 1706 of the liquid crystal layer in regard to the gate selection pulse 1705 as shown in FIG. 17 can be obtained in both the operating modes, a polarity of a voltage signal (either a video signal or a blanking signal) supplied to the pixel in response to the gate selection pulse 1705 is changed depending upon the operating modes.

In the present embodiment, the light source device (a backlight hereinafter) is controlled in accordance with the indicated lighting timing 1707 in response to the optical response (e.g., a variation of light transmission) of the liquid crystal layer as above. The backlight is lit at a high-level of the lighting timing 1707 and turned off at a low-level of the lighting timing 1707. The backlight (a light source device) installed at the liquid crystal display device is classified into two classes in terms of its arrangement for the liquid crystal display panel. One of them is the so-called side light-type in which an optical element called a light guide or a light guide plate is disposed oppositely to a major surface of the liquid crystal display panel and a light source such as a cold cathode fluorescent lamp or a light emitting diode and the like is arranged at a side surface of the optical element, where the liquid crystal display panel is irradiated with light from the light source indirectly through the optical element. Many of the side light-type liquid crystal display devices sometimes constitute a so-called front light-type liquid crystal display device in which its light source is not faced to the major surface of the liquid crystal display panel, and such an optical device as above is arranged on the user's side of the liquid crystal display panel. The side light-type backlight is preferable for restricting a thickness of an entire liquid crystal display device and applied to a product installed at a notebook type personal computer, for example.

In addition, the other type of backlight is the so-called direct type backlight in which a light source is faced to a major surface of the liquid crystal display panel, and this is preferable for increasing a luminance of the liquid crystal display device. In the case where an aperture ratio of the pixel formed at the liquid crystal display panel is low, for example, a plurality of light sources (cold cathode fluorescent lamps, for example) are arranged side by side oppositely to the liquid crystal display panel to cause a displayed video image in the liquid crystal display panel to be bright. In the present embodiment, the direct type backlight in which a plurality of fluorescent lamps (cold cathode fluorescent lamps) are faced to the liquid crystal display panel in view of increasing a luminance of the pixel array.

As shown in FIG. 17, gate lines are selected by two in sequence from the adjacent gate lines G1, G2 (the gate selection pulse 1705 corresponding to each of the lines is made high) and the video is written into the pixel groups associated with these lines. After completion of writing of the video image into the pixel groups associated with each of the gate lines (the gate selection pulse 1705 returns to a low state), an optical characteristic of the liquid crystal layer associated with these pixel groups respond in sequence through several ms to several tens ms.

In the blinking control of the backlight in accordance with the present embodiment, timing of reduction in luminance of the liquid crystal display panel in a turned-off state of the backlight is allowed to coincide with timing of blanking display (black data scanning), a lamp current generated in the fluorescent lamp at the time of turned-on state of the backlight is made higher than the lamp current at a normal operation (a continuous turned-on operation) so as to increase luminance of the liquid crystal display panel at the time of displaying the video image. It is more preferable that a light emission characteristic of not only a fluorescent lamp but also a light source reaches a desired level of brightness within a short period of time from a starting of supply of electrical current to the light source and light emission ceases rapidly (the so-called duration of persistence is short) after supply of electrical current to the light source is shut off. The electrical current that can be supplied to the fluorescent lamp is determined in its upper limit value in terms of the practical value on the basis of the relation between a value of the aforesaid lamp current and a lifetime of the fluorescent lamp. In addition, light emission response of the fluorescent for supply of electrical current or the duration of persistence each continues for about several ms. Due to this fact, in the present embodiment, a period for increasing a lamp current and turning-on the fluorescent lamp is set to a half of one frame period and the fluorescent lam is turned on once for each frame period.

The direct type backlight in which a plurality of fluorescent lamps are arranged side by side oppositely to the liquid crystal display panel may employ a method in which the backlight is controlled such that the blinking timing is shifted in sequence for each one fluorescent lamp. However, even if a certain fluorescent lamp is turned off, light from another fluorescent lamp adjacent to the former one leaks near the certain fluorescent lamp to increase a luminance of the area in the liquid crystal display panel intended to display dark (this phenomenon is called interference between the fluorescent lamps). Accordingly, even if the blinking timing of each of the fluorescent lamps is shifted in sequence, an effect to such an extent that has been intended cannot be obtained.

In contrast to this, the blinking of a plurality of fluorescent lamps are carried out with the same timing in the present embodiment. one example shown in FIG. 17, the fluorescent lamps are turned on with the scanning start timing of the blanking display period 1703 for displaying the pixel groups in black, or in reference to this scanning start timing and then the lamp is turned off in reference to a start timing of the video write-in period 1702.

In the present embodiment, an operation for turning on the fluorescent lamp in a turning-on period 1708 and turning-off in other periods in accordance with the timing shown in FIG. 17 is repeated for each frame period 1701. Since the starting time of the turning-on period 1708 is set to the rear half of an image signal writing period 1702, the fluorescent lamp is turned on at a stage where a light transmission of the liquid crystal layer (hereinafter defined as a liquid crystal layer at the central part of the display screen) corresponding to the pixel groups positioned at the central part of the display screen is increased in response to the image signal. In addition, since the ending time of the turning-on period 1708 is set to the rear half of a blanking-signal writing period 1703, the fluorescent lamp is turned off at a stage where a light transmission of the liquid crystal layer at the central part of the display picture is decreased in response to the blanking-signal. Adjustment of the illumination timing and the light transmission of the liquid crystal layer in this way cause the video image to be displayed more brightly at the central part of the display picture of the liquid crystal display device for each frame period, and subsequently it causes the video image to be masked more darkly with the blanking signal. Due to this fact, a contrast ratio of the video image generated at the central part of the display picture becomes clear.

In accordance with the present embodiment, there is a period in which the fluorescent lamp is being turned off even after the light transmission of the liquid crystal layer upper than the central part of the display screen is increased up to a value corresponding to the video signal (response to the video signal is completed). Additionally, there is a period in which the fluorescent lamp is being turned on even after the light transmission of the upper side liquid crystal layer is decreased by the blanking signal (a response to the blanking signal is completed). On the other hand, a light transmission of the liquid crystal layer lower than the central part of the display picture starts to increase in response to the video signal after the fluorescent lamp is turned on (a response to the video signal is started), and a light transmission of the liquid crystal layer below the former layer shows a value corresponding to the video signal for a while (a response for the video signal is completed) also after the fluorescent lamp is turned on. Accordingly, an overlapped time between a period in which a light transmission of the liquid crystal layer is in an increased state by the video signal (response to the video signal is completed) and a period in which the fluorescent lamp (a light source) is in its turned-on state is decreased as it is moved to a value higher or lower than the value as compared with that at the central part of the aforesaid display picture. In other words, the blanking of the display video is governed by the turning-on timing of the fluorescent lamp as the pixel rows of the display picture go to the upper and the blanking of the display video is governed by the turning-off timing of the fluorescent lamp as the pixel rows of the display screen goes to the lower. In contrast to this, the pixel rows at the central part of the display picture are displayed so that a period in which their associated liquid crystal layers complete a response against the video signal and a turning-on period of the fluorescent lamp are overlapped for a long period of time. Therefore, although the light is emitted in an impulse form from each of the pixels for each frame period in the entire display screen, an integrated value of the optical response (the number of photons emitted from the pixel) becomes maximum at the central part of the display screen and it is gradually decreased as the part of the display screen goes to the upper or lower side.

In this case, in view of the fact that users are ready to turn their eyes upon the center of the display screen, a difference in luminance between a luminance at the central part of the display picture and a luminance generated at each of the upper and lower sides of the display picture is scarcely recognized by a user. In addition, in the case where a video signal and a blanking signal are supplied to each of the pixels constituting the display picture for every frame period in accordance with the present invention, light is emitted from all the pixels in an impulse form. Further, a luminance becomes the highest value at the central part of the display picture where an integrated value of optical response becomes a maximum value, and in turn a luminance is substantially decreased in a symmetrical manner as the position goes from the central part of the display screen to each of an upper side and a lower side of the display picture. Due to these reasons described above, the liquid crystal display device in accordance with the present embodiment provides a user with displaying of a clear, bright video image (in particular, a moving image) having a displaying characteristic as found in a Braun tube where a peak luminance appears at the central part of the picture.

In the present embodiment, a lighting period 1708 of a fluorescent lamp is set up to ½ of a frame period 1701. This causes the possibility that a luminance of the screen is decreased due to the presence of light-ceasing period of the fluorescent lamp. In any of light sources such as a fluorescent lamp or a halogen lamp, a light emitting diode and an electroluminescent element, its luminous efficacy is dependent not only upon an electric current supplied to the light source, but also upon an increased temperature caused by this electric current. Accordingly, an operation for intermittently turning on the light source such as a fluorescent lamp does not necessarily give damage to a luminance of the display screen. The light source is cooled within the aforesaid light-ceasing period in dependence on the temperature dependency of luminance of the light source, so that it is also possible to prevent a luminance of the light source from being decreased due to an increased temperature. However, in view of the aforesaid possibility, an electric current (a lamp current) supplied to the fluorescent lamp in the present embodiment is made larger than a lamp current supplied to continuously turn on the fluorescent lamp (when a still image is displayed, for example). A lamp current value of the fluorescent lamp that is turned on intermittently in accordance with the present embodiment is set to twice the lamp current value that is supplied in the continuous turning-on operation.

In the present embodiment, when a luminance of the light source that is turned on intermittently is sufficiently high, the lighting period 1708 is further shortened, that is, the light source may be turned on in a lighting period 1709 started with the same timing as that of the blanking signal write-in period 1703, for example. Further, in order to accomplish such a turning-on timing as above, the lamp current supplied to the fluorescent lamp during the intermittent operation may be further increased. The turning-on period 1709 shown in FIG. 17 is terminated by a time in the middle of the blanking signal write-in period 1703 (in the front half of the blanking signal write-in period 1703). Therefore, the light source is completely turned off in a period where the pixels in the display screen, including its upper end pixel row, are displayed in black in accordance with the blanking signal and the light source is turned on after the liquid crystal layer corresponding to the pixel row at the central part of the display screen completely indicates the optical response for the video signal, so that the brightness of the displayed video image is increased and at the same time the luminous efficacy of the lamp is also improved.

As described above, although the liquid crystal display device having the direct type light source (the backlight) mounted thereon is used in the present embodiment, the intermittent turning-on of the light source described above can be applied to the liquid crystal display device having the side light type light source device mounted thereon.

Figure 18A:
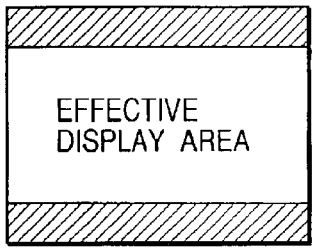
FIG. 18A is a diagram showing an invalid display area of the liquid crystal display panel in Embodiment 2 of the present invention.
Figure 18B:
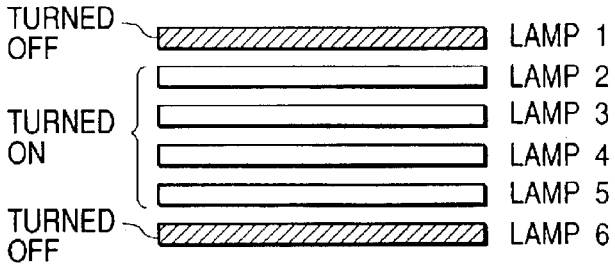
FIG. 18B is a diagram showing correspondence with lamp lighting positions in the light source device of the liquid crystal display panel.

Further, FIGS. 18A and 18B are diagrams showing an example of lighting control of the backlight performed when the video image having an aspect ratio different from that of the pixel array is displayed at the pixel array. In FIG. 18A, the video image having a different aspect ratio is generated in the effective display area as has already been described in reference to FIG. 13B and the invalid display areas indicated in black ground on its upper side and lower side are padded with the blanking data.

FIG. 18B shows the direct type backlight arranged at the rear surface of the pixel array which is provided with six lamps (e.g., cold cathode fluorescent lamps) which are controlled separately. In the application example described in reference to FIGS. 18A, 18B, the backlight for the effective display area padded with the blanking data for use in displaying the pixels in black, for example, is kept in the turned-off state because the turning-on operation is not required. That is, in the video display at the pixel array for each frame period, two, upper and lower, lamps may be turned off and only central four lamps may be turned on, so that power consumption of the backlight is suppressed and luminous efficacy of the backlight is also improved.

These switchable backlight control in the present embodiment is properly performed by a method in which the parameters as shown in FIG. 43 are attached as control information to the video data as already been described in the embodiment 1 in reference to FIG. 16 (by storing the control information in the header area, for example).

The scanning timing generator circuit 103 shown in FIG. 1, for example, receives the video data attached with the backlight control information from the scanning data generator circuit 102, transmits the video data to the backlight drive circuit 108 through the backlight control bus 111 so as to switch the control for each of the lamps installed at the backlight (light source device) 107. One example of the backlight control information includes a content in which the lamps 1 and 6 of the direct type backlight shown in FIG. 18B are always turned off and the lamps 2 to 5 are blinked with the timing shown in FIG. 17.

A liquid crystal display device mounted in a notebook type personal computer is provided with a side light type backlight so as to make its entire thickness thin. In such a liquid crystal display device as above, since its number of lights to be controlled or its turning-on manner is limited, a necessity for transmitting control information to the backlight drive circuit as described above is low. However, in the case where a moving image to be distributed through the Internet system or the like is watched by the notebook type personal computer, an significant advantage that blinks the lamp (a fluorescent lamp) with the timing shown in FIG. 17 is provided. Therefore, it is preferable that the display control circuit (a timing converter or the like) in the liquid crystal display device mounted in the personal computer above be provided with a function of attaching the backlight control information to the video data.

Controlling over a turning-on of the backlight in reference to a blanking display period set for each frame period or an effective display area of the pixel array (display picture) in accordance with the present embodiment described above improves a moving image displaying characteristic in the display device and further luminous efficacy of the light source device installed in the display device.

<Embodiment 3>

As described in the embodiment 1, when the pixel array is operated by the scanning process, the so-called 2-line simultaneous write-in (2-line skip scanning) in which a plurality of pixel rows (forming lines for each gate line or scanning line) arranged side by side along a vertical direction of the pixel array are selected for each two lines, a voltage signal is applied to these pixel rows and the pixel rows having the voltage signal applied thereto are selected in skip for each 2 lines in response to a pulse of the scanning timing signal, a video image having only a half vertical resolution of the original image inputted to the display device is inevitably reproduced at the pixel array in some cases.

As is apparent from FIGS. 40 and 41, when resolution of video data is sufficiently lower than that of the pixel array, that is, when the resolution on the vertical resolution basis is a half or less than that of the pixel array, the original vide information can be reproduced at the pixel array without any lack of the original video information even if 2-line simultaneous write-in/skip-scanning are carried out. However, when a vertical resolution of the video data exceeds a half value of that of the pixel array, it is inevitable that video information to be displayed is reduced or its mode is switched to the conventional hold type display mode for scanning one line of the pixel array for each video data of one line. Although the former case for restricting the video image to be displayed is suitable for displaying a moving image of high quality, a vertical resolution is reduced in a still image display; the latter case using the conventional hold type display mode presents the shows its converse manner. The present embodiment provides a method for displaying video information without deteriorating a vertical resolution while improving a moving image display performance caused by a blanking effect.

A data transmittance band in a drain drive circuit (a drain driver IC) available at present is about 50 MHz. As shown in FIG. 3, video data is transferred from the display control circuit (a timing converter) 114 by color, R, G, B, in a waveform shown in FIG. 5B, for example, to the drain drive circuit 105 (one pixel single interlace process described above). When the video data is transferred with a frequency of 60 Hz, the drain drive circuit 105 receives video data corresponding to one pixel in the pixel array at an interval of 16.7 ms. However, as shown in FIG. 5B, the video data is set such that the data for the number of pixels (the number of n×m, refer to FIG. 38) present in the pixel array are arranged in series with respect to a time axis, so that the drain drive circuit 105 must receive and process the video data in each of the pixels in a short interval of 16.7/(n×m) ms. Accordingly, the data transfer band required for the drain drive circuit 105 becomes more than an inverse number of the interval in which the video data corresponding to the number of pixels in the pixel array is received, that is, a product of transmittance frequency of the video data and the number of pixels n×m in the pixel array (effective display area).

If the pixel array of XGA is driven by use of this drain driver IC (Integrated Circuit), at least 60×768×1024≈47 MHz is needed in the case where the video data is supplied with a frequency of 60 Hz, and there is no margin in this driver data transferring band (also including a case in which color video data is supplied on three types of display color basis). To solve this problem, some products available at present include a display device which is provided with data buses for two pixels (a total of six buses by display color in a color video data) and which has a half rate of a transfer rate of each of the data buses. In this display device, video data of each of the display colors arranged in a horizontal direction are assigned alternatively to any one of the data buses for two pixels through two-pixel parallel interface described above in reference to FIG. 5C. Such a transfer process for a video data as above is essential in view of satisfying a dot clock frequency (a transfer rate) of about 80 MHz defined as XGA standards by the VESA (Video Electronics Standards Association), in particular, in a display device for monitor use.

However, in contrast to the display device for use in a monitor of which specification is defined by such standards as described above, a display device for displaying television broadcasting is not relatively put restrictions on the method for transferring the video data even if the display device displays digital broadcasting or is provided with as system applicable to NTSC (National Television System Committee). Accordingly, a signal processing circuit specific to each of the manufacturers is mounted on a display device (a liquid crystal display device and the like) for a television receiver. In view of the foregoing, the present inventors have studied a method for making full use of the data transfer band of the drain driver IC used.

The drain driver IC having the data transfer buses for two pixels is mounted on the display device of XGA class and the data is transferred to this drain driver IC with a frequency of 47 MHz as described above, with the result that scanning for two pictures with a frequency of 60 Hz, in other words, application of a signal voltage to all the pixels in the pixel array can be carried out in a frame period of 16.7 ms. In the present embodiment, such a driver IC (with two-pixel parallel interface) is used, of the scanning periods for two pictures assured in the one frame period, one scanning period for one picture is assigned to vide display and the scanning period for the other picture is assigned to blanking display, so that moving image displaying performance without losing a vertical resolution of the video data is improved.

Figure 19:
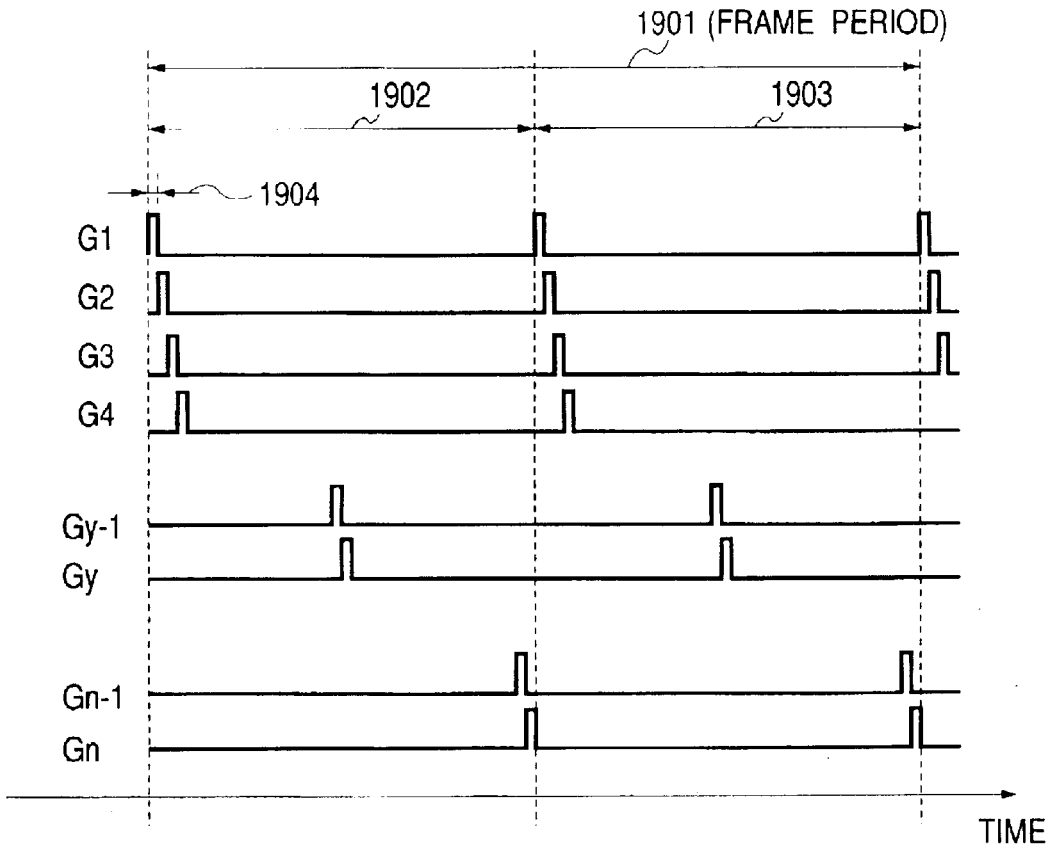
FIG. 19 is a timing chart of a gate selection pulse for use in scanning every 1 line of the pixel array in Embodiment 3 of the present invention.
Figure 20:
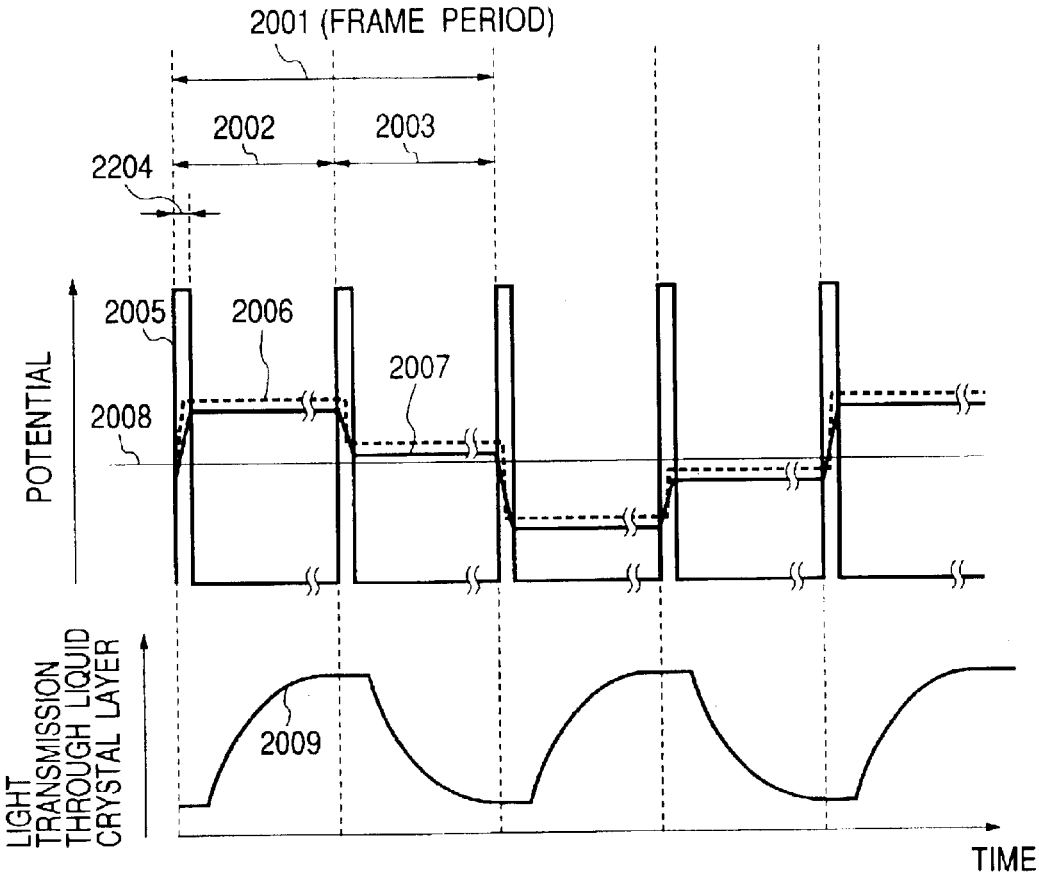
FIG. 20 is a diagram showing each of the signal line drive waveforms and the optical response waveform of the liquid crystal when scanning is carried out every 1 line of the pixel array in Embodiment 3 of the present invention.

FIG. 19 shows a timing chart of a gate selection pulse in the present embodiment. The front half (a period corresponding to ½ of the frame period 1901) of the frame period 1901 is assigned to a video write-in period 1902 and the rear half (a period corresponding to ½ of the frame period 1901) is assigned to a blanking period 1903 and the video signal or the blanking signal is supplied for each one line of the pixel array in one-line write-in period 1904. In the present embodiment, since the scanning operation for two pictures is carried out by scanning for each one line in one frame period, a write-in period for data signal for each one line is shortened to about half of that required for one-pixel single interface process. In view of the foregoing, the present embodiment provides a process operated such that a polarity of voltage signal applied to a drain line (with respect to the aforesaid common level) was reversed as shown in FIG. 20 at the time when a frame period 2001, i.e., video scanning (a video write-in period at the front half of the frame period 2001) and blanking scanning (a blanking period at the rear half of the frame period 2001) are finished so as to improve a write-in rate of the voltage signal to the pixel array. In both the video write-in period 2002 and the blanking period 2003, the video signal or the blanking signal is supplied for each one line of the pixel array in one-line write-in period 2004. As shown in the timing chart of FIG. 19, a gate waveform 2005 is generated by a scanning clock signal in which a voltage pulse is applied to any one of lines (scanning signal lines) G1 to Gn constituting the pixel array, a one-line write-in period 1904 associated with the voltage pulse is given and at least n pulses are generated for each of the video write-in period 2002 and blanking period 2003. On the other hand, the video data or the blanking data is applied to the drain signal line as a voltage signal having a drain waveform 2006 and applied to a pixel electrode arranged at each of the corresponding pixels in response to a voltage pulse of the gate waveform 2005 generated in the aforesaid one-line write-in period 2004. A voltage variation in the pixel electrode is indicated by a source waveform 2007, a potential between this voltage and a common level (an opposite voltage) 2008 is applied to the liquid crystal to modulate its light transmission. Accordingly, a polarity of an electric field generated in the liquid crystal layer is also inversed for each frame period 2001. A variation of light transmission in the liquid crystal layer for each frame period is indicated by an optical response waveform 2009. Although FIG. 20 assumes that a liquid crystal display device is in a normally black mode, also in the liquid crystal display device that is in the normally white mode, the light transmission of the liquid crystal layer can be modulated in accordance with an optical response waveform 2009 by changing the drain waveform 2006 and the source waveform 2007. Since driving of the liquid crystal display device in accordance with the present embodiment causes the optical response waveform 2009 in the liquid crystal layer to indicate a waveform of impulse type modulation responding to each of the video display and the blanking in one frame period, the moving image displaying characteristic attained by this waveform is improved.

Combining the backlight system described in the embodiment 1 with the liquid crystal display device in accordance with the present embodiment causes the moving image to be displayed more clearly and also causes luminance efficiency of the backlight to be improved.

Unlike the embodiment 1, in the present embodiment, the video data or blanking data is not written simultaneously in a plurality of lines, so that it is not necessary to perform a partial deletion of video information of the original image and a vertical resolution of the video image to be displayed is not decreased. With such an arrangement, displayed image quality is further improved.

The pixel array in the display device in the application example combining the 2-line simultaneous write-in (2-line skip scanning) of the embodiment 1 with the present embodiment can be scanned four times in one frame period, so that its moving image display performance is further improved. When the still image is displayed in this application example, details of this image are reproduced at the display screen (a pixel array) with a high vertical resolution. On the other hand, when a fast moving image is displayed in this application example, applying of the aforesaid liquid-crystal-response-speed-up filter processing or the like causes a resolution (a time margin) to be assured in a time direction and a displaying quality to be improved. Although a trial for speeding up the optical response of the liquid crystal has been promoted through improvement of liquid crystal material, a response speed of the liquid crystal material itself has been up to a range from several ms to several tens ms. In addition, even if the response speed has been improved in this way, a holding characteristic in which the liquid crystal layer holds a video signal in a frame period inevitably tends to deteriorate. Since the holding characteristic of the liquid crystal layer determines a frequency in occurrence of flicker at a screen of the liquid crystal display device, liquid crystal material showing a fast response speed has not been accepted in the liquid crystal display device used in a personal computer or the like in particular.

In contrast to this, if scanning for four pictures is carried out for each frame period as described in the present application example, the four pictures are divided into the initial two pictures for a video write-in scanning and the subsequent two pictures for a blanking scanning, and additionally, the initial one picture for the video write-in operation is assigned to scanning in which the video signal is subjected to a fast-responding filtering process and the subsequent one picture is returned to scanning performed by the normal video signal, whereby an impulse type drive of the liquid crystal display device in which an apparent response is accelerated can be realized. Since a potential of each of the pixels after the blanking scanning in the previous one frame period is always in a black display state in the present application example, the potential of the pixel in the subsequent one frame period is increased from the black display state to a value corresponding to the video signal. Accordingly, the fast-responding filter processes a video signal to be supplied to the pixel in the subsequent one frame period with a pixel potential in a black display state set as an initial value and the thus processed video signal is applied to the pixel. Therefore, a video signal production through the fast-responding filter can be carried out simply and positively in view of performing a fast increasing of the potential of the pixel to a desired level, so that its circuit configuration is also suppressed to a relatively small size. Further, as described above in reference to FIG. 10, if a polarity of the video signal with respect to a common level are inversed in reference to a video write-in for the first picture and a video write-in for the second picture in a frame period, and a polarity of the blanking signal with respect to a common level are inversed in reference to a video write-in for the third picture and a video write-in for the fourth picture in a frame period, inversion of the polarity in the electric field within the liquid crystal layer is completed in each of the video write-in period and the blanking period, so that a deterioration of the liquid crystal can be suppressed by applying an electric field always kept in a symmetrical state.

Figure 21:
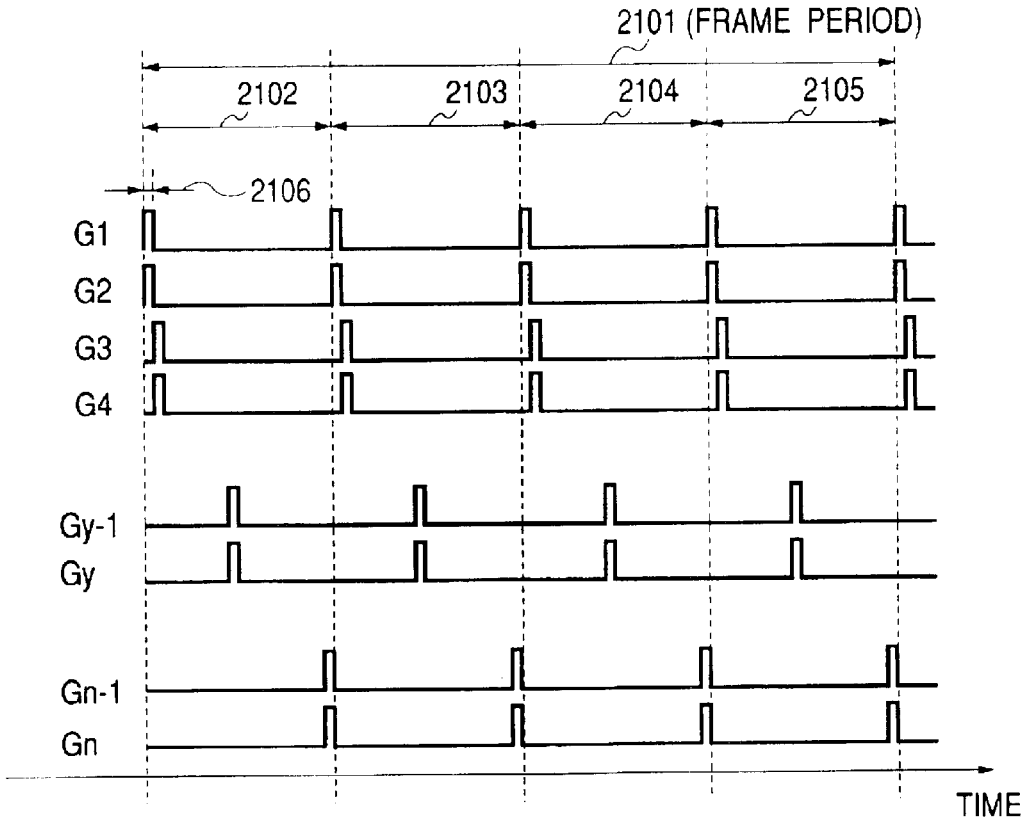
FIG. 21 is a timing chart of a gate selection pulse of the display device driven by the 2-line simultaneous write-in and 2-line skip scanning in Embodiment 3 of the present invention.

FIG. 21 is a timing chart showing a gate pulse for each of lines G1 to Gn in the present application example, wherein a frame period 2101 is divided into four periods each having a ¼ length of the frame period 2101. The four periods consist of, from the starting time of the frame period 2101, a period 2102 for writing in a video signal accelerating an optical response of the liquid crystal, a period 2103 for writing in a normal video signal, a period 2104 for writing in a first time blanking signal and a period 2105 for writing in a second time blanking signal. The gate selection period 2106 in which a voltage pulse is applied to each of the lines and a signal voltage is applied to the pixel rows associated therewith is about half of the normal write-in gate selection period 606 in one pixel single interface process shown in FIG. 9.

Figure 22:
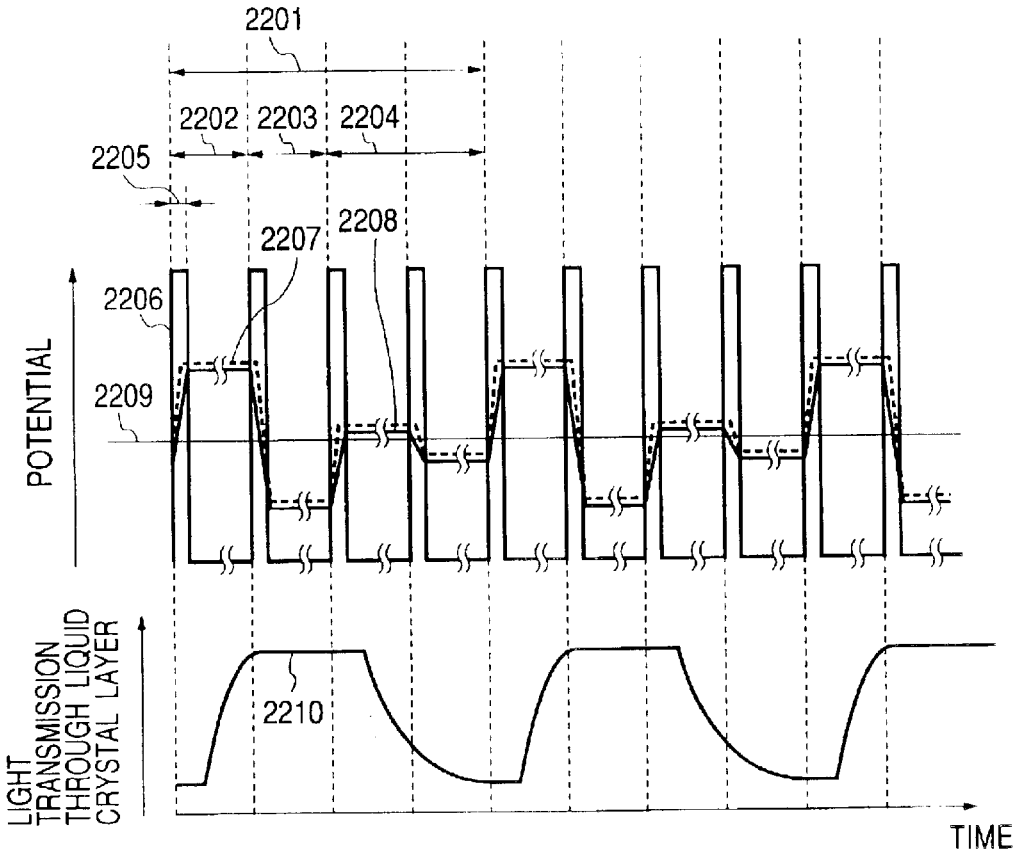
FIG. 22 is a diagram showing each of signal line drive waveforms and a liquid crystal optical response waveform of the display device driven by 2-line simultaneous write-in and 2-line skip scanning in Embodiment 3 of the present invention.

FIG. 22 shows a drive waveform of one line (a signal line) in the present application example driven in accordance with the timing chart shown in FIG. 21, wherein the frame period 2201 is divided in sequence into a fast-responding period 2202 having a ¼ length of the frame period 2202, a settling period 2203 having a ¼ length of the frame period 2202, and a blanking period 2204 having a ½ length of the frame period 2202. To this line is applied a voltage indicating the gate line drive waveform 2206 and this voltage is brought to a high-state in the gate selection period 2205, so that a voltage signal (a video signal or a blank signal) is written into the pixel associated with to this line. The write-in period of the voltage signal into this pixel coincide with the gate selection period 2205. On the other hand, a voltage signal indicating the drain line drive waveform 2207 is applied to the drain line and this voltage signal is applied to the pixel electrode arranged in the pixel in the gate selection period 2205. A potential of the pixel electrode varies like a source waveform 2208 and a potential difference between the source voltage waveform 2208 and the common level 2209 is applied to the liquid crystal layer to modulate its light transmission. The light transmission in the liquid crystal layer is varied as shown in the waveform 2210. The source waveform 2208, common level 2209 and waveform 2210 of the light transmission at the liquid crystal layer are based on the liquid crystal display device with the normally black mode.

In the liquid crystal fast-responding period 2202, a filter coefficient of the fast-responding filter is set in such a way that a video signal applied to the pixel becomes higher than a video signal applied to the pixel in the settling period 2203 so as to cause the pixel to be always responded from the black displaying potential to a desired potential as described above, and an electric field intensity applied to the liquid crystal is made higher than that in the settling period 2203. The so-called pseudo video signal having a voltage value of the video signal set to be higher than a predetermined value with the fast-responding filter in this way is applied to the pixel electrode, thereby the optical response waveform 2210 in the liquid crystal fast-responding period 2202 reaches rapidly to a predetermined light transmission. The time in which a light transmission of the liquid crystal layer reaches from its minimum value to a predetermined value (the maximum value in the case of white display) shown through a drive of the liquid crystal display device is shortened down to 4.2 ms.

The optical response of the liquid crystal layer shows a tendency in which it is made fast as an electric field intensity applied to the liquid crystal layer is increased, and is made slow as an electric field intensity is decreased. An orientation of liquid crystal molecule (determining a light transmission of the liquid crystal layer) is varied forcedly from an initial oriented state (an oriented state under a substantially no electric field) or its approximate oriented state into another orientated state due to an increased electric field intensity artificially in a sense and in turn it is naturally (without being forced) returned to an initial oriented state or its approximate oriented state in accordance with an amount of reduction of the electric field intensity. In the case where the liquid crystal display device is driven in the normally black mode in the present embodiment, a potential of the pixel electrode where the video signal corresponding to a certain frame period is written is set to a value corresponding to the black display (a minimum voltage value capable of being applied to the pixel electrode) at the time of end of another frame period preceding to the one frame period, so that the potential of the pixel electrode is increased by application of the video signal. In other words, a light transmission in the liquid crystal layer is increased from the minimum value at the time of the end of the above another frame period to a predetermined value corresponding to the video signal supplied in the above certain frame period. Therefore, the light transmission in the liquid crystal layer is changed rapidly and its speed is further increased through the processing of the video signal performed by the aforesaid fast-responding filter. In contrast to this, at a stage changing from the settling period 2203 to the blanking period 2204, a potential of the pixel electrode must be changed from a value corresponding to the video signal to its minimum value or its approximate value (this requirement is not applied to a pixel electrode to which the video signal of black display is supplied). In the liquid crystal display device with the normally black mode, an electric field generated at the liquid crystal layer in response to the video signal becomes a more intensified one than that corresponding to the blanking signal as long as a video signal increases a light transmission of the liquid crystal layer more than that of the blanking signal. Therefore, at a transit stage from the settling period 2203 to the blanking period 2204, an optical response at the liquid crystal layer becomes also slow. As described above, when the electrical field generated at the liquid crystal layer is decreased, its light transmission is not forced by a variation in the electrical field, so that the optical response at the liquid crystal layer is not accelerated to the extent that has been expected even if the fast-responding filter is used. It is effective to apply the blanking signal at least twice to the blanking period 2204 as described in the present application example in view of accommodating for deterioration in optical response in such a liquid crystal layer.

In the liquid crystal display device of normally white mode represented by the liquid crystal display device using TN (Twisted Nematic) liquid crystal, its light transmission is decreased as an electrical field intensity applied to the liquid crystal layer is increased. In other words, in the case of the liquid crystal display device of normally white mode, a display color (luminance) of the pixel responds fast toward a black level and responds slow toward a white level. Consequently, a relation between a speed of optical response of the liquid crystal layer at a stage shifting from one of the pair of aforesaid frame periods to the other and a speed of optical response at the liquid crystal layer at a stage shifting from the aforesaid settling period 2203 to the blanking period 2204 is inversed. That is, at the stage shifting from the settling period 2203 to the blanking period 2204, a potential of the pixel electrode (except an electrode to which the video signal of displaying black is supplied) is increased from a value corresponding to the video signal to its maximum value or its approximate value, so that a light transmission at the liquid crystal layer is rapidly changed and its speed is further increased through processing of the blanking signal caused by the aforesaid fast-responding filter.

In the present application example, since a transferring speed of video data to the drain driver IC through the two-pixel parallel interface process is made twice, the write-in period 2205 of the voltage signal (either the video signal or the blank signal) to the pixel rows selected for each line in accordance with the transferring speed is also shortened. In the present application example, a potential of each of the drain lines for supplying a voltage signal to each of the pixels constituting the pixel rows is changed such that a polarity of the potential relative to a common level (a common potential) is inversed for each ¼ period of the frame period 2201 as shown by a drain line drive waveform 2207. With such an arrangement, a polarity inversion period of the signal voltage at the drain line is completed for each frame period 2201 at each of the video signal write-in period (including the fast-responding period 2202 and the settling period 2203) and the blanking period 2204. In other words, the polarity of a signal voltage at the drain line with respect to the common level is inverted a plurality of times for each frame period. With such an arrangement, even if the aforesaid write-in period 2205 is shortened, the signal voltage is applied efficiently to each of the pixel electrodes associated with the lines selected at this period (a data write-in rate for each of the pixels is improved), with the result that each of the pixel electrodes is set positively to the desired potential.

In the case where the still image is displayed by the operation of the display device in accordance with the present application example, there is the possibility that a vertical resolution of the picture is decreased as described above in reference to the embodiment 1. To eliminate the possibility, the display device is preferably provided with means for recognizing whether the video data is the still image or the moving image and a switching means for a scanning process for scanning one line (one pixel row) in the pixel array of the display device for each one line of the video data when the still image is recognized and for scanning a pixel array in accordance with the present application example when the moving image is recognized. In one example of the display device, in the system block diagram for the display device shown in FIG. 1, video images (original images), for two frame periods, continuously inputted to the plural-time scanning data generator circuit 102 are compared with each other, a moving vector for each pixel is calculated on the basis of pattern matching or a gradient method or the like, and it is judged as a moving image if a moving amount more than a certain specified level is detected.

One example of this judging operation performed by the display device will be described as follows in reference to FIG. 3, for example. At first, the video data sent from the receiver circuit 113 to the display control circuit 114 in a certain frame period (called the first frame period) is stored in a memory M1. Then, the video data sent similarly from the receiver circuit 113 in the subsequent frame period (called the second frame period) next to the first frame period is stored in a memory M2. At a stage in which the video data in the second frame period is stored in the memory M2, the video data in the first frame period is read out of the memory M1, these video data are compared by a comparator arranged in the display control circuit 114 or around it so as to detect a difference between the video data. With such an operation, when a variation (motion) is detected at a video image to be displayed by the video data in the second frame period in reference to a video image to be displayed by the video data in the first frame, the video data in the second frame period is read out of the memory M2 in a form in accordance with the 2-line simultaneous write-in (2-line skip) in reference to the present application example. At this time, the video data in the second frame period is read out of the memory M2 as an intermediate video 902 as shown in FIG. 12A, for example. When the motion is not detected, the video data in the second frame period is read out of the memory M2 as the original image 901 shown in FIG. 12A, for example. In any of the cases, the video data read out of the memory M2 is sent to the scanning timing generator circuit 103 arranged in the display control circuit 114. Such an operation is repeated such that at a stage in which the video data sent from the receiver circuit 113 is stored in the memory M1 in the subsequent frame period (called the third frame period) next to the second frame period, the video data in the second frame period is read out of the memory N2, the video data in the second frame period and the third frame period are compared with each other, subsequently at a stage in which the video data sent from the receiver circuit 113 in the subsequent frame period (called the fourth frame period) next to the third frame period is stored in the memory M2, the video data in the third frame period is read out of the memory M1 and the video data in the third frame period and the fourth frame period are compared with each other.

As already described in the embodiment 1 in reference to FIG. 16, it is preferable that the control information associated with each of the results of judgment as to whether the video data is the still image or the moving image be attached to the video data generated in the scanning data generator control circuit 102 (arranged in the aforesaid display control circuit 114, for example). The video data attached with the control information is sent from the scanning data generator control circuit 102 to the scanning timing control circuit 103, and the scanning timing control circuit 103 generates a gate pulse as shown in FIG. 21 when the received video data is the moving image. Giving and receiving of these video data are carried out within the aforesaid display control circuit (timing converter) 114 arranged in the display device (or its module), for example, and the scanning clock signal for generating either the gate pulse or a frequency divided gate pulse as shown in FIG. 21 is outputted from the display control circuit 114 together with the video data (also including the blanking data) 903 shown in FIG. 12B. In the present application example, the video data 903 is sent from the display control circuit 114 to the drain line drive circuit 105 through the 2-pixel parallel interface (comprising six bus lines in the case of color display), either the aforesaid gate pulse or the scanning clock signal is sent from the display control circuit 114 to the gate line drive circuit 104 and the drain line drive circuit 105 through the clock signal line. The control information attached with the video data is set such that the parameters shown in FIG. 44 are added to the parameters indicated in FIG. 42 in the embodiment 1, for example.

The scanning timing generator circuit 103 receiving the video data attached with the control information associated with the moving image converts either the video data or the blanking data into the voltage signal applied to each of the drain lines 203 at a high-speed by the drain line drive circuit 105, and generates timing suitable for applying in sequence, for each two lines, a gate pulse for selecting the pixel rows in the pixel array by the gate line drive circuit 104 for each two lines of the gate lines 201. The voltage signal generated by the drain line drive circuit 105 in this way is applied to each of the pixels in the pixel array in response to the gate pulse generated by the gate line drive circuit 104 and a light transmission (a luminance of each of the pixels) in the liquid crystal layer is raised at a high-speed as shown in FIG. 22, whereby the pixel array is impulse driven to display the moving image clearly.

On the other hand, the scanning timing generator circuit 103 receiving the video data attached with the control information associated with a still image generates the video data suitable for supplying the pixel information for each one line of the original image for each one line of the pixel array and generates a gate pulse shown in FIG. 19 for selecting in sequence the pixel rows in the pixel array for each one line of the gate lines 201. The scanning timing generator circuit 103 also generates a blanking data suitable for being supplied for each pixel row in one line of the pixel array and applies a voltage signal corresponding to the blanking data in sequence to the pixel rows arranged for each one line of the gate lines 201 in response to the aforesaid gate pulse. With such an operation, the video having a vertical resolution of the original image is displayed impulsively at the pixel array.

Further, when a display device user requests a display video image keeping the vertical resolution of an original image even if either the display device or its control system judges the original image as the moving image, it is also possible to generate the moving image at the display device by the same operation as that for the aforesaid still image through the control bus 109 shown in FIG. 1.

Further, when a control for the backlight (light source device) described in the embodiment 2 is combined with a drive of the display device in accordance with the present embodiment or its application example, the moving image displayed by the present embodiment or its application example becomes clearer due to a blanking effect caused by blinking of the backlight. In addition, since the luminous efficacy of the light source device is also improved, displayed video quality of the display device (a liquid crystal display device) is also improved.

<Embodiment 4>

As already been described in reference to FIGS. 13B, 13C and FIGS. 14B, 14C of the embodiment 1, the present embodiment provides a description about a display device and its drive suitable for compensating for a difference between an aspect ratio of the pixel array and an aspect ratio of the video displayed by generating the effective display area displaying a video and an area (a surplus displaying area indicated in black) not contributing the video display in the pixel array (a display picture) of the display device along its horizontal direction. This display device is provided with a gate line drive circuit capable of selecting an address of a line (a gate line) for starting a scanning of the display picture along its vertical direction and an address of a line finishing this scanning operation.

Figure 23:
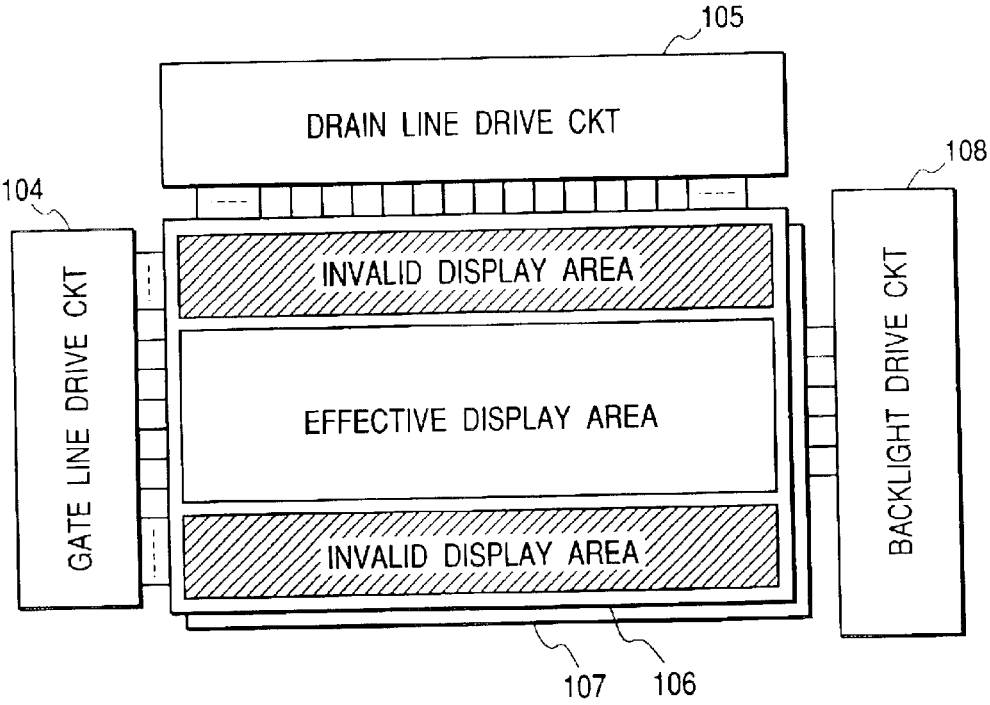
FIG. 23 is a schematic diagram of the display device in Embodiment 4 of the present invention.

FIG. 23 schematically indicates a system configuration of the liquid crystal display device operated under a normally black mode as one example of such a display device as described above. a gate line drive circuit 104 composed of a gate driver IC (a scanning signal drive integrated circuit element) capable of selecting a line to be scanned in a vertical direction as described above, a drain line drive circuit (a video signal drive integrated circuit element) 105, a backlight (a light source unit) 107, and a backlight drive circuit 108 are arranged around the liquid crystal display panel 106 having the pixel array as shown in FIG. 2.

The gate line drive circuit 104 sets an address of line starting a vertical scanning and an address of line finishing a vertical scanning of a plurality of gate lines arranged side by side in a pixel array of the liquid crystal display panel 106 (each of them is discriminated by addresses of G1 to Gn shown in FIG. 2). Therefore, the gate line drive circuit 104 can perform a usual vertical scanning operation for writing a voltage signal (either a video signal or a blanking signal) to the pixel row corresponding to each of lines upon selection of from an initial stage line G1 to a final stage line Gn in the pixel array. The gate line drive circuit 104 can also perform a partial display operation for writing a voltage signal in sequence to the pixel row corresponding to each of lines specified by addresses ranging from Gy to Gy' upon selection of the pixel array ranging from the line Gy at the middle stage to the line Gy' at the middle stage (y, y' are optional natural numbers larger than 1 and smaller than n, satisfying a relation of y<y').

An advantage of the display device (the liquid crystal display device in the present embodiment) provided with the gate line drive circuit 104 having such a scanning line selecting function becomes apparent when a video of format having an aspect ratio different from that of the pixel array (refer to FIGS. 40 and 41) is displayed at the pixel array. The display device provided with a gate line drive circuit having no such a function as above is operated such that the gate line drive circuit applies a scanning signal (a gate pulse) to all the gate lines 201 in the pixel array connected to the gate line drive circuit also whenever videos are displayed at the pixel array. Due to this fact, a luminance of each of the pixels (a light transmission of the liquid crystal layer corresponding to each of the pixels in the liquid crystal display device) cannot be substantially controlled unless a voltage signal is applied to all the pixels (pixel rows) corresponding to these gate lines. Accordingly, when the display device having no scanning line selecting function displays a video having an aspect ratio different from that of the pixel array, it is necessary to apply a padding of blanking data to an area (other than the effective display area) not used for displaying the video as shown in FIG. 13B. That is, the blanking signal (a so-called dummy video signal) must be outputted from the drain line drive circuit associated with a scanning at the area other than the effective display area. Due to this fact, the video data transferred from the display control circuit 114 of the display device to the drain line drive circuit 105 cannot avoid to include the blanking data (a dummy video) associated with the area other than the effective display area and accordingly thereto an amount of data to be transferred to the drain line drive circuit for every frame period is also increased.

In contrast to this, if the display device is provided with the gate line drive circuit having a scanning line selecting function described in reference to the present embodiment, the blanking display of the pixel arranged at the area other than the effective display area can be performed separately from the data write-in operation (applying of either a video signal or a blank signal to the pixel electrode) to the pixel arranged in the effective display area. Due to this fact, a time assigned for the scanning of area other than the effective display area for every frame period can be used for a scanning of the effective display area. Accordingly, as described in reference to the embodiment 1, either a displaying operation for selecting the gate line in the pixel array (in the effective display area) for every plurality of lines and performing a simultaneous write-in scanning of data to the pixels corresponding to these lines while skipping for every plurality of lines, or a fast data-transfer operation for shortening a selection time for each of the lines (a gate pulse width) in the aforesaid pixel array (in the effective display area) as described in reference to the embodiment 3 and applying a signal voltage to the pixel electrode corresponding to each of the lines in the selecting period by a plurality of times for every frame period can be carried out with a tolerance for the data-transfer area of the drain line drive circuit. Further, it is not necessary to transfer the aforesaid dummy video from the display control circuit to the drain line drive circuit. That is, the dummy video data may be generated at a location other than the display control circuit (in the drain line drive circuit, for example). In the case of the liquid crystal display device of normally black mode or the electroluminescent type display device, a scanning of an area other than the effective display area is stopped and a luminance of pixel in this area may be kept at a black display state (a light transmission of the liquid crystal layer in this area is made minimum in the case of the liquid crystal display device).

Next, in reference to a timing chart for a gate selection pulse in a pixel array shown in FIG. 24, there will be described one example of a driving operation at the display device in which a group of lines used for displaying videos in the pixel array is selected in accordance with the present embodiment, and a scanning for the group of the lines and a scanning for another group of lines (not used in displaying video) are separately carried out.

Figure 24:
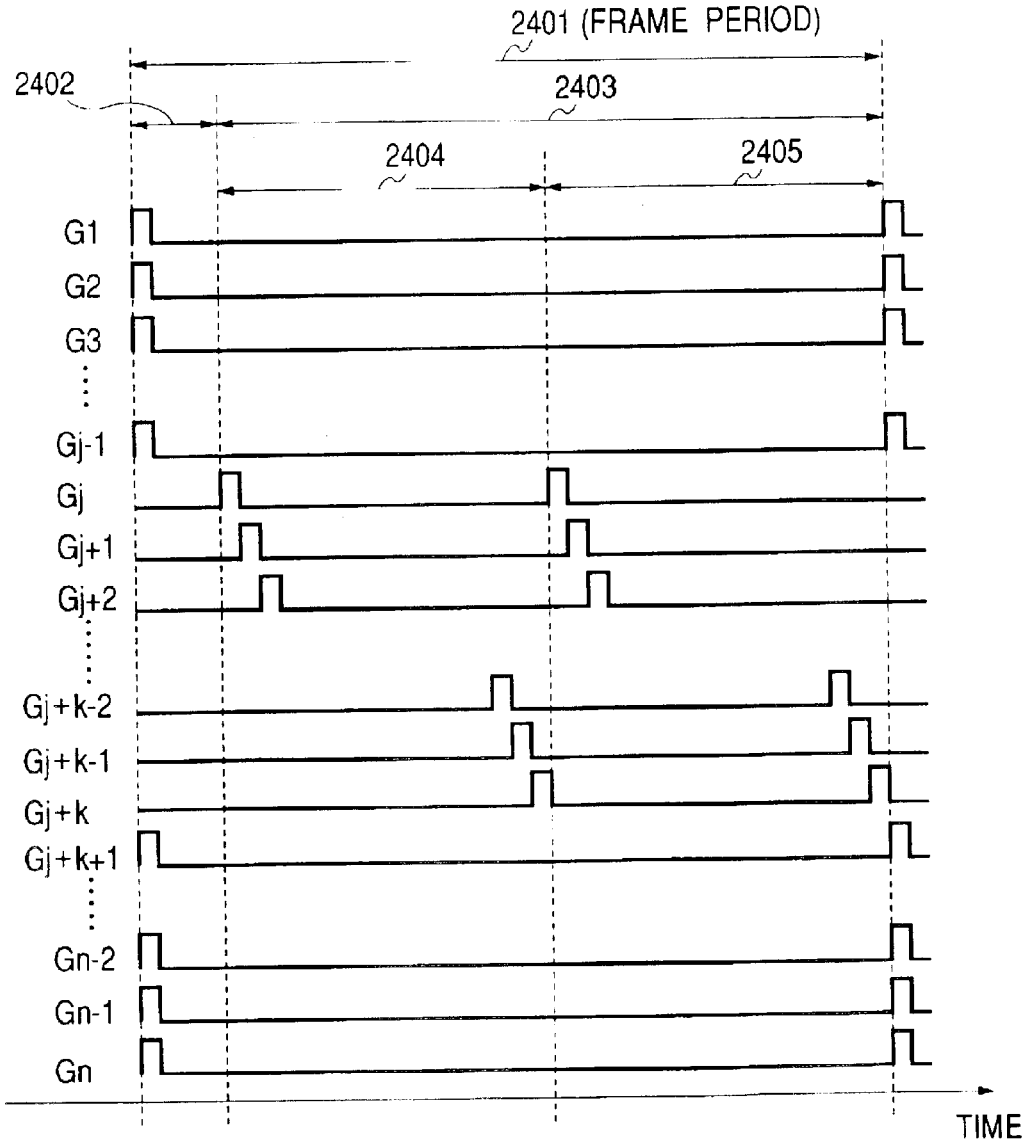
FIG. 24 is a timing chart for a gate selection pulse of the display device in Embodiment 4 of the present invention.

In the timing chart shown in FIG. 24, a frame period 2401 of a video inputted to the display device is divided in sequence into a retrace period 2402 and a display period 2403. The display period 2403 is assigned in sequence for a video write-in period 2404 and a blanking data write-in period 2405 at which the written video is displayed at the pixel array in an impulse manner. Although the timing chart for the gate selection pulse generated in the pixel array for every frame period for the video has already been described in reference to FIGS. 6, 9, 15, 17, 19 and 21, the retrace period as shown in FIG. 24 is also included for every frame period of the timing charts in the aforesaid embodiments 1 to 3. However, the aforesaid embodiments omit a displaying of retrace period due to a presence of both understanding of each of the technical concepts and possibility in which the retrace period is used in writing of either the video data or the blanking data into the pixel array. In the present embodiment, this retrace period is assigned for a scanning of line (other than the line in the effective display area shown in FIG. 13B and the like) not used in display of video in the pixel array.

In the timing chart shown in FIG. 24, k lines of gate lines specified by the addresses ranging from Gi to Gi+k of n lines of the gate lines are used in displaying of video on the basis of the pixel array provided with the number of n of gate lines and their corresponding pixel rows (except for dummy pixels around the display area seen at a certain liquid crystal display device). In other words, the effective display area is formed by the group of pixels ranging from the pixel rows corresponding to the gate line Gi to the pixel rows corresponding to the gate line Gi+k. To the contrary, the group of pixels corresponding to a total (n−k) line of the gate lines specified by addresses ranging from Gi to Gi−1 in the number of n of gate lines and the gate lines specified by addresses ranging from Gi+k+1 to Gn are padded by the blanking signal as an effective area not contributing to a display of the video. In this case, affix letters of i and k are optional natural numbers satisfying a relation of $5 \leqq i$ and a relation of $i+k \leqq n-4$.

All the pixels in the invalid area corresponding to the aforesaid (n−k) line may be displayed uniformly in black, for example, or in color not hindering a user's sight of view when the video displayed in the effective display area is seen by a user. In the present embodiment, the lines ranging from address G1 to address Gi−1 and the lines ranging from address Gi+k+1 to address Gn are selected simultaneously in the retrace period 2402, and the blanking signal displaying the pixel in black is written into all the pixels corresponding to these (n−k) lines. After the blanking signal is written into the pixels in the invalid area, the video signal and the blanking signal are written in sequence into each of the pixels present in the effective display area in a display period 2403.

The video displaying operation in accordance with the present embodiment and its advantage will be described more specifically in reference to an example in which the video of **1080*i* is displayed at the pixel array of XGA class. In this example, as shown in FIGS. 40 and 41**, 192 gate lines out of 768 gate lines arranged in the pixel array become invalid display lines, and remaining 576 lines become effective display lines. When the video corresponding to one frame period is displayed in an entire area of the pixel array while being scanned for every one line, the number of gate selection pulses required for this operation becomes 768. In other words, at least 768 pulses are generated for every frame period at a scanning clock signal transmitted to the gate line drive circuit.

In the present embodiment, videos corresponding to one field of interlace process formatted in **1080*i* (including data corresponding to 1080 lines of gate lines of 540 odd-numbered lines or 540 even-numbered lines) in one frame period in which an entire area of such pixel array as above is once scanned for every one line are displayed. In the present embodiment, 192 lines in the invalid area are scanned in a retrace period 2402 separate from 576 lines in the effective display area, so that the gate selection pulses generated by 768 times in the display period 2403** can be utilized for the data writing-in operation for 576 lines in the effective display area.

As described above, since the display period 2403 is divided into the video writing-in period 2404 and the blanking data writing-in period 2405, the video signal writing-in operation for 576 lines in the former case and the blanking signal writing-in operation for 576 lines in the latter can be carried out with gate selection pulses of 384 times, respectively. Accordingly, 384 lines out of 576 lines in the effective display area for use in displaying video formatted in **1080*i* at the pixel array of XGA class is scanned under 2-line simultaneous selection mode with 192 times of gate selection pulses and the remaining 192 lines are scanned under 1-line selection mode with 192 times of gate selection pulses, respectively, whereby the video signal is written into all the pixels corresponding to 576 lines (the video writing-in period 2404) and the blanking signal is written (the blanking data write-in period 2405). As one practical example of such a scanning method as described above, a scanning by the 2-line simultaneous selection mode for every gate selection pulse and a scanning by one-line selection mode are carried out alternately. With such an operation as above, data corresponding to 540 lines of video inputted to the display device for every field period are written into the effective display area of the pixel array with gate selection pulses of 384 times in the video write-in period 2404. That is, data of 384 lines out of 540 lines (540 of the vertical resolution) transmitted to the display device for every field period are reproduced at the picture in a video write-in period 2404, the picture having the video reproduced in its subsequent blanking data write-in period 2405** is switched to the blanking display to cause the video reproduced at the picture to be seen in an impulse manner.

In place of the aforesaid scanning method, it is also possible to perform a writing-in operation for writing the video data of **1080*i*** corresponding to one field period and the blanking data in sequence for every one line of 576 gate lines arranged in the effective display area of the pixel array of XGA class and to display the video in an impulse manner. In this case, since 576×2=1152 lines are scanned in one field period, it is necessary to output the voltage signal according to the times of scanning to the drain line drive circuit. That is, the video data (also including the blanking data) for outputting such a voltage signal as above at the drain line drive circuit must be transferred from the display control circuit (the timing converter). For example, for the video corresponding to one field period to be inputted to the display device at a frequency of 60 Hz, the video data displayed at the pixel array and the blanking data are transferred to the drain line drive circuit at a frequency of about 60×1024×1052=65 MHz. Accordingly, the drain line drive circuit having the data transfer band of 50 MHz usually installed at the pixel array of XGA class is replaced with the drain line drive circuit having a data transfer band of 80 MHz or more for the pixel array of SXGA class.

In this way, when the data transfer band in the drain line drive circuit is set to be sufficiently higher than the data transfer band corresponding to a resolution (the number of pixels) of the pixel array of XGA class having the drain line drive circuit installed therein, 576 gate lines arranged in the effective display area of the pixel array can be scanned by four times, for example, through the plural-line simultaneous write-in operation and the plural-line skip scanning operation in accordance with the embodiment 3 for every field period of **1080*i* data. Due to this fact, a blur of contour of a moving item displayed at a picture is restricted by displaying the video data corresponding to one field period of data of 1080*i*** through front half twice scanning of four times scanning for the effective display area performed by the plural-line simultaneous write-in operation and the plural-line skip scanning, and by displaying the blanking data at the pixel array through rear half twice scanning, respectively. In addition, the video showing many actions (many number of pixels showing some luminance changed for every frame period) can be displayed clearly by performing an initial scanning to write-in the video data into the effective display area for every one field period of the video data when the display device has a pixel array driven under a normally black mode, and by filtering a voltage signal supplied from the drain line drive circuit to the pixel array through an initial scanning to write-in the blanking data into the effective display area when the display device has a pixel array driven under a normally white mode.

In addition, in the liquid crystal display device in accordance with the present embodiment, the lamps corresponding to the pixel array acting as the invalid display area are turned off over the frame period in accordance with the embodiment 2, or the turning-on of the lamps constituting the light source device (the backlight) is controlled for every frame period, whereby the quality of the moving image can be improved more, a luminous efficacy of the light source device can be improved and a consumption power can be restricted.

Referring to FIG. 1, there will be described a changing-over of the scanning range in the pixel array set by the gate line drive circuit for every frame period (for every field period) of video inputted to the display device in accordance with the present embodiment. In the present embodiment, an instruction for changing-over the display mode from outside the display device is inputted from the control bus 109 to the scanning data generator circuit 102 as described in reference to the embodiment 1. The scanning data generator circuit 102 converts the video inputted to this circuit into video data in response to a displaying method suitable for it (either the still image or the moving image). As already been described in the embodiment 1 in reference to FIG. 16, the video data is affixed with each of parameters illustrated in FIG. 42 or FIG. 43 or information (control information) composed of parameters illustrated in FIG. 45 by the scanning data generator circuit 102 and the video data is transferred to the scanning timing control circuit 103.

When the scanning timing generator circuit 103 receives the video data attached with such control information as above, it generates a timing for controlling each of the drive circuits also including a gate drive circuit 104, a drain drive circuit 105 and a backlight drive circuit 108 in a certain liquid crystal display device on the basis of the control information. The display device constructed as above receives an instruction for switching the display mode in response to visual contents desired by a user, at the scanning data generator circuit 102 through the control bus 109, and properly changes the video display corresponding to the instruction to any one of impulse type drive (a pseudo impulse mode in accordance with the present invention) and a hold-type drive to thereby improve its displayed video quality in response to the video.

<Embodiment 5>

In order to perform writing-in of video into the pixel array and writing-in of blanking data for every frame period (for every field period in the interlace mode) through scanning for every one line in the pixel array and to attain an impulse-type luminous characteristic, it is required to arrange the drain line drive circuit having a scanning band at least twice that required in the drain line drive circuit used in the conventional hold-type display of the still image. In order to generate an impulse type video of one frame at the display device having a pixel array of XGA class, for example, 1536 lines exceeding the pixel array (a vertical resolution of 1200) of UXGA class in one frame period are scanned because 768 lines are scanned in ½ of the frame period. Accordingly, in order to generate an impulse video by writing the video signal and the blanking signal into the pixel array in response to such a scanning as above, the data transferring band capable of receiving data for the impulse video and processing it (corresponding to one more than the data transferring band of the drain line drive circuit for UXGA class) is required in the drain line drive circuit.

As already been described in the embodiment 3, the drain driver IC (the drain line drive circuit) available at present is operated such that data is transferred from the display control circuit to the drain line drive circuit, if the data transfer band is slightly larger than a band required for displaying the video for every frame period through scanning for every one line in the pixel array. However, an operation margin of the drain line drive circuit is quite low. In the present embodiment, a transfer speed of the video data (also including the blanking data) from the display control circuit to the drain line drive circuit is increased by two times without changing a data bus width in the drain line drive circuit (for example, without replacing one-pixel single interface mode with two-pixel parallel interface mode), and without increasing its transfer clock frequency, the video signal and the blanking signal are written into the pixel array in sequence for every frame period by performing the scanning for every one line of the pixel array, and then the video is impulse displayed at the pixel array. In order to accelerate the video data transfer without changing either the data bus width or the transfer clock frequency of the drain line drive circuit, the display device in accordance with the present embodiment employs either a new drain line drive circuit or a new data transfer method.

Figure 25:
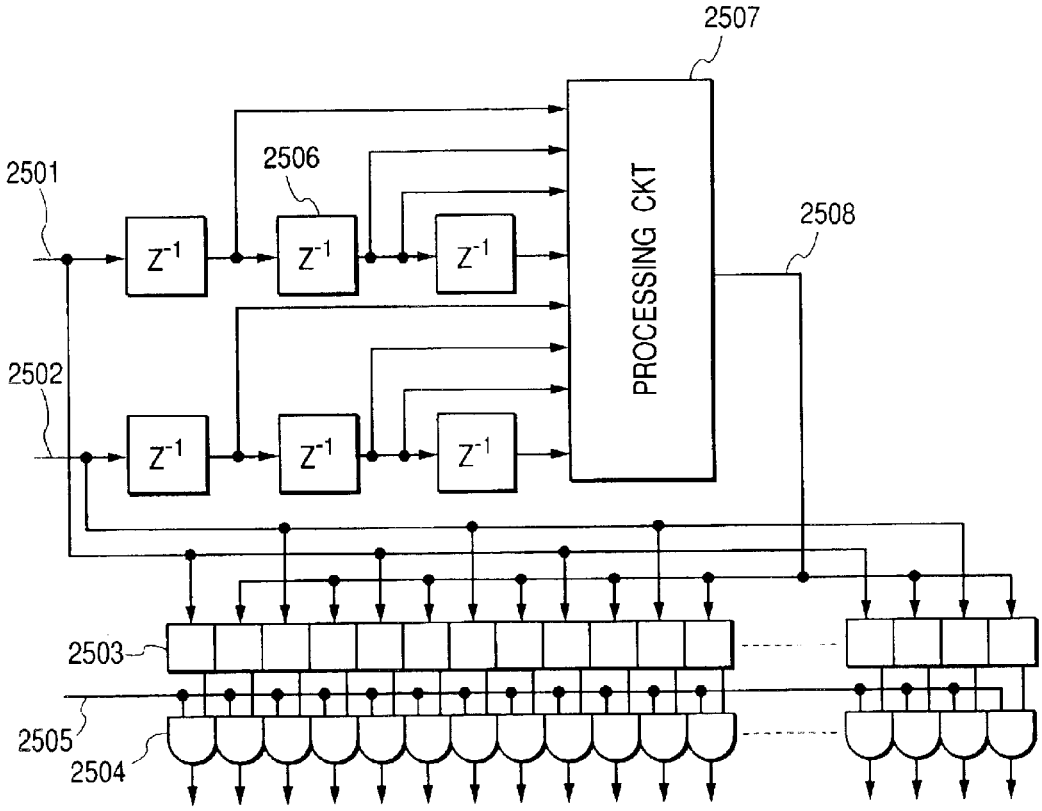
FIG. 25 is a diagram showing one example of a drain driver IC (an integrated circuit element) in Embodiment 5 of the present invention.
Figure 26:
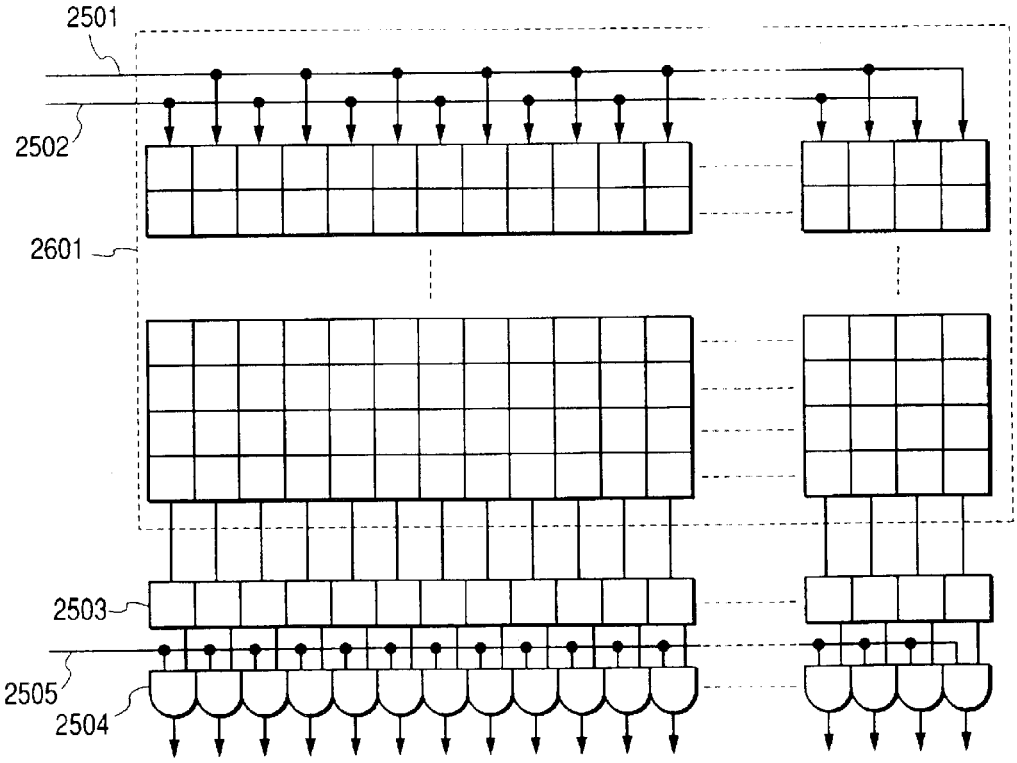
FIG. 26 is a diagram showing another example of a drain driver IC in Embodiment 5 of the present invention.
Figure 27:
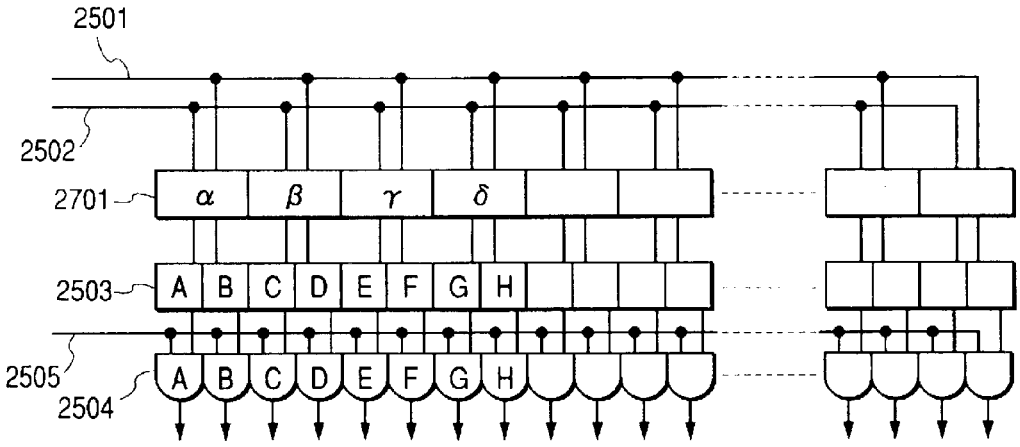
FIG. 27 is a diagram showing another example of a drain driver IC in Embodiment 5 of the present invention.

A configuration of a logic portion included in the drain line drive circuit (a drain driver IC) assembled into the display device in accordance with the present embodiment is shown in FIGS. 25, 26 and 27, respectively.

FIG. 25 shows a drain driver IC for receiving the video data for every frame period under a state in which an amount of transfer of the horizontal pixel data is decreased to a half value, and for causing the video to be displayed at the pixel array through an impulse drive. The video data is transferred to the drain driver IC in this way to speed up the transfer speed by twice while maintaining the transfer bus width of the existing driver interface (in the present embodiment, each of the three primary colors is provided with transfer buses corresponding to two pixels). A half of the video data to be supplied to the pixels (for every pixel column) arranged in a horizontal direction of the pixel array is deleted at a stage where it is inputted to the drain driver IC, so that the data supplementing the deleted data is generated in the drain driver IC.

Figure 5A:
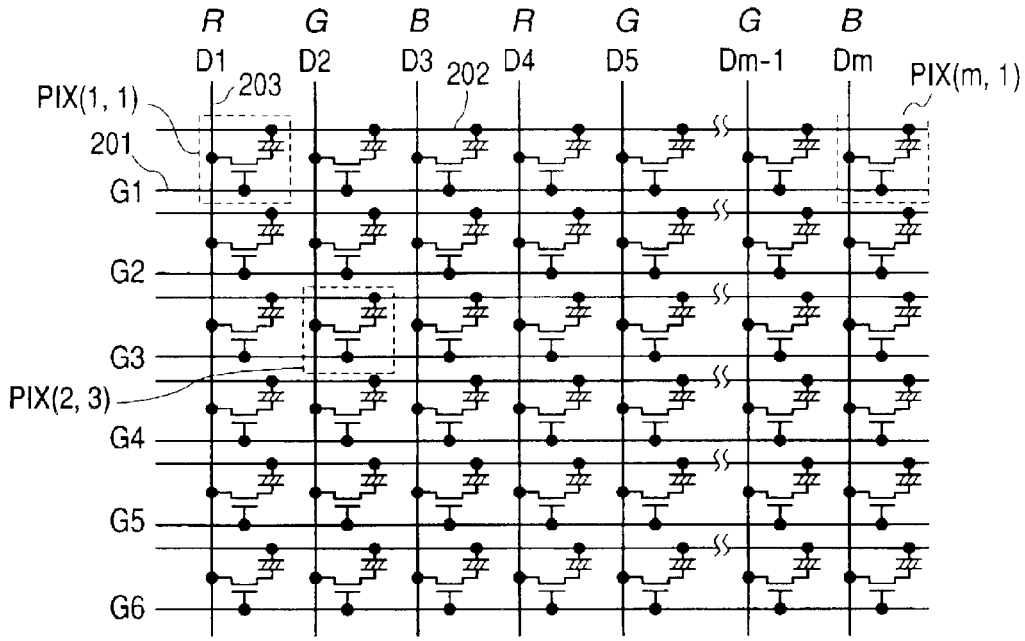
FIG. 5A shows one example of an equivalent circuit of a pixel array of the present invention.
Figure 5B:
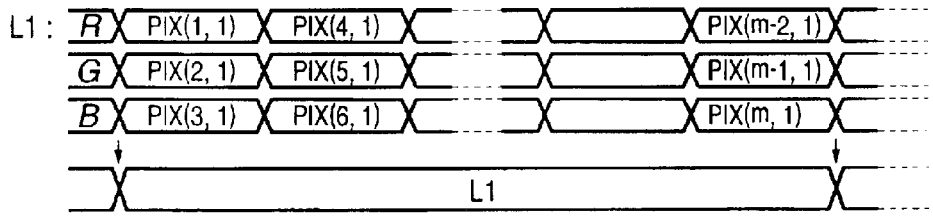
FIGS. 5B and 5C are diagrams each showing an eye diagram of a video data waveform transferred to the pixel array.
Figure 5C:
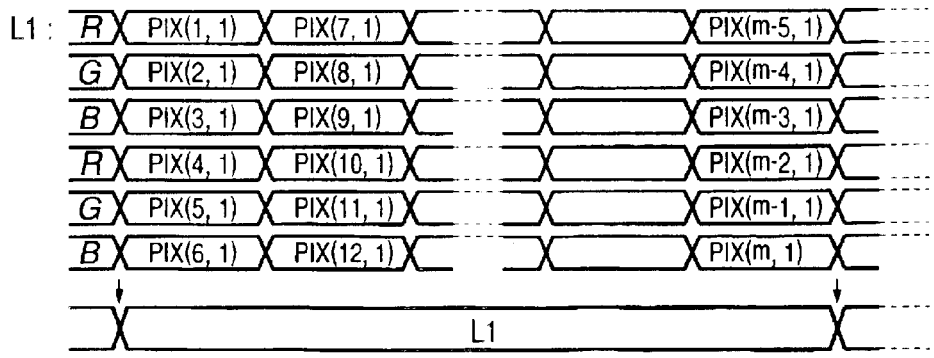

In FIG. 25, the transfer bus having widths corresponding to the aforesaid two pixels alternately divides the data for every pixel arranged in a horizontal direction of the video data into an odd-numbered one and an even-numbered one in response to the position of each of the pixels (discriminated by the addresses of drain lines D1 to Dm corresponding to each of the pixels shown in FIG. 2 and FIG. 5A). Each of the data divided is then transferred to the drain driver IC separately through the data bus 2501 for odd-numbered pixels and the data bus 2502 for even-numbered pixels. The video data inputted to the drain driver IC after having divided into the odd-numbered pixel data and the even-numbered pixel data is inputted to a data latch circuit 2503 (having the same width as that of the aforesaid data bus connected to the drain driver IC) arranged for every drain lines of the pixel array (in other words, for every pixel selected in one horizontal scanning period of the pixel array). The data latch circuit 2503 is provided with a mask logic 2504 at a rear stage thereof and the video data inputted to the data latch circuit 2503 is masked in response to the signal of the mask signal line 2505. In the display device for displaying the color video, the data latch circuit 2503 is needed for every pixel corresponding to three primary colors R, G, B arranged in a horizontal direction of the pixel array. Therefore, the number of the data latch circuit 2503 becomes three times a horizontal resolution of the pixel array. For example, since the number of 1024×3=3072 data latch circuits 2503 are needed for the pixel array of XGA class, 8 drain driver ICs having 384 data latch circuits 2503 arranged therein are installed therearound.

Although not shown in FIG. 25, the drain driver IC outputs a gray scale voltage in response to the video data stored in each of the data latch circuits 2503 and drives each of the drain lines corresponding to each of the data latch circuits 2503. An instruction for outputting a gray scale voltage in response to the video data stored in each of the data latch circuits 2503 is sent from the data latch circuits 2503 to the mask logic 2504. Accordingly, it is possible to replace this instruction with an instruction for outputting a gray scale voltage displaying the pixel in blanking (for example, a gray scale voltage for displaying the pixel in black) by the mask logic 2504. This operation is a masking for the video data.

The gray scale voltage is a signal voltage for determining a brightness of a pixel to which the gray scale voltage is applied (including an electrode to which the gray scale voltage is applied) and this signal voltage is applied in sequence to a plurality of pixels (pixel columns) arranged along the drain line (along the vertical direction of the pixel array) through the drain lines installed at the pixel array. A timing at which the gray scale voltage is applied to each of the pixels constituting the pixel columns is controlled by the aforesaid gate selection pulse, and in the case of a scanning performed through the aforesaid plural-line simultaneous selection, the gray scale voltage is applied to a plurality of pixels arranged continuously from a certain drain line at a pixel columns corresponding to this drain line is applied in response to a certain one gate selection pulse (that is, the plurality of pixels are displayed by approximate same gray scale). In turn, it is frequently found that the gray scales of each of the pixels constituting the pixel column are different from each other. Due to this fact, the gray scale voltage outputted at the drain line for every horizontal scanning period of the pixel array is also assumed as a voltage signal indicating a variation illustrated as the aforesaid drain waveform.

The drain driver IC is also provided with a data latch circuit having a plurality of synchronous delay elements 2506 connected in series with respect to each of the odd-numbered pixel data and the even-numbered pixel data inputted to the drain driver IC; a processing circuit 2507 receiving an output from each of the data latch circuits; and a data bus 2508 for sending a post-processing signal outputted from the processing circuit 2507 to the data latch circuit 2503. Although these circuits complement a half of the video (video data) deleted at a stage where it is transferred to the drain driver IC, its details will be described later.

Figure 28A:
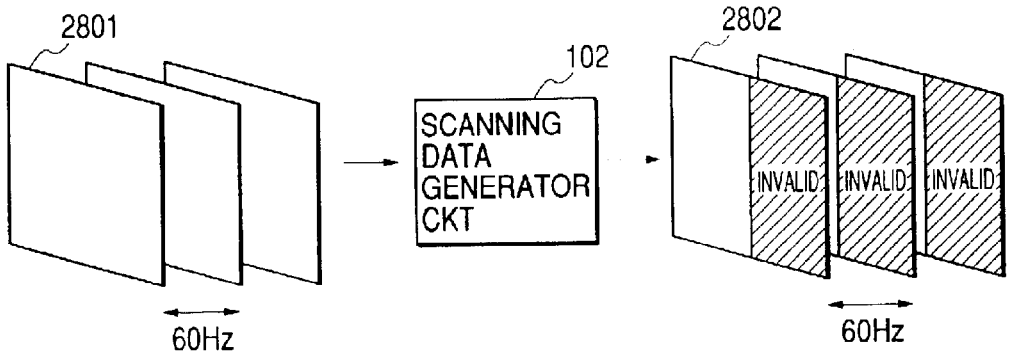
FIGS. 28A and 28B are conceptual diagrams showing a generator process of the video data transferred at a high-speed to the drain line drive circuit in Embodiment 5 of the present invention.
Figure 28B:
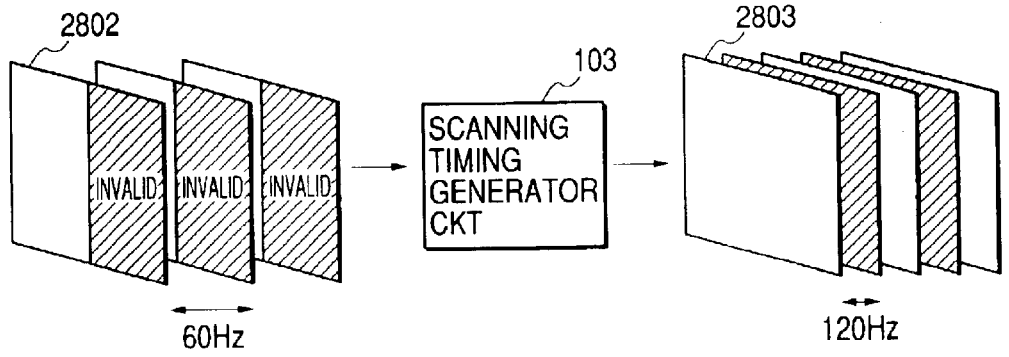

FIGS. 28A and 28B are views for schematically showing a step in which the video data transmitted to the drain driver IC shown in FIG. 25 for every frame period is compressed in its horizontal direction. When the original image 2801 is inputted to the display control circuit (a timing converter or the like) of the display device, for example, a scanning data generator circuit 102 installed at the display control circuit compresses the video information to its left half segment to generate the video data 2802. The left half segment of the video data 2802 is formed such that a plurality of data arranged in a horizontal scanning direction of the original image 2801, for example (in other words, inputted to the pixel rows) are taken out every other one and the taken-out data are stored in sequence from the left end of the video data 2802 for every horizontal scanning period (for every pixel rows) of the original image 2801. The video data 2802 is sent to the scanning timing control circuit 103 installed at the display control circuit, its left half segment is transferred from the scanning timing control circuit 103 to the drain driver IC as the video data and its right half segment is transferred from the scanning timing control circuit 103 to the drain driver IC as blanking data through the data bus for the even-numbered pixels and the data bus for the odd-numbered pixels, respectively.

A plurality of latch circuits (data latch circuits) 2503 arranged at the drain driver IC is classified into the first group connected to the data bus 2501 for the odd-numbered pixels, the second group connected to the data bus 2502 for the even-numbered pixels, and the third group connected to the output bus 2508 of the processing circuit 2507. The respective latch circuits belonging to the first group and the respective latch circuits belonging to the second group are arranged alternately with one of the latch circuits belonging to the third group being held between each of the respective latch circuits belonging to the first group and each of the respective latch circuits belonging to the second group. Each of the latch circuits belonging to these latch circuit groups is selected by an address circuit (not shown) in response to an address given for every latch circuit.

The video data transferred through the data bus 2501 for the odd-numbered pixels is stored in each of the latch circuits by selecting the plurality of latch circuits belonging to the first group in sequence through the aforesaid address circuit. The video data transferred through the data bus 2502 for the even-numbered pixels is stored in each of the latch circuits by selecting the plurality of latch circuits belonging to the first group in sequence through the aforesaid address circuit.

When an output instruction for a gray scale voltage is outputted at this stage from the data latch circuit 2503 as described above, a gray scale voltage to be applied to a half number of a plurality of drain lines arranged in a horizontal direction of the pixel array is determined. Referring to FIG. 25, it will be understood that the gray scale voltage of the drain line corresponding to the odd-numbered one of the pixel columns arranged in a horizontal direction from the left end of the pixel array, for example, is determined. In accordance with such an understanding as above, it means that video data transferred to the drain driver IC has been compressed in a horizontal direction, and thereby information concerning the gray scale voltage of the drain line corresponding to the even-numbered one of the pixel columns arranged in a horizontal direction from a left end of the pixel array has been deleted. Therefore, it becomes necessary to complement the gray scale voltage of the drain line corresponding to the even-numbered pixel column.

This processing is carried out by another circuit connected in parallel with one group of the aforesaid latch circuits 2503 to each of the data bus 2501 for the odd-numbered pixels and the data bus 2502 for the even-numbered pixels and by the plurality of latch circuits belonging to the aforesaid third group receiving an output of this another circuit. The drain driver IC formed in accordance with the present embodiment shown in FIG. 25 is operated such that the video data transferred from the data bus 2501 for the odd-numbered pixels to the drain driver IC is inputted to one group of delay elements 2501 (a plurality of delay elements 2506 connected in series) connected to the data bus 2501 for the odd-numbered pixels, and the video data transferred from the data bus 2502 for the even-numbered pixels to the drain driver IC is inputted to the one group of delay elements 2506 (a plurality of delay elements 2506 connected in series) connected to the data bus 2502 for the even-numbered pixel. The odd-numbered pixel data (one odd-numbered group of data arranged in a horizontal direction from the left end of the video data 2802, for example) transferred through the data bus 2501 for the odd-numbered pixels is delayed by each of the delay elements 2506 arranged in series and held by each of them. The odd-numbered pixel data corresponding to several pixels stored in the delay elements 2506 in this way is transferred to the processing circuit 2507. The even-numbered pixel data transferred through the data bus 2502 for the even-numbered pixels (one even-numbered group of data arranged in a horizontal direction from the left end of the video data 2802, for example) is also delayed by each of the delay elements 2506 arranged in series, and the even-numbered pixel data corresponding to several pixels stored inside it is transferred to the processing circuit 2507.

Outputs of each of the plurality of delay elements 2506 to which odd-numbered pixel data is inputted and the plurality of delay elements 2506 to which even-numbered pixel data is inputted are connected to the processing circuit 2507. The processing circuit 2507 has an amplifier for every output of the delay element 2506, for example, and an adder for adding sequentially the outputs (that is, pixel data) of the delay elements 2506 amplified by this amplifier. In this way, the processing circuit 2507 constitutes an FIR filter (a digital filter also called Finite Impulse Response Filter or Non Recursive Filter) together with each of the one group of delay elements 2506 connected to the data bus 2501 for odd-numbered pixels and the one group of delay elements 2506 connected to the data bus 2502 for even-numbered pixels. The processing circuit 2507 transfers a result of adding the pixel data (inputted to the delay elements 2506) weighted by different factors, respectively, through the output bus 2508 and stores it in the latch circuit 2503 belonging to the aforesaid third group. Accordingly, a gray scale voltage corresponding to an output of the processing circuit 2507 is applied to half number of drain lines not applied with a gray scale voltage even by either latch circuits 2503 belonging to the aforesaid first group or the aforesaid second group. In other words, the half video data deleted in a horizontal direction are complemented by the output of the processing circuit 2507. The pixel columns to which a gray scale voltage based on the video data is not applied are driven by a gray scale voltage based on the data generated by such a filtering process as described above, whereby a moving image having a sufficient image quality is displayed only if the gray scale voltage based on the video data is applied to certain pixel columns only at the display picture.

In addition, "−z" denoted at the delay element 2506 shows that the delay element 2506 subjects a digital data (expressed as a series $f_n$) inputted to this delay element to z-transform and outputs a sum of a power series of $Z^{-n}$ with a general term being $f_n z^{-n}$ (z is a complex variable).

As described above, two times scaling has been applied along a horizontal scanning line (a horizontal direction) of the video data and an amount of transfer for the drain driver IC has been decreased in the present embodiment. However, if N-times scaling (N is an optional natural number larger than 2) is applied to the video data, an amount of transfer for the drain driver IC also becomes 1/N and the vertical scanning can be performed by N times for every frame period. In the case that N times scaling is applied to the video data, a bus for transferring the video data to the drain driver IC is set to have a width corresponding to N pixels. For example, a new pixel data bus is provided for the present embodiment in which a bus wiring having a width corresponding to two pixels is provided by the data bus 2501 for odd-numbered pixels and the data bus 2502 for even-numbered pixels. In turn, in the case that a still image is displayed at the display device, data arranged in the horizontal direction is transferred in full to the drain driver IC for every horizontal scanning period to be written into the pixel rows for every gate line in the pixel array, respectively. Therefore, because it is also applicable to hold the gray scale of each of the pixels over a frame period, it is not necessary to make a scaling of the video data in the horizontal direction as disclosed in the present embodiment. Accordingly, it is to be noted that the video data transfer bus for the drain driver IC in the display device is arranged with a width corresponding to N pixels being set and its wiring width is changed over in response to the still image display, the moving image display, and a scaling magnification of the moving image.

In turn, the blanking data generated at the right half portion of the video data 2802 in FIG. 28B may not be transferred to the drain driver IC through a mask logic 2504 arranged in the drain driver IC. The mask logic 2504 is arranged at an output side for every data latch circuit 2503, the data stored in each of the data latch circuits 2503 is masked with blanking data (black display data, for example) in response to an instruction from a mask signal line 2505. The mask signal line 2505 sends an enabling signal to the mask logic 2504 at a rear half segment of one frame period after the video has been written into the pixel array in response to an instruction from the data latch circuit 2503 at a front half segment of one frame period, for example, and it is masked with an instruction from the data latch circuit 2503. Since the mask logic 2504 is also installed at any of the data latch circuits 2503 belonging to the aforesaid first group, second group, or third group, a gray scale voltage corresponding to the blanking data can be outputted at the drain line corresponding to each of the data latch circuits even if either the video data or its similar data is left at the data latch circuit 2503. Accordingly, even if the blanking data (black displaying data, for example) is not transferred from the scanning timing generator circuit (a display control circuit) to the drain driver IC, the black data can always be written into the pixel array for a blanking period.

As described above, in the present embodiment, a video display is carried out with video data having a reduced amount of data at a front half segment of the frame period and subsequently a blanking display is carried out with blanking data (a masking data) generated by the drain driver IC for every frame period. A video 2803 shown in FIG. 28B is generated at the pixel array with a frequency two times that of the original image 2801 and the video is displayed in an impulse manner. In addition, the video data partially deleted in the drain driver IC in the present embodiment is subjected to scaling and the deleted video data is complemented with data generated from the residual video data. Therefore, a moving image having no blur can be displayed with half video data (a horizontal pixel data) in the pixel array without damaging the video quality along the horizontal line and in a half of one frame period.

FIG. 26 shows an application example of the present embodiment, in which a frame buffer 2601 is arranged at a front stage of the data latch circuit 2503 belonging to the aforesaid first group and the aforesaid second group of the drain driver IC shown in FIG. 25. Since the video data sent from the data bus 2501 for the odd-numbered pixels or the data bus 2502 for the even-numbered pixels is transferred to the frame buffer 2601 at a mask period during which the enabling signal is inputted to the mask logic 2504 through the mask signal line 2505, even in the case that the video data is subjected to scaling outside the drain driver IC and this is transferred to the data latch circuit 2503, the video can be displayed in an impulse manner. When a scaling of video data at the display device is carried out both inside and outside of the drain driver IC, the various kinds of functions of the display device such as a partial scaling of the video data in the drain driver IC or a partial display of the moving image and the like are provided.

FIG. 27 indicates an application example, in which a bus width corresponding to one pixel in the prior art drain driver IC is divided into two segments and a usable mode is added. In the case of a drain driver IC in which each of three primary colors is provided with an 8-bit width as a bus for transferring data of three primary colors (displaying colors) of R, G, B in one pixel unit (having three pixels corresponding to three primary colors), the bus width in this application example is divided into two segments and each of them is assigned for every two-pixel unit. With such an arrangement as above, the data is transferred for every 4 bits in each of the two-pixel unit through a bus of 8-bit width used in data transfer to one pixel unit, resulting in that a transfer speed of the pixel data is accelerated by twice. If each of data of three primary colors (displaying colors) of R, G, B supplied in one pixel unit is transferred in 4-bit, 16 colors in multiplication of 2 by 4, and 4096 colors in multiplication of 2 by 12 in combination of three primary colors can be reproduced for every display color. An amount of data to be transferred is not necessarily assigned uniformly to three primary colors of R, G, B and the data can be converted through a logic pallet. In the present application example, the amount of data to be transferred is uniformly assigned to the three primary colors of R, G, B.

The drain driver IC in accordance with the present application example is characterized in that it is provided with a bus division multiplexer 2701. Under an operation mode for transferring data in one pixel unit with a 8-bit bus width (hereinafter 8-bit bus mode), the bus division multiplexer 2701 transfers data inputted to the data bus 2501 for odd-numbered pixels from the data bus 2501 for odd-numbered pixels to the latch circuit 2503 for the odd-numbered pixels and transfers data inputted to the data bus 2502 for even-numbered pixels from the data bus 2501 for even-numbered pixels to the latch circuit 2503 for the even-numbered pixels, respectively. In FIG. 27, for the sake of description, the bus division multiplexers 2701 arranged in a horizontal direction are provided with addresses α, β, γ, δ in sequence from the left end. In addition, the two latch circuits 2503 connected to the bus division multiplexer α are provided with addresses a, b; the two latch circuits 2503 connected to the bus division multiplexer β are provided with addresses c, d; and the two latch circuits 2503 connected to the bus division multiplexer γ are provided with addresses e, f; and the two latch circuits 2503 connected to the bus division multiplexer δ are provided with addresses g, h. The bus division multiplexer 2701 is provided with a bus switch (not shown) for use in changing-over each of the buses. This bus switch under the aforesaid 8-bit bus mode selects in sequence the bus division multiplexers α, β, γ, δ. In the case of the pixel array shown in FIG. 5A, for example, this bus switch transfers data to be sent to a pair of pixels at addresses PIX(1,y), PIX(2,y) to the latch circuits a, b through the bus division multiplexer α; then, this bus switch transfers data to be sent to a pair of pixels at addresses PIX(3,y), PIX(4,y) to the latch circuits c, d through the bus division multiplexer β; and further, this bus switch transfers data to be sent to a pair of pixels at addresses PIX(5,y), PIX(6,y) to the latch circuits e, f through the bus division multiplexer β (y denotes an address Gy in the gate line in these pixels).

On the contrary, under a mode in which the 8-bit bus width is assigned every 4 bits to each of the two pixel units (hereinafter called a half bus mode), the data bus 2501 for the odd-numbered pixels or the data bus 2502 for the even-numbered pixels are divided into two segments, and the data inputted from any one of the data bus 2501 for the odd-numbered pixels and the data bus 2502 for the even-numbered pixels to it are transferred to a pair of latch circuits 2503 connected in parallel to the rear stage (usually, one of them is used as the latch circuit for the odd-numbered pixels and the other of them is used as the latch circuit for the even-numbered pixels). Under the aforesaid 8-bit bus mode, the bus division multiplexers 2701 are selected one by one in sequence using the bus switch and the pixel data are transferred to the two latch circuits. However, under the half bus mode, the bus dividing multiplexers 2701 are selected in sequence every one pair using the bus switch and the pixel data is transferred to four latch circuits. The data (pixel data) to be sent to each of the pixels illustrated under the aforesaid 8-bit bus mode is transferred to the latch circuit 2503 as follows under the half bus mode. At first, the bus switch selects a pair of bus division multiplexers α, β. This bus switch transfers a pair of odd-numbered pixel data corresponding to addresses PIX(1,y), PIX(3,y) to the latch circuits a, through the bus division multiplexer α and at the same time this bus switch transfers a pair of even-numbered pixel data corresponding to addresses PIX(2,y), PIX(4,y) to the latch circuits c, d through the bus division multiplexer β. Then, the bus switch selects a next pair of bus division multiplexers γ, δ. This bus switch transfers a pair of odd-numbered pixel data corresponding to addresses PIX(5,y), PIX(7,y) to the latch circuits e, f through the bus division multiplexer γ, and concurrently this bus switch transfers a pair of even-numbered pixel data corresponding to addresses PIX(6,y), PIX(8,y) to the latch circuits g, h through the bus division multiplexer δ.

As described above, in the present application example in which the bus width corresponding to one pixel is assigned for a plurality of pixels N (N=2 in the aforesaid example), one multiplexer is assigned for every number of N of the latch circuits connected to either the data bus 2501 for odd-numbered pixels or the data bus 2502 for even-numbered pixels, a transfer amount of the pixel data sent to the latch circuit is set to 1/N and a transfer speed is accelerated by N times through this multiplexer. As described above, any one of the odd-numbered pixel data corresponding to N pixels or the even-numbered pixel data is connected through one multiplexer 2710 to the number of N of latch circuits 2503 connected to the multiplexer 2701. That is, as described above, the latch circuit b for storing even-numbered pixel data corresponding to the address PIX(2,y) under the 8-bit bus mode stores the odd-numbered pixel data corresponding to the address PIX(3,y) under the half bus mode, while the latch circuit c for storing odd-numbered pixel data corresponding to the address PIX(3,y) under the 8-bit bus mode stores the even-numbered pixel data corresponding to the address PIX(2,y) under the half bus mode, so that a gray scale voltage corresponding to another drain line is outputted at the drain line corresponding to a certain latch circuit. Due to this fact, in the present application example, there is provided an address selection circuit (not shown) for replacing the address of the latch circuit in response to a driving operation of the bus switch. In accordance with the aforesaid example, when the bus switch controls the multiplexer under the half bus mode, the address selection circuit produces an instruction recognizing the latch circuit b as the latch circuit c in synchronous with an instruction outputted by the bus switch so that the gray scale voltage corresponding to the data stored in the latch circuit b is outputted at the drain line corresponding to the latch circuit c. The address selection circuit also produces an instruction recognizing the latch circuit c as the latch circuit b so that the gray scale voltage corresponding to the data stored in the latch circuit c is outputted at the drain line corresponding to the latch circuit b.

In the present application example, the data bus for the even-numbered pixels is divided into 2 segments for the transfer of data corresponding to two pixels, each of the divided buses is connected to a pair of latch circuits adjacent to each other, the data bus for the odd-numbered pixels is divided into 2 segments for the transfer of data corresponding to two pixels, each of the divided buses is connected to a next pair of latch circuits adjacent to each other adjoining the former pair of latch circuits, whereby the odd-numbered pixel data corresponding to the two pixels and the even-numbered pixel data corresponding to the two pixels are stored concurrently in these four latch circuits during a time in which each of the odd-numbered pixel data and the even-numbered pixel data is stored in sequence in a pair of latch circuits and a pair of aforesaid next latch circuits for every one pixel. With such an operation as above, since the pixel data is transferred to the drain driver IC at a speed two times a transfer rate in the so-called hold display of the still image normally found, it is possible to write the video into the pixel array in a period of ½ of the frame period of the original image. Accordingly, remaining period of ½ in the frame period is assigned for a blanking period and the video data transferred in the previous ½ period is masked by the mask logic 2504, whereby the blanking data (black display data, for example) is written into the pixel array to enable the video to be displayed in a conventional driver data transfer rate.

Figure 29:
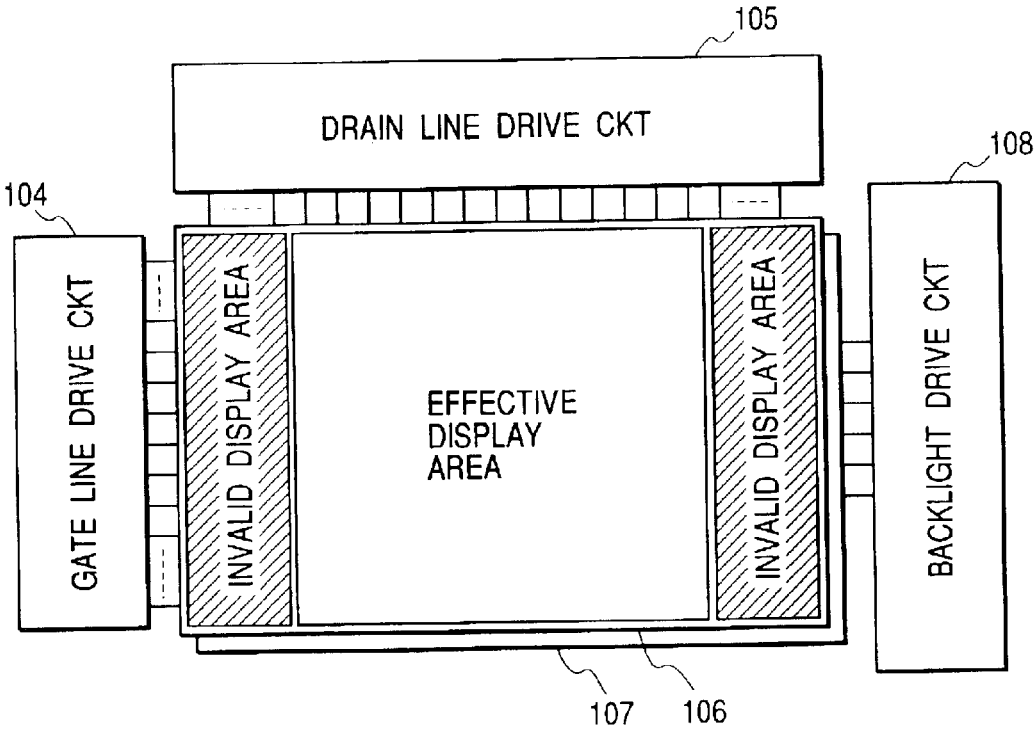
FIG. 29 is a diagram showing one example of the display device used in Embodiment 5 of the present invention.

FIG. 29 schematically shows a display device having a function for setting blanking areas at the right and left sides of the pixel array as one example of a display device, as shown in FIG. 14B, suitable for displaying a video having a different aspect ratio (an aspect ratio in the horizontal direction being smaller than that of the pixel array) in a wide pixel array (a pixel array with a large aspect ratio in a horizontal direction, 16:9, for example). The wide display array 106 is provided with the gate line drive circuit 104 and the drain line drive circuit 105, and a backlight 107 controlled by the backlight drive circuit 108 is oppositely arranged at the rear surface of the wide display array 106. Each of the pixels in the invalid display areas set at the right and left sides of the display array 106 is displayed uniformly under application of the same blanking signal (the black color displaying data, for example). If the drain driver IC in accordance with the present embodiment or its application example described above in reference to any of FIGS. 25 to 27, for example, is used for the drain line drive circuit 105 when such invalid display areas are driven in such a way as described above, each of the pixels in the invalid display areas can be uniformly masked with a blanking signal (a gray scale voltage displaying the pixel in black, for example) generated in response to the instruction from the mask logic 2504. Accordingly, it does not become necessary to transfer the blanking data for generating blanking areas (invalid displaying areas) at the right and left sides of the pixel array to the drain line drive circuit 105, so that the band assigned for the transferring operation can be assigned for the impulse driving for the pixel array. In such a display device as described above, since timings in masking for the pixels through the mask logic 2504 are different in the effective display area and the invalid display area, the mask signal line 2505 for controlling it may be connected to the mask logic 2504 of the drain driver IC shown in any of FIGS. 25 to 27 for each of the display areas of the pixel array. In other words, the single mask signal line 2505 arranged in the drain driver IC shown in any of FIGS. 25 to 27 is formed of a plurality of mask signal lines.

In an example in which the video of XGA class having a smaller aspect ratio in a horizontal direction than that of the pixel array is displayed by the display device provided with the pixel array 106 of WXGA class having the aforesaid functions as shown in FIG. 14B, data to be transferred to the drain driver IC 105 of the display device per one horizontal scanning period (a period for which a voltage is supplied to 1280 pixels for every pixel rows) in the video displaying operation of the wide display array 106 corresponds to 1024 pixels (a horizontal resolution of XGA class). Therefore, data corresponding to 256 pixels as the difference is not needed for its transfer. Accordingly, adding the mask signal line 2505 for the invalid display areas to the drain driver IC shown in any of FIGS. 25 to 27 causes a surplus number to be generated in the number of pulses of dot clock for the data transfer in one horizontal scanning period. If the band for transferring the blanking data is assured by the surplus pulse, the video can be efficiently displayed in an impulse manner in the effective display area shown in FIG. 29. It is to be noted that an instruction concerning a setting of displaying areas in the pixel array 106 and a selection of a driving method according to the display areas is inputted to the header area (refer to FIG. 16) of the video data as control information at the scanning data generator circuit 102 as already been described in the embodiment 1.

In the present embodiment, some parameters shown in FIG. 46 are added to the video data, as one example of control information for the drain driver IC shown in any of FIGS. 25 to 27.

"FULL" in the driver transfer bus mode is a data transfer format as illustrated in the aforesaid 8-bit bus mode under which its bus width is used for transferring data corresponding to one pixel.

If the gate driver IC described in reference to the embodiment 4 is mounted on the gate line drive circuit 104 of the display device shown in FIG. 29, it is possible to perform a scanning operation for four pictures in one frame period. In the case of such a display device constructed as above, a high quality moving image can be displayed through a filtering process or the like where an optical response of the liquid crystal is made fast and various kinds of other displaying functions can also be realized. It is needless to say that a mere combination of at least one function described in the embodiment 1 and the embodiment 2 with the display device in accordance with the present embodiment causes the display device to exhibit a synergy effect along with the displaying function in accordance with the present embodiment.

Further, in the case where an active element arranged for every pixel in the pixel array is formed by a field effect transistor (represented by a thin film transistor TFT) or a diode and the like in which a semiconductor layer of polycrystalline silicon (p-Si) or pseudo-single-crystal silicon is used for a channel (an area where a carrier motion between a drain line and a pixel electrode is controlled in response to the aforesaid line selection), the drain line drive circuit in accordance with the present embodiment can be formed in a substrate (an insulating substrate such as a glass substrate or a plastic substrate and the like or a semi-insulating substrate such as silicon and the like) where the pixel array is formed. This fact is not restricted to the present embodiment, and the gate line drive circuit described in accordance with the embodiment 4 can also be formed in the substrate similarly where the pixel array is formed. A substrate (hereinafter called a pixel array substrate) in which an active element having a channel formed by any one of polycrystalline semiconductor layer or single-crystal semiconductor layer or a semiconductor layer having their intermediate crystalline structure (called a pseudo single-crystal) is arranged together with the pixel array can be widely utilized in a display device in which not only a liquid crystal but also electroluminescent material or compound semiconductor material having a hetero-junction is applied as media for displaying. In the case of both a liquid crystal display device and a display device provided with light-emitting diode made of an organic material or a non-organic material, it becomes possible to restrict a circumferential edge size (called a perimeter) of the pixel array and to display the moving image with a high definition and various functions by employing the pixel array substrate as above and forming the driving circuit on the pixel array substrate (composed of glass, plastics, semiconductor or the like). When all the functions or structures described not only in the present embodiment but also in the aforesaid embodiments 1, 3 and 4 are applied in the display device for pseudo-hold displaying of an image by the pixels formed by the light emitting diodes (element emitting light through carrier injection into an electroluminescent material or a compound semiconductor material or the like), luminance of the pixel element during displaying in black also becomes quite low because the pixel element itself has a function of the light source (due to no requirement of backlight). Accordingly, if the present invention is applied to the display device in which the pixel elements are constituted by the light-emitting diodes, it becomes possible to attain a blanking effect and a clear (having a high contrast ratio) moving image display through this blanking effect.

<Embodiment 6>

In the aforesaid embodiment, there has been described the video display in which the pixel rows of N lines (N is a natural number not less than 2) are selected simultaneously, scanning for applying a voltage signal to these pixel rows is carried out while skip-scanning every adjacent groups of N lines. In the present embodiment, in N line groups selected simultaneously (hereinafter called the first line group), a voltage signal applied to N line group to be selected subsequently (hereinafter called the second line group) is partially taken into certain lines of the second N line groups, and the so-called gray scale gradation displayed between the line groups is generated. This operation is carried out such that at least one-line gate selection time of the first line groups on the side of the second line groups is delayed relative to that of another line (set in such a way that a voltage signal corresponding to the first line groups is prevalently applied) or this gate line selection period is extended compared with that of another line.

Figure 30:
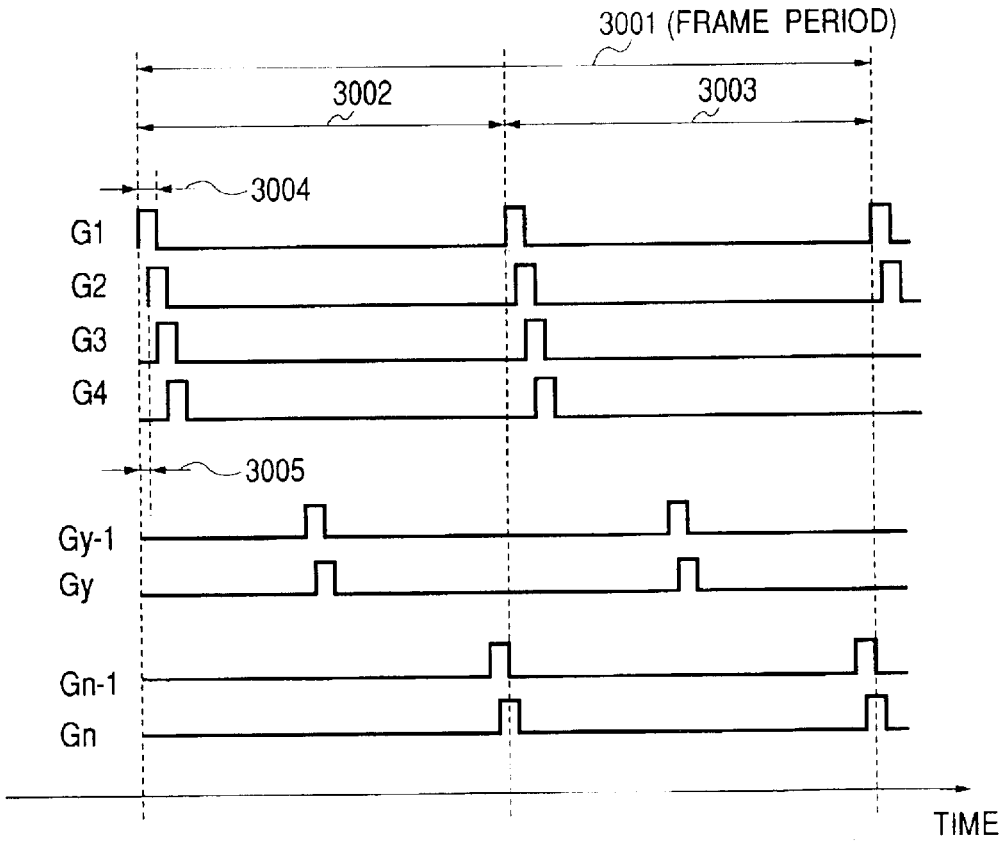
FIG. 30 is a timing chart of a gate selection pulse of the display device in Embodiment 6 of the present invention.

FIG. 30 shows gate selection pulse timing in an example in which the video data is written in the front half of one frame period 3001 and a blanking data (e.g., a black display data) is written in the rear half by repeating scanning to shift 2-line gate selection timings from each other with skip-scanning every two lines in which the voltage signal is written.

The half of one frame period 3001 is assigned to the video write-in period 3002 and the remaining half of one frame period 3001 is assigned to the blanking period 3003, and a voltage signal is applied to the pixel row corresponding to each of the lines at one line selection period 3004. However, when selection periods 3004 of a pair of lines G1, G2 selected simultaneously are compared to each other, a selection period of the line G2 on the side of a pair of lines G3, G4 selected next is delayed relative to that of line G1 by a time 3005. This time 3005 is also called a gate selection timing delay at the aforesaid 2-line simultaneous write-in. The present invention is characterized in that the gate selection timing delay is set for each 2-line simultaneous write-in scanning. This gate selection timing delay 3005 is also set for each of the other pairs of lines G3, G4; Gi−1, Gi; and Gn−1, Gn each of which is selected simultaneously.

Figure 31:
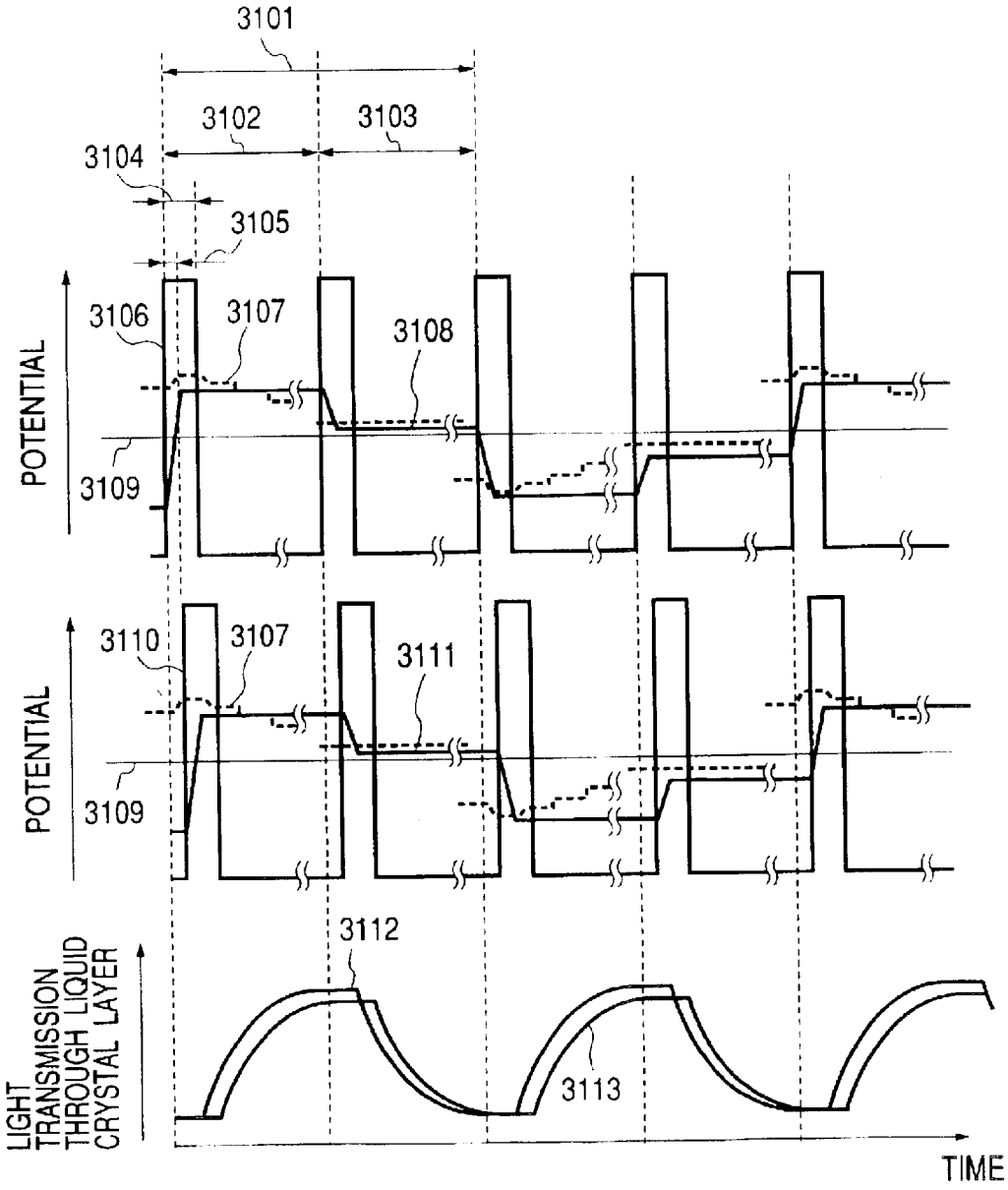
FIG. 31 shows drive waveforms and optical response waveforms of each of the pixels associated with a pair of adjacent lines (gate lines) in Embodiment 6 of the present invention.

FIG. 31 shows a drive waveform particularly specifying a pixel corresponding to each of the line Gy−1 and line Gy (in regard to FIG. 30, y is a natural number indicating a relation of $2 \leqq y \leqq n$) where 2-line simultaneous write-in operation is carried out and it is assumed that both pixels receive a voltage signal from the same drain line. Accordingly, a drain waveform 3107 indicated by a dotted line at each of a drive waveform of the line Gy−1 (upper side in FIG. 31) and a drive waveform of the line Gy (middle side in FIG. 31) show a similar variation (a voltage waveform) relative to a common waveform (a common potential) 3109 in a frame period 3101, a video write-in period 3102 set at the front half of the frame period 3101 and the blanking period 3103 set at the rear half. In contrast to this, the gate waveform 3106 applied to the line Gy−1 and the gate waveform 3110 applied to the line Gy have respective line selection periods 3104 having the same pulse width, and a rising time and a lowering time at the gate waveform 3110 are delayed from those at the gate waveform 3106 only by a period of the gate selection pulse delay 3105, respectively.

On the other hand, the drain waveform 3107 indicates a potential variation according to the video data to be supplied to the pixel rows corresponding to the selected two lines for each two lines. It is apparent that if the video data to be supplied to the pixel rows corresponding to a pair of lines selected through a certain scanning and the video data to be supplied to the pixel rows corresponding to the other pair of lines selected by the subsequent scanning are equal to each other, this potential variation is scarcely produced. In FIG. 31, the drain waveform 3107 is drawn on the assumption that the video data to be supplied to a pair of line Gy−1 and line Gy and the video data to be supplied to the other pair of lines (line Gy−3, line Gy−2, line Gy+1 and line Gy+2) are different from each other.

A potential of the drain waveform 3107 becomes a value corresponding to the video data to be supplied to the pair of line Gy−1 and line Gy at the time of being slightly delayed from a starting time of the line selection period 3104 of the gate waveform 3106 to be applied to the line Gy−1. In addition, also at the finishing time of the line selection period 3104 of the gate waveform 3106 (a time at which the gate voltage is lowered to a "Low" state), the potential of the drain waveform 3107 keeps the value corresponding to the video data. Accordingly, although a potential of the pixel electrode corresponding to the line Gy−1 in the line selection period 3104 of the gate waveform 3106 finally increases up to a potential or its near value of the drain line corresponding to the video data to be supplied to the pair of lines Gy−1, Gy even though its rising is slightly delayed in regard to that found at the starting time of the line selection period 3104 as shown in the source waveform 3108.

On the other hand, the potential of the drain waveform 3107 is already set at a value corresponding to a video data to be supplied to the pair of lines Gy−1, Gy at the starting time of the line selection period 3104 of the gate waveform 3110 applied to the line Gy. However, the potential of the drain waveform 3107 has already changed to a value corresponding to the video data to be supplied to a pair of line Gy+1 and line Gy+2 before the finishing time of the line selection period 3104 of the gate waveform 3110 applied to the line Gy. In the case of an example shown in FIG. 31, the potential of the drain waveform 3107 decreases. Accordingly, the potential of the pixel electrode corresponding to the line Gy in the line selection period 3104 of the gate waveform 3110 is also influenced by a voltage corresponding to the video data to be supplied to the subsequent pair of lines Gy+1, Gy+2 outputted to the drain line before the end of the line selection period 3104 as shown by the source waveform 3111. That is, in the case of an example shown in FIG. 31, since a potential corresponding to the video data in lines Gy+1, Gy+2 is lower than a potential of the drain waveform 3107 corresponding to the video data in lines Gy−1, Gy, the potential of the pixel electrode (source waveform 3111) in the line Gy at the time of the end of the line selection period 3104 of the gate waveform 3110 is not so increased as the potential (source waveform 3108) of the pixel electrode in the line Gy−1 at the time of the end of the line selection period 3104 of the gate waveform 3106. It is apparent that when a potential corresponding to the video data in the lines Gy+1, Gy+2 is higher than that of the drain waveform 3107 corresponding to the video data in the lines Gy−1, Gy, the potential of the pixel electrode in the line Gy at the time of the end of the line selection period 3104 of the wave waveform 3110 also becomes higher than the potential of the pixel electrode of the line Gy−1 at the time of the end of the line selection period 3104 of the gate waveform 3106.

More specifically, in the waveform shown in FIG. 31, although the gate waveform 3106 applied to the line Gy−1 and the gate waveform 3110 applied to the line Gy each have a line selection period 3104 with the same pulse width, each of a rising time and a lowering time of the gate waveform 3110 is delayed from that of the gate waveform 3106 only by a period of the gate selection pulse delay 3105, so that the drain waveform 3107 shows a different level at the line selection period 3104 of the gate waveform 3110 applied to the line Gy. A variation in level of this drain waveform 3107 (a variation in voltage outputted to the drain line) causes a potential of the pixel corresponding to the line Gy (in other words, applying of voltage to the pixel electrode is controlled by the gate waveform 3110) to be set to an intermediate value between a potential of the pixel corresponding to the line Gy−1 and a potential of the pixel corresponding to the line Gy+1. Accordingly, as shown in the lower part of FIG. 31, an optical response waveform 3112 of the pixel corresponding to the line GY−1 and an optical response waveform 3113 of the pixel corresponding to the line Gy each show a luminance corresponding to a difference between the associated pixel electrodes while their rising timings are shifted from each other. Considering an optical response waveform of the pixel corresponding to the line Gy+1 with respect to these optical response waveforms, it is apparent that this is raised after the optical response waveform 3113 in the line Gy and settles at a lower luminance than that of the optical response waveform 3113 in the line Gy. With all these phenomenon considered, it is apparent that a luminance of not only one pixel corresponding to the line Gy but also a luminance of the pixel row corresponding to the line Gy including this one pixel show the so-called intermediate gray scale between a luminance of the pixel row corresponding to the line Gy−1 and a luminance of the pixel row corresponding to the line Gy+1. Accordingly, as compared with the case where the pixel rows for each two lines are selected simultaneously and each of the pixel rows is displayed in the same luminance, a stripe of 2-line space is deleted from the display screen. Consequently, in accordance with the present embodiment, a more natural and soft video image can be displayed without deteriorating some advantages of the moving image display in the aforesaid embodiments.

Further, in the present embodiment, the display device provided with a pixel array operated in a normally black mode is driven by the so-called frame inversion system in which a write-in polarity of a voltage signal to the pixel (a polarity of the drain line potential relative to the common potential) is kept in the frame period and inversed for each frame period.

By shifting a gate selection pulse in at least one line of a plurality of lines (the aforesaid first line group) to be selected simultaneously along a time axis from a gate selection pulse in another line as described in the present embodiment, both data (the first line data) inputted to another line in the first line group and data (the second line data) inputted to the aforesaid second line group selected subsequent to the first line group are written in at least the one line. Consequently, since a gray scale not found in both line data is generated in an analogue mode in at least one line described above, a display device user is scarcely aware of a reduction in vertical resolution of a display screen.

<Embodiment 7>

In the embodiment 6, there has been described a pixel array drive system in which the pixel rows (or pixel row group) indicating an intermediate gray scale relative to a gray scale of each of the pixel row groups are generated between a pair of adjacent pixel rows of the pixel row groups in a plurality of lines selected in sequence. However, a technical concept similar to this drive system can be embodied by another pixel array drive system. In the present embodiment, there will be described another pixel array drive system.

Figure 32A:
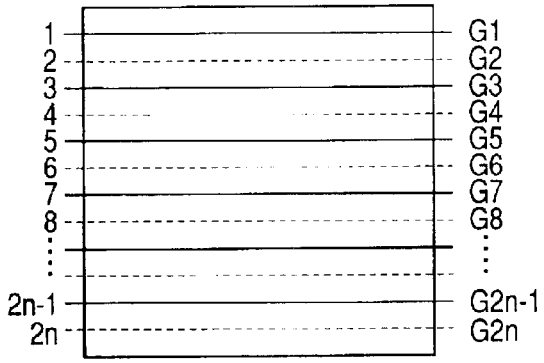
FIGS. 32A, 32B and 32C are each a conceptual diagram showing a line scanning of a pixel array in Embodiment 7 of the present invention.

In the present embodiment, an original image inputted, as a progressive image having a frequency of 60 Hz, to video equipment having a system shown in FIG. 3 is shown, the original image is divided into video data of sub-fields with 60 Hz by a display control circuit 114 installed in the video equipment, one of the divided video data is displayed at the pixel array by the aforesaid 2-line simultaneous write-in in a sub-field period (16.7 ms for 60 Hz). When the original image processed by the progressive mode is displayed while one pixel row (corresponding to one gate line) in the pixel array is assigned per one line in a horizontal direction, horizontal data 1, 2, 3, 4, . . . , 2n−1, 2n of the original image are inputted to the pixel rows corresponding to each line in the pixel array in accordance with addresses G1, G2, G3, G4, . . . G2n−1, G2n of lines in the pixel array (also called gate lines or scanning signal lines) as shown in FIG. 32A. However, in the present embodiment, the data is converted into video data similar to the video image obtained in the interlace mode by the scanning data generator circuit 102, for example, at a stage in which the original image is inputted to the display control circuit 114. That is, either the even-numbered groups (2, 4, . . . , 2n) or the odd-numbered groups (1, 3, . . . , 2n−1) are removed from the horizontal data of the original image, and the remaining video data are transferred together with the blanking data from the display control circuit 114 to the drain line drive circuit 105 (of course, transfer of blanking data may be eliminated by the drain line drive circuit in accordance with the embodiment 5).

These video data are created such that the horizontal data having only odd-numbered video data of the original image and the horizontal data having even-numbered video data of the original image for each sub-field period of 16.7 ms are generated alternatively. Since the original image is inputted to the display device for each frame period of 16.7 ms, the even-numbered horizontal data of the original image inputted for each frame period is wasted when the former video data is generated, and the odd-numbered horizontal data of the original image inputted for each frame period is wasted when the latter video data is generated. Therefore, it is no exaggeration to say that the original image inputted to the display device by the progressive mode is converted into the video in an interlace mode within the display device (e.g., the display control circuit arranged in the display device). Accordingly, although the odd-numbered horizontal data of the original image and the even-numbered horizontal data of the original image in the present embodiment are synthesized at the pixel array for each 2 frame periods (i.e. 33 ms) of the original image, its image quality is not deteriorated as long as the moving image is displayed.

In the present embodiment, only the odd-numbered horizontal data of the original image are written in sequence for each two lines in the pixel array in a sub-field period (hereinafter called the first field period) and only the even-numbered horizontal data of the original image are written in sequence for each two lines in the pixel array in the next sub-field period (hereinafter called the second field period) subsequent to the first field period. However, another feature of the present embodiment consists in the fact that a combination of two lines of the pixel array selected for each horizontal data of the original image is changed depending on the first field period and the second field period. For example, the odd-numbered horizontal data 1, 3, 5, 7, . . . , 2n−1 of the original image are inputted in sequence into each of a pair of lines in the pixel array: G1 and G2; G3 and G4; G5 and G6; G7 and G8; . . . Gn−1 and G2n by 2-line simultaneous write-in scanning in the first field period (refer to FIG. 32B), while the even-numbered horizontal data 2, 4, 6, 8, . . . , 2n−2 of the original image are inputted in sequence into each of line combinations in the pixel array: G1, G2 and G3; G4 and G5; G6 and G7; G8 and G9; . . . ; G2n−2 and G2n−1 by simultaneous write-in scanning in the second field period and the last even-numbered horizontal data: 2n is inputted into only a line: G2n of the pixel array (refer to FIG. 32C). That is, each of the data other than the second and (2n)th data in the even-numbered horizontal data is inputted for each two lines selected in such a manner as to be shifted by one line in a vertical direction of the pixel array with respect to the two lines of the pixel array to which each of the odd-numbered horizontal data is inputted.

In the present embodiment, an operation for selecting simultaneously the gate lines in the pixel array for each two lines at the front half of each of the first field period and the second field period and writing the video data into the pixel rows corresponding to the two lines is repeated as described above, and then the scanning for one picture with the video data corresponding to each of the field periods is completed. In the case where the original image is a progressive image with a frequency of 60 Hz, each of the field periods has the same length as that of one frame period of the original image as described above, so that scanning for one picture with the video data is finished with about 8.4 ms, which is half of one frame period: 16.7 ms of the original image. Subsequent to the scanning for one picture with the video data, an operation for selecting simultaneously the gate lines of the pixel array for each two lines by the same procedure as that for the scanning of video data for one picture in each of the field periods, at the rear half of each of the first field period and the second field period, and writing the blanking data to the pixel rows corresponding to the two lines is repeated, and then the video signal inputted to each of the pixels in the pixel array in the front half of each of the field periods is replaced with a blanking signal (e.g., a voltage signal displaying the pixel in black).

In the present embodiment, a combination of gate lines for each two lines selected for inputting of blanking data in the second field period has been set in the same manner as that selected through inputting of the even-numbered horizontal data of the original image in the aforesaid second field period (except certain data) while a combination of gate lines for each two lines selected for inputting either the video data or the blanking data in the first field period is shifted by one line in the vertical direction of the pixel array. As regards inputting of the blanking data, although there is no trouble in a displaying operation even if a combination of the gate lines for each two lines selected in the second field period is set in the same manner as that for the first field period, changing the inputting mode for the blanking data is advantageous for controlling the display device in accordance with the case where the video data inputting mode (scanning mode) for one picture is changed for each field period. Scanning for one picture with the blanking data at the rear half of each of the first field period and the second field period is completed in half of one frame period of the original image: 16.7 ms, i.e. about 8.4 ms in the same manner as that of the scanning for one picture with the video data irrespective of setting for the combination of gate lines for each two lines in the second field period.

As described above, the present embodiment performs the following two operations alternately: one operation is performed such that a scanning for performing a simultaneous wiring-in of odd-numbered horizontal data of the original image (hereinafter called odd-numbered lines) in sequence for each two lines in the pixel array is carried out for one picture, then a scanning for writing-in the blanking data (e.g., black data) into the pixel array is carried out for one picture to display the first sub-field video with 60 Hz in the aforesaid first field period; and the other operation is performed such that a scanning for performing a simultaneous writing-in of even-numbered horizontal data of the original image (hereinafter called even-numbered lines) in sequence for each two lines in the pixel array is carried out for one picture, then a scanning for writing-in the blanking data into the pixel array is carried out for one picture to display the second sub-field video with 60 Hz in the aforesaid second field period. With such operations, each of the first sub-field video and the second sub-field video is displayed in an impulse manner.

These two sub-field videos are displayed in such a manner as to be superimposed on the picture in the display device in the two frame periods of the original image. In other words, the present embodiment reproduces in a pseudo manner the interlace scanning performed by a Braun tube or the like by displaying the two sub-field videos held and displayed by a liquid crystal display device or an electroluminescent display device or the like on a video screen at a specific period (two frame periods for the original image) in an impulse-display manner. In the present embodiment in which each of the sub-field video images is generated with 60 Hz, this impulse-like interlace video image is displayed with a frequency of 30 Hz (33 ms in the field period).

There will be described an effect of another feature of the present embodiment for changing the combinations of two lines in the pixel array selected in sequence for each sub-field period, in one frame period in such a pseudo interlace scanning.

In the case where the combinations of selected pixel array for each two lines are not changed in each of the two sub-field periods, the two lines display a Yth odd-numbered line of the pixel array in the first field period. That is, the two lines display one of the line data of the original image. In addition, the two lines display the (Y+1)th even-numbered line of the original image in the second field period. That is, the two lines display another line data of the original image. Accordingly, a mere combination of the first field period with the second field period causes two line data of the original image to be displayed at four lines, and a gray scale displayed by the two lines through these periods is only one combination of the Yth odd-numbered data and the (Y+1)th even-numbered data. Consequently, the vertical resolution of video image reproduced at the pixel array is as small as $2/4=1/2$ of the number of lines constituting the pixel array.

In the case where the combinations of two selected lines in the pixel array are changed in each of the two sub-field periods, the two lines display the Yth odd-numbered line of the original image in the first field period. That is, the two lines display one of the line data of the original image. However, in the second field period, one of these two lines displays (Y−1)th even-numbered line of the original image, and the other of these two lines displays (Y+1)th even-numbered line of the original image. That is, the two lines display other two line data of the original image. Accordingly, if the first field period and the second field period are merely combined to each other, three line data of the original image are displayed at four lines. Consequently, the gray scales displayed by the two lines through these periods become two combinations: Yth odd-numbered data and (Y−1)th even-numbered data; and Yth odd-numbered data and (Y+1)th even-numbered data. Therefore, the vertical resolution of the video image reproduced at the pixel array is also increased up to $3/4$ of the number of lines constituting the pixel array. The gray scale of the pixel array displayed in the vertical direction is made variable for each pixel row through the two sub-fields in this way, with the result that it is possible to display a soft moving image (a moving image having image quality similar to a photograph) with a gray scale between the lines being smoothly varied as compared with the method for scanning the pixel array while the data write-in operation through the 2-line simultaneous selection described in reference to embodiments 1 to 5 is carried out while a skip-scanning is performed for each two lines.

Figure 32B:
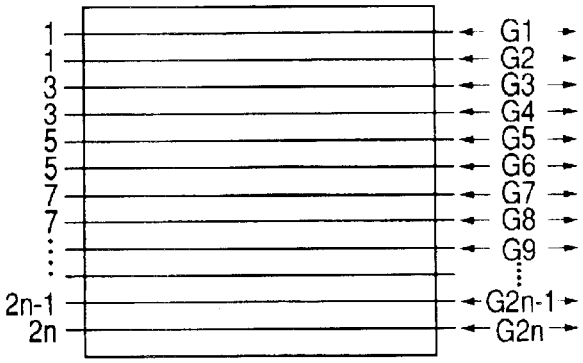
Figure 32C:
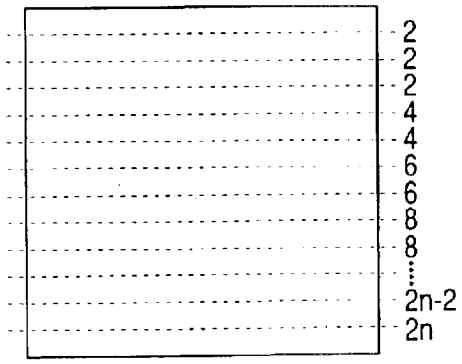

The original image inputted to the display device in the progressive mode is classified into video formats such as 480*p*, 720*p*, 1080*p* and the like in accordance with the vertical resolution (effective number of scanning) as shown in FIG. 39. In accordance with the present embodiment, the video image shown in FIG. 32A is generated on a display screen for each one frame period in the case where the original image in the progressive mode is a still image. In addition, in the case where the original image in the progressive mode is a moving image, the horizontal data are removed alternately for each one line from each of the original images in two frame periods continuously inputted to the display device, the video image for one frame in only odd-numbered line as shown in FIG. 32B and the video image only in the even-numbered line as shown in FIG. 32C are generated alternately on the display screen, and each of the video images is subjected to the blanking processing. The display device makes a determination by the method described in the embodiment 3, for example, as to which the original image of the progressive mode inputted thereto is displayed as the still image or the moving image. The original image inputted to the display device is stored once in the memory (the circuit also called a frame memory indicated in FIG. 3 as M1 or M2) through the display control circuit 114 (refer to FIG. 3) arranged in the display device. Consequently, when one of the two original images under the progressive mode in the frame periods adjacent to each other (already stored in the memory) is read out of the memory and the other original image is stored in the memory, a feature of the original image in the progressive mode inputted to the display device can be recognized in the display device by comparing the pixel data in both video images. Both the video images, i.e. the pixel data each of which is inputted to the display device in the two adjacent sub-field periods are compared to each other by the display control circuit, for example, or a comparator arranged around the display control circuit.

On the other hand, the present embodiment can also be applied to display of the original image having some video formats such as 480*i*, 1080*i* and the like inputted to the display device in the interlace mode. The original image in the interlace mode includes video images of only odd-numbered lines and video images of only even-numbered lines generated while the horizontal data are alternatively removed for each one line. In the case of the original image with a video format of 1080*i*, the odd-number line video images with a vertical resolution of 540 and video images of only even-numbered lines with a vertical resolution of 540 are inputted to the display device to generate video images having a vertical resolution of 1080 on its display screen. Accordingly, in the case where the original image in an interlace mode is a still image, the video image shown in FIG. 32A is generated on a display screen by an interlace-progressive conversion in which the horizontal data are supplemented to each other from two kinds of video images inputted to the display device for each two field periods. In contrast to this, in the case where the original image in an interlace mode is a moving image, the video image in FIG. 32B and the video image in FIG. 32C are generated alternately on the display screen for each one field period, and each of the video images is subjected to blanking processing. Accordingly, a moving image display of an interlace mode in accordance with the present embodiment does not need processing in which an original image of the moving image of a progressive mode is divided into two sub-field video data. Therefore, the display device similarly compares pixel data included in each of the original images of the interlace mode for two field periods inputted subsequently to this device with the original image of the progressive mode, and performs the aforesaid interlace-progressive conversion by a circuit (the scanning data generator circuit 102 shown in FIG. 1, for example) arranged in or around the display control circuit 114 when the display device judges that the original image of the interlace mode is a still image.

When only the odd-numbered or even-numbered line video data formatted with 1080*i* in the interlace mode are displayed on a liquid crystal display panel having a resolution of XGA class in an impulse manner for each field period in accordance with the present embodiment, the number of vertical scanning lines in the liquid crystal display panel (pixel array) provided for each video display becomes 576 (refer to FIG. 40). In the case where only the odd-numbered line video image and only the even-numbered line video image are displayed while the gate lines in the effective display area in the pixel array (refer to FIG. 13B) are similarly selected for each two lines, a vertical resolution of video generated at an effective display area during the two field periods is as small as 576×(½)=288 lines. In contrast to this, one combination of gate lines in the effective display area selected for displaying only the odd-numbered line video data and the other combination of gate lines in the effective display area selected for displaying only the even-numbered line video data are made different from each other, as described above in the present embodiment, (in other words, pseudo interlace display is carried out in accordance with the present embodiment), a vertical resolution of the video image generated at an effective display area during the two field periods is improved to 576×(¾)=432 lines.

Figure 33:
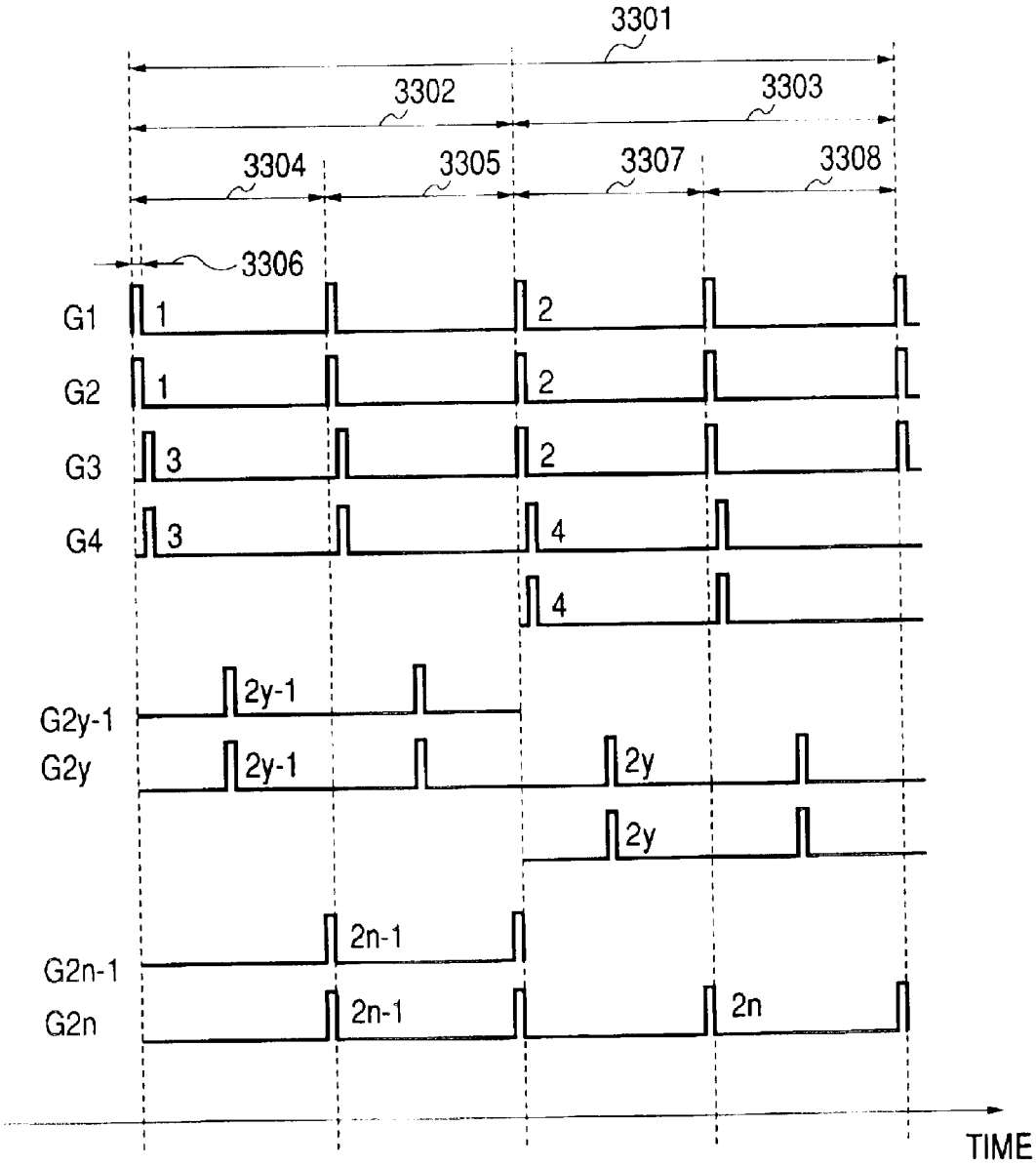
FIG. 33 is a timing chart of a gate selection pulse in a display device in Embodiment 7 of the present invention.

FIG. 33 shows one example of a timing chart of gate pulses in which a video image is displayed in an impulse manner in the aforesaid pseudo interlace mode in accordance with the present embodiment.

As described above, in order to reproduce a moving image of the original image in the pixel array (display screen) or its effective display area in accordance with the present embodiment, scanning must be carried out at least for each picture on odd-numbered line video data and even-numbered line video data. Due to this fact, a period in which scanning for each picture with odd-numbered line video data and even-numbered line video data and scanning for each picture with a blanking data accompanied by each of the scanning are completed is defined as a frame period 3301. In the case where an original image is inputted to the display device as either a video image of the interlace mode or a video image of the progressive mode with a frequency of 60 Hz, the frame period 3301 for the displaying operation in accordance with the present embodiment becomes about 33 ms, and about 16.7 ms of the front half of the frame period is assigned to an odd-numbered field period 3302 where the video display of odd-numbered line and blanking processing performed for this video display are carried out and about 16.7 ms of the rear half is assigned to an even-numbered field period 3303 where video display of even-numbered line and blanking processing performed for this video display are carried out. As is apparent from a length of the odd-numbered field period 3302 and a length of the even-numbered field period 3303, these periods corresponds to one field period for the original image in an interlace mode with 60 Hz and one frame period for the original image in a progressive mode with 60 Hz, respectively.

A video write-in period 3304 is assigned to the front half of the odd-numbered field period 3302 and a blanking data write-in period 3305 is assigned to the rear half of the odd-numbered field period 3302 every about 8.4 ms. In addition, the odd-numbered line data of the original image is written in the video write-in period 3304 and the blanking data for displaying pixel in black, for example, is written in the blanking data write-in period 3305 through the selection of gate lines in the pixel array as shown in FIG. 32B. Likewise, a video write-in period 3307 and a blanking data write-in period 3308 are assigned to the front half and the rear half of the even-numbered field period 3303, respectively, every about 8.4 ms. However, the even-numbered line data of the original image and the blanking data for displaying pixels in black, for example, are written into the pixel array in the video write-in period 3307 and the blanking data write-in period 3308, respectively, through selection of the gate lines in the pixel array shown in FIG. 32C.

In each of the odd-numbered field period 3302 and the even-numbered field period 3303, each of the lines is selected in a similar gate selection period 3306 and either a video signal or a blanking signal is transferred to pixel rows corresponding to each of the lines during this selection period. When the display device in accordance with the present embodiment recognizes the original image inputted to this display device a still image, the horizontal data of the original image are written in sequence for each lines of the pixel array, and blanking processing is not performed on the video data written into the pixel array. Accordingly, in accordance with the present embodiment, it is also possible to write the video data into the pixel array in the gate selection period 3306 having a similar length irrespective of a video displaying format (applicable to still image display or moving image display).

FIG. 33 shows a voltage waveform applied to each of gate lines of the number of 2n arranged in such a pixel array as that shown in FIG. 32 for each of the addresses (G1 to G2n) of the gate lines. Each of the voltage waveforms produces a gate selection pulse whose potential value changes from a low state to a high state in the aforesaid gate selection period 3306 with the lapse of time indicated along the abscissa. The line numbers of the original image (an address of each of the horizontal data) is indicated at a position near each of the gate selection pulses.

In the video write-in period 3304 of the odd-numbered field period 3302, the odd-numbered line video data 1, 3, 5, . . . are written in sequence from a pair of gate lines G1, G2 simultaneously for each two lines, and then scanning of one picture with the odd-numbered line video data is completed with writing-in of the (2n−1)−th video data into the gate lines G2n−1, G2. After this operation, black data is written in sequence simultaneously for two lines from the pair of gate lines G1, G2 in the blanking period 3305. The odd-numbered field period 3302 ends with completion of one picture scanning for the blanking data by writing-in of the black data into the gate lines G2n−1, G2n.

Then, an even-numbered field period 3303 starts from a video writing-in period 3307. As described above, a pair of gate lines to which each of the even-numbered line video data is written are set in such a manner to be shifted by one line with respect to that of odd-numbered line video data in a vertical direction.

In this case, when an address 2y (y is a natural number less than n) is assigned for data of an optional even-numbered line, the even-numbered line video data are written into a pair of pixel rows corresponding to a pair of gate lines to which the odd-numbered line video data with an address (2y−1) has already been inputted in another field period, by 2-line simultaneous write-in operation described in reference to the embodiment 1. That is, in the displaying operation for selecting every one line in the pixel array, the odd-numbered line video data with a certain address and the even-numbered line video data written into the pixel array subsequent to the writing-in operation of the video data into the pixel array are written into a pair of pixel rows corresponding to the same pair of gate lines in the 2-line simultaneous writing-in operation described in reference to the embodiment 1. In contrast to this, in the present embodiment, odd-numbered line data with an address 2y−1 are written into a pair of pixel rows corresponding to a pair of gate lines with addresses G2y−1 and G2y affixed in a vertical direction in the pixel array, and the even-numbered line data with an address 2y are written into a pair of pixel rows corresponding to a pair of gate lines with addresses of G2y and G2y+1 positioned lower than a pair of gate lines G2y−1, G2y by one line in the pixel array. Due to this fact, in the video writing-in period 3307 of the even-numbered field period 3303, the video data written into the upper-most gate line G1 in the pixel array is unfixed and the video data written into the lower-most gate line G2n in the pixel array is not written at a gate line other than the above.

Since the user of display devices (or audio visual equipment or information processing device provided with this display device) turns their eyes upon the center of display screen, the user is scarcely aware that either the content displayed at the pixel rows corresponding to the uppermost gate line G1 in the pixel array or even-numbered (2n)th line data is displayed only at the lowermost gate line G2n in the pixel array. However, the pixel array described above in reference to the present embodiment is replaced with an effective display area found in the video display indicated in FIG. 13B or FIG. 13C in which an invalid area is formed in its vertical direction. If the video data written into the pixel row corresponding to the upper-most gate line G1 in the effective display area are unfixed with respect to the invalid area displayed in black during such a pixel display as above, there arises the possibility that the unnatural bright display of the pixel row allows a certain stripe pattern to generate at the interface between the invalid area and the effective display area.

In view of the above possibility, in the present embodiment, the second even-numbered line video data written into the pixel array at first in the video write-in period 3307 of the even-numbered field period 3303 are written into three pixel rows corresponding to the three gate lines G1, G2, G3, and subsequently the even-numbered line video data 4, 6, 8, . . . are written in sequence from a pair of gate lines G4, G5 in a 2-line simultaneous write-in manner. Although writing of the second even-numbered line data into the pixel row corresponding to the line G1 is not directly related to an improvement of a vertical resolution in moving image display of the original image, a luminance displayed at the pixel row is prevented from being abnormally increased relative to a luminance around it over one frame period 3301 for a displaying operation at the pixel array. In another operation mode in which the pixel array is provided with an effective display area as shown in FIG. 13B or FIG. 13C and the moving image is displayed in accordance with the present embodiment, the blanking data written into the invalid area is also written into the pixel row corresponding to the line G1 in the even-numbered field period 3303 (in this case, this operation mode is desirably combined with the driving mode of the embodiment 4 described in reference to FIG. 24).

One picture scanning with the even-numbered line video data is completed with writing of the (2n)th video data into the gate line G2 only. Thereafter, the gate lines are selected in sequence within the same blanking period 3308 as the video writing-in period 3307 in the same manner as that for the video writing-in period 3307, black data are written in sequence into the pixel rows corresponding to each of the two lines, from the pixel rows corresponding to three gate lines G1, G2, G3; pixel rows corresponding to two lines G4, G5; pixel rows corresponding to the subsequent two lines G6, G7; and subsequently up to pixel rows corresponding to two lines G2n−2, G2n−1. Upon completion of one picture scanning of blanking data through writing of the black data into the lowermost gate line G2n, the even-numbered field period 3303 is finished and concurrently the displaying operation in one frame period 3301 of the pixel array is also finished.

This displaying operation in one frame period 3301 is repeated in sequence for each two frame periods on the original image in the progressive mode, and for each two field periods on the original image in the interlace mode, whereby the moving image can be impulse displayed in the aforesaid pseudo interlace by the display device for hold-displaying the still image.

In the case of impulse display of the video under a pseudo interlace mode in accordance with the aforesaid present embodiment, line selection of the pixel array in the even-numbered field period 3303 may be shifted by one line relative to the line selection in the odd-numbered field period 3302 from (2y)th gate line in the midway along a vertical direction of the pixel array (because the users pay their concern to the center of the display device). In this case, the even-numbered line data with an address 2y or another data is written in a pixel row corresponding to a gate line with an address (2y−1) where the video data to be written becomes unfixed in the even-numbered field period 3303.

Alternatively, two gate lines are similarly selected for each gate selection pulse in the odd-numbered field period 3302 and the even-numbered field period 3303 up to the gate line with an address 2y along a vertical direction of the pixel array, the odd-numbered line data up to an address 2y−1 and the even-numbered line data up to an address 2y are written into the pixel array, thereafter the line selection of the pixel array in the odd-numbered field period 3302 is shifted by one line with respect to a line selection of the pixel array in the even-numbered field period 3303. For example, the odd-numbered line data with an address 2y+1 is written into only the pixel row corresponding to the gate line with an address (2y+1), subsequently the odd-numbered line data with an address of 2y+3 is written into pixel rows corresponding to two gate lines with addresses (2y+2), (2y+3), and, subsequent odd-numbered line data is written into the residual gate lines for each two lines (for each two pixel rows corresponding to each of the lines). In this case, the even-numbered line data with an address 2y+2 is written into the pixel rows corresponding to gate lines with addresses (2y+1), (2n+2) and subsequently the even-numbered line data with an address 2y+4 is written into the pixel rows corresponding to the gate lines with addresses (2y+3), (2y+4), and subsequent even-numbered line data is written into the remaining gate line for each two lines (for each two pixel rows corresponding to each of the lines), in sequence.

In the case where the two gate lines selected in the odd-numbered field period 3302 are shifted by one line in respective to that in the even-numbered field period 3303 over the pixel array or its effective display area, the odd-numbered line data 1 is written into the pixel row corresponding to only the gate line G1, the odd-numbered line data 3 is written into two gate lines G2, G3 and subsequent odd-numbered line data are written into the remaining gate lines for each two lines (for each two pixel rows corresponding to each of the lines), in sequence. In contrast to this, the even-numbered line data 2 are written into two gate lines G1, G2 and the subsequent even-numbered line data are also written into the remaining gate lines for each two lines (for each two pixel rows corresponding to each of the lines).

In this case, the video data to be written into the pixel row corresponding to the lowermost gate line 2n of the pixel array is unfixed in the odd-numbered field period 3302. However, it is satisfactory that the blanking data is written into the pixel row corresponding to the gate line G2n in accordance with writing of data into the gate line G1 (the uppermost line of the pixel array) when a pair of gate lines selected in the even-numbered field period 3303 are shifted by one line. In addition, the odd-numbered line data with an address n−1 written into the pixel rows corresponding to the gate lines G2n−2, G2n−1 may be written. Further, in the case where a video image is partially displayed at the pixel array as shown in FIG. 13D or FIG. 14D (finder-displayed), the odd-numbered line data with 2n+1 (not appeared in the display screen in the case of finder-display for a still image) is written into the pixel row corresponding to the gate line G2n. In the case where this finder-display in is carried out while a pair of gate lines selected in the even-numbered field period 3303 being displaced by one line, 0th even-numbered line (not appeared in a display screen in the case of finder-display for a still image) may be written into the pixel row corresponding to the upper-most gate line G1 in the pixel array in the even-numbered field period 3303. The odd-numbered line data and the even-numbered line data of the original image are partially deposited to correct the respective differences in resolution and aspect ratios between the original image and the pixel array. In such a case, as regards number (addresses) of the aforesaid odd-numbered line data and the even-numbered line data, only one group written into the pixel array or its effective display area for each one line from the horizontal data of the original image is extracted and they are assigned to them in sequence from the upper end of the pixel array.

The order of odd-numbered field period 3302 and an even-numbered field period 3303 in one frame period 3301 may be properly inversed.

As shown in FIG. 33, in accordance with the present embodiment, a timing of voltage signal (scanning signal) outputted to each of the gate lines in the pixel array from the gate line drive circuit 104 is changed for each of the field periods 3302, 3303 (sub-field periods). The output timing of a scanning signal to each of the gate lines is sometimes changed in one period of the two kinds of video write-in periods 3304, 3307 included for each frame period 3301 (including two times of the aforesaid field period). Its reason and effect have already been described above.

In view of the gate line G3 shown in FIG. 33, a gate selection pulse is outputted in the same timing as that for the gate line G4 in one field period 3302 of the two kinds of field periods alternately set with respect to the time axis, and in turn a gate selection pulse is outputted in the same timing as that for the gate lines G1, G2 in the other field period 3303. A generating timing for a gate selection pulse in each of such gate lines G1 to G2n is controlled by selecting in sequence, with an enable signal, each of the output units of the gate line drive circuit 104 connected for each gate line. For this reason, the gate line drive circuit 104 or a circuit substrate having this gate line drive circuit 104 mounted therein is provided with enable signal wiring suitable for one field period 3302 for driving the outputting of a scanning signal to the gate lines G1, G2 with a certain timing, for example, and for driving the output of scanning signals to the gate lines G3, G4 with the subsequent timing; and enable signal wiring suitable for the other field period 3303 for driving the outputting of a scanning signal to the gate lines G1, G2, G3 with a certain timing, and for driving the output of scanning signal to the gate lines G4, G5 with the subsequent timing. Although controlling of each of the scanning signal output units is not restricted to the aforesaid enable signal, the present embodiment has controlled a displaying operation for the pixel array in which an instruction signal for determining this controlling condition (for selecting wiring for an enable signal, for example) is generated by a display control circuit (a timing converter) 114 or a peripheral circuit installed at a substrate having this display control circuit 114 mounted thereon, transferred to the gate line drive circuit 104 and output patterns of gate selection pulse for each of field periods (a combination of the gate selection pulse generating timing in each of the gate lines G1 to G2n) are alternately changed. The instruction signal inputted to the gate line drive circuit 104 is generated as a timing signal similar to another clock signal and its potential is changed over to either a low state or a high state to cause the gate line drive circuit 104 to recognize the start and end of each of the field periods.

It is possible to further increase a resolution of the moving image by the impulse display of the pseudo interlace video in accordance with the present embodiment described above.

<Embodiment 8>

The aforesaid preferred embodiments have illustrated the video data or the drive waveforms in the pixel array when the pixels are mainly displayed in black with the blanking data. In the present embodiment, there will be described a blanking data including a data area having different display colors of pixels in one picture in reference to a variation of the video image inputted to the display device or video data sent to the pixel array for each frame period or field period as another setting format of the blanking data.

Figure 34A:
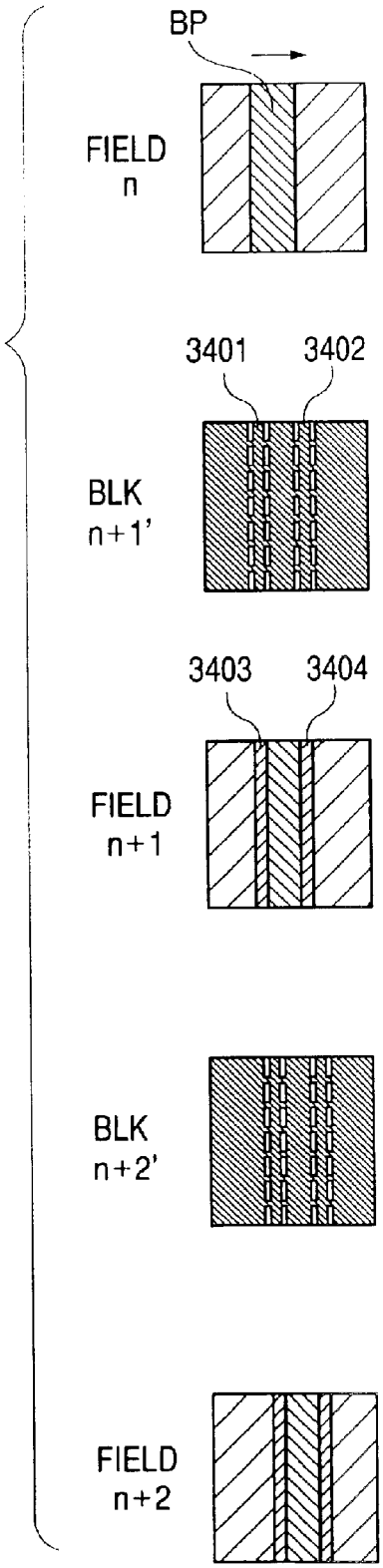
FIGS. 34A, 34B, 34C, and 34D are explanatory diagrams showing a method for inserting blanking data (black data) for each frame period in Embodiment 8 of the present invention.

FIG. 34A indicates a series of videos arranged side by side from the upper side to the lower side of this paper sheet in the order of three successive field periods in which an elongated belt pattern BP displayed in a dark half tone is moved from the left side to the right side at the display screen of the display device having a background with a light halftone set. The three field periods are continuous in an order of periods n, n+1 and n+2, and the video images displayed at the image screen in each of the field periods are indicated every other video image along a vertical direction in the paper sheet. A blanking video image n+1' is displayed between the video images displayed at the picture in the field periods n and n+1, and a blanking video image n+2' is displayed between the field periods n+1 and n+2 at the picture. Although a variation in the video image will be described for each field period in the present embodiment, the field period in the present embodiment is suitably replaced with a frame period in accordance with to the aforesaid embodiments.

In FIG. 34A, a position of the aforesaid belt pattern BP in the picture is also changed in response to the transition of the video image from the field period n to the field period n+1. Motion of the belt pattern BP causes both an area 3403 varied to a light halftone as compared with a picture displaying the video of the field n and an area 3404 varied for showing a dark halftone to be generated in a picture for displaying the video image having a field period n+1.

The picture having a displayed video with the field period n displays a video image with the field period n in an impulse manner while being displayed in black over its entire area with a blanking video image n+1', and then the video image with the field period n+1 is displayed. Such an impulse display of video image is carried out by 2-line simultaneous write-in operation of video data into the pixel array described in the aforesaid embodiment, for example. In the picture where the blanking video image n+1' is displayed, the aforesaid area 3403 varying from the dark halftone to the light halftone is indicated as an area 3401 enclosed by a blank dotted line, and the aforesaid area 3404 varying from the light halftone to the dark halftone is indicated as an area 3402 enclosed by a blank dotted line.

When not only data write-in into the pixel array by 2-line simultaneous write-in but also an impulse-type display through black displaying over an entire area of a pixel array of the video image written into the pixel array for each field period is carried out, it has been assumed that all the video images written into the pixel array in the field period upon completion of one field period are once reset. However, in the liquid crystal display device or an electroluminescent type display device, its optical response characteristic is dependent on a manner of change in a gray scale signal supplied to the pixel, so that it is hard to make the uniform reset of the video displayed in the previous field period (the period n with respect to the period n+1, for example) from the picture.

one example of such a phenomenon as above will be described as follows in reference to the liquid crystal display device. An optical response in the liquid crystal layer (for example, a variation in its light transmission) in the liquid crystal display device becomes fast when an electric field in the liquid crystal layer is intensified as described above, and the optical response becomes slow when it is weakened. Due to this fact, in the case of the normally black mode type liquid crystal display device in which a potential difference applied to the liquid crystal layer is made small so as to decrease a light transmission of the liquid crystal layer (in other words, a display color of pixel is approached to black), it shows a tendency that a response speed when a pixel display is changed from its bright gray scale display to its dark gray scale display (resulting in black display) is made slow. In the video image with a field period n+1, this is apparent from the fact that a response characteristic of the area 3404 where its gray scale is changed from a gray scale of background at the picture to a gray scale of the belt pattern is slightly deteriorated as compared with the area 3403 where its gray scale is changed from a gray scale of the belt pattern to a gray scale of background in a picture.

In the liquid crystal display panel of IPS mode, which is one of the liquid crystal display devices of normally black mode, there is an area of halftone not reaching a black displayed state with the blanking data because an optical response from a halftone to another half tone is also slow.

Figure 34B:
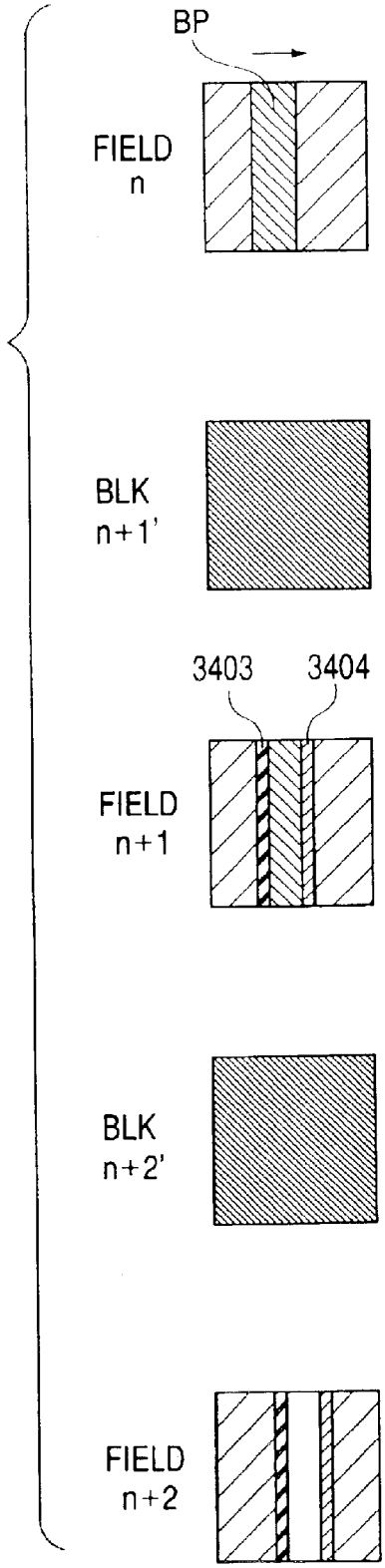

In regard to the aforesaid problems, FIG. 34B shows that the area 3403 transferred from a dark halftone display state to a light halftone display state is driven with a higher gray scale voltage than a gray scale voltage corresponding to a light halftone display to correct a rising from the black display state in blanking video display period to a desired light halftone. In addition, the area 3403 transferred from a light halftone display state to a dark halftone display state in opposition to the former also shows a delay in transition to the dark halftone display state because it is not completely transmitted to the black displayed state even in the blanking video display period. Accordingly, the area 3404 transferred to the dark halftone display state is driven by a lower gray scale voltage than the gray scale voltage corresponding to this dark halftone display.

The moving image generated over a video image with a field period n to a video image with a field period n+1 is displayed in an impulse manner by generating such a video image in a video display period and then a transition of belt pattern contour moved between the video images is made clearer.

Figure 34C:
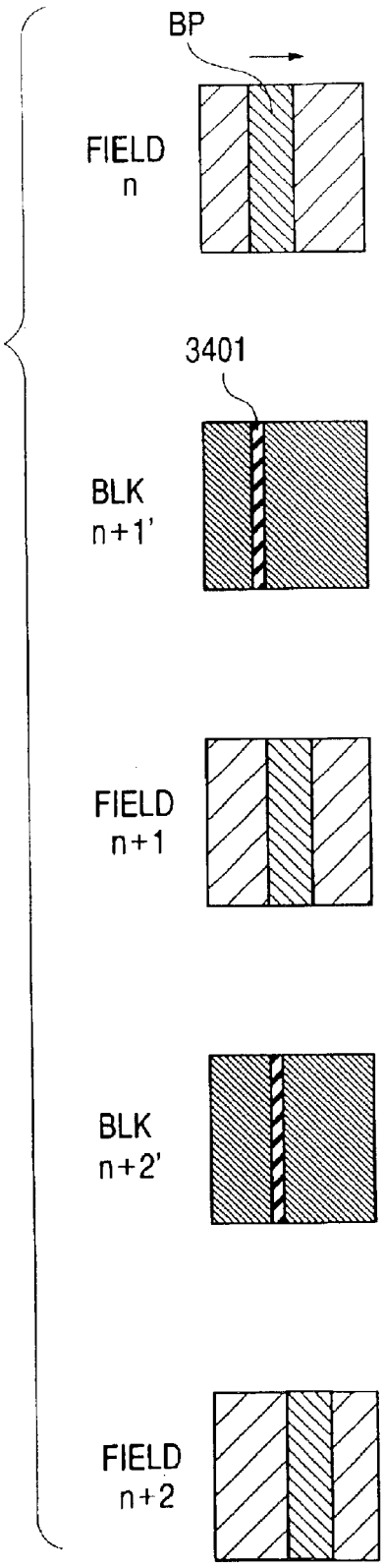

In FIG. 34B, although part of the video signal supplied in the pixel array in a video display period has been processed, in FIG. 34C, it is processed with a pattern of the blanking video image. In this method, a video image partially including an area showing different brightness in the blanking display period n+1', for example, is displayed in place of the blanking video image where the entire area of a picture is displayed in black. That is, the area 3403 (specified at a similar address at the pixel array) corresponding to the area 3403 in the video image with the blanking display period n+1' is made to a halftone display state for correction in order to correct an optical response of the area 3403 transferred to the light halftone display state in the video image with the field period n+1 displayed just after it from the video image with a field period n displayed just before the blanking display period n+1'. This area 3401 is displayed in a lighter halftone, for example, than that of another area at a picture with the blanking display period n+1'.

This method provides an effect when an optical response in an area transferred from a dark halftone display state to a light halftone state is slow, and this method is preferable for the TN type liquid crystal display device of normally white mode as well as an IPS mode liquid crystal display device with a slow changing-over speed in a halftone display state.

An operation for setting an area having different brightness such as the area 3401 to the blanking video data with the blanking display period n+1' is carried out by a display control circuit 114 of the display device or a circuit arranged around it, for example. In accordance with the comparator described in the embodiment 7, for example, a result in which an original image to be displayed in a field period n is compared with an original image to be displayed in a field period n+1 can be attained in a pixel unit during a period in which the original image with the field period n+1 is taken into a frame memory from outside, so that it is possible to process the blank video data written into the pixel array in the blanking display period n+1 on the basis of the result above. The processed blank video data is transferred to the drain line drive circuit 105, and a blanking signal of voltage different from that of another pixel group, the so-called pseudo video signal is supplied to a pixel (pixel group) corresponding to the aforesaid area 3401 in the pixel array.

Figure 34D:
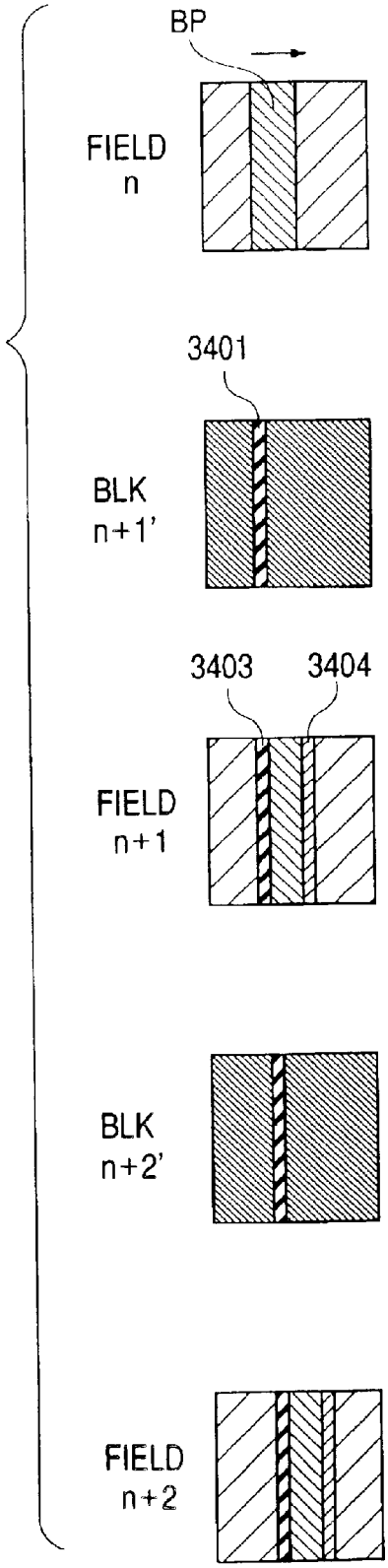

In FIG. 34D is shown an example of combination of the method for processing part of the video signal supplied to the pixel array in a video display period described in reference to FIG. 34B and the method for processing part of the blanking signal supplied to the pixel array in a blanking display period described in reference to FIG. 34C. The area 3404 reaches a desired halftone displayed state by intensifying a video signal supplied to the pixel array in a video display period, and the area 3403 reaches the desired halftone displayed state by intensifying a video signal supplied to the pixel array in a video display period and by a correction pattern in a blanking video array displayed just before it, so that a portion where the video image changes in the picture (an end part of the belt pattern in this case) can be displayed clearly.

As described above, both the methods for correcting a displayed state at a varying portion of the video image in the picture described in reference to FIG. 34B and FIG. 34C in the present embodiment (video processing methods), and the example of FIG. 34D in which these correcting methods are combined are also applied to an impulse display for the video described in the embodiments 1 to 7, thereby improving visibility of the video image displayed as the moving image.

<Embodiment 9>

As described in the embodiment 2 in reference to FIG. 17, when an impulse display of video image with the liquid crystal display panel is combined with an blinking operation of a light source device disposed oppositely to the liquid crystal display panel (a light source device operated in this way is hereinafter called a blink backlight), clearness of the moving image is increased and its visibility is improved. The blink backlight is made such that a plurality of tubular light sources arranged oppositely to the liquid crystal display panel, for example, are totally controlled with the current waveform 1701 shown in FIG. 17, so that luminance is made different in a vertical direction of the picture in the liquid crystal display panel displaying a video image in an impulse manner.

Each of the drive waveforms shown in FIG. 17 is operated such that a light source is turned on when liquid crystal layers corresponding to the pixel rows at the central part of a picture substantially completes an optical response to a video signal (in other words, a light transmission of the liquid crystal layers increases up to a desired level) in order to make a preference of moving image quality at the central part of the picture in the liquid crystal display panel, and current pulse (hereinafter also called a blink pulse) 1708 or 1709 for turning off the light source at a timing where the liquid crystal layers corresponding to these pixel rows start to change into the black displaying state in response to the blanking signal (in other words, a light transmission of the liquid crystal layer starts to decrease) is generated. Therefore, a light transmission of the liquid crystal layer corresponding to the pixel rows at the upper end of the picture starts to decrease in response to a blanking signal and a light transmission of the liquid crystal layer corresponding to the pixel rows at the lower end of the picture does not reach yet to a level corresponding to the video signal. As a result, the so-called grading in luminance showing a bright central part and displaying dark upper and lower sides is generated at the picture of the liquid crystal display panel.

In view of such circumstances as described above, in order to keep the drive waveform shown in FIG. 17 in regard to the blink backlight turned on with blink pulse 1708 or 1709 of the current waveform 1707 shown in FIG. 17, it is desired that timing of blanking at the central part of a picture at the liquid crystal display panel (a timing dropping a light transmission of the liquid crystal layers corresponding to the pixel rows) delays a reduction in light transmission of the liquid crystal and further allows the light transmission of the liquid crystal layer at the lower part of the picture to rise fast up to a level corresponding to the video signal.

Figure 35:
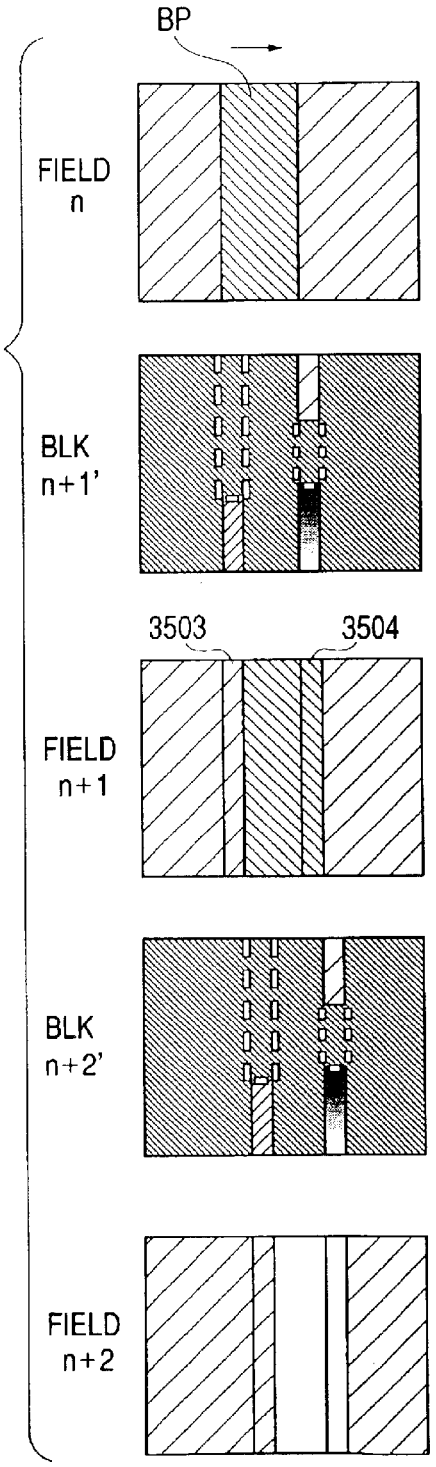
FIG. 35 is a diagram showing a method for inserting blanking data (black data) for each frame period in Embodiment 9 of the present invention.

FIG. 35 shows a series of videos in which a varying video part is corrected in the vertical direction of the picture of the liquid crystal display panel over continuous three field periods n, n+1, n+2 in reference to FIGS. 34A to 34D. Also in the present embodiment, it is possible to represent a field period by a frame period in reference to the aforesaid embodiments.

FIG. 35 shows a video image in which an elongated belt pattern of dark halftone is scrolled from the left side to the right side at a background of a light halftone in the same manner as that shown in FIG. 34A; and a blanking video image n+1' is displayed between one period in which a video image with a field period n is displayed in a picture and the other period in which a video image with a field period n+1 is displayed in a picture, and a blanking video n+2' is displayed in a picture between one period in which a video image with a field period n+1 is displayed in a picture and the other period in which a video image with a field period n+2 is displayed in a picture. Varying portions 3503, 3504 with respect to the video image with a field period n are indicated in the video image with a field period n+1, and each of the varying portions corresponds to each of video varying areas 3501, 3502 indicated in the blanking video n+1' displayed just before the video image with a field period n+1.

In order to hold a video image at the upper part of a picture, the video-varying areas 3501, 3502 generated in the blanking video displayed in black are displayed at a gray scale of halftone between a gray scale displayed in this area in the frame period n and black in place of displaying of black to cause a reduction in light transmission at the liquid crystal layer at the upper part of a picture to be delayed. Also at the lower part of the picture, the video-varying areas 3501, 3502 are displayed at a gray scale of halftone between black and a gray scale displayed in this area in the frame period n+1 in place of displaying of black. That is, the video data (video image with the frame period n+1) displayed just after the blanking video image n+1' is written in advance in the video-varying areas 3501, 3502 on the lower side of the picture. Since the central part of the picture is also applied as a standard for setting the blink pulse, the blanking video image n+1' is displayed in black and the video-varying areas 3501, 3502 are also displayed in black.

In this way, an interface condition is set at each of the video-varying areas 3501, 3502 in the blanking video n+1' at the upper part, lower part and central part of the picture, respectively (displayed in gray scales different from each other), and a gradated image region in a vertical direction as shown in FIG. 35 is generated at other portions while supplementing a difference in interface condition (gradation) set at both sides.

With such an operation, even if a blink pulse is set to the central part of the picture, the liquid crystal layer at the upper part of the picture is kept in a light transmission corresponding to the video image already written at the time of turning-on of a lamp, resulting in that a dark display is restricted. In addition, since a light transmission of the liquid crystal layer at the lower part of the picture already starts to increase in response to the video image to be written at the time of turning-on of the lamp, the pixel rows at the lower part of the picture are displayed in a luminance corresponding to the video image. As a result, a non-uniform luminance of the liquid crystal display panel generated at each of the upper and lower portions of a picture becomes scarcely noticeable.

<Embodiment 10>

Figure 36:
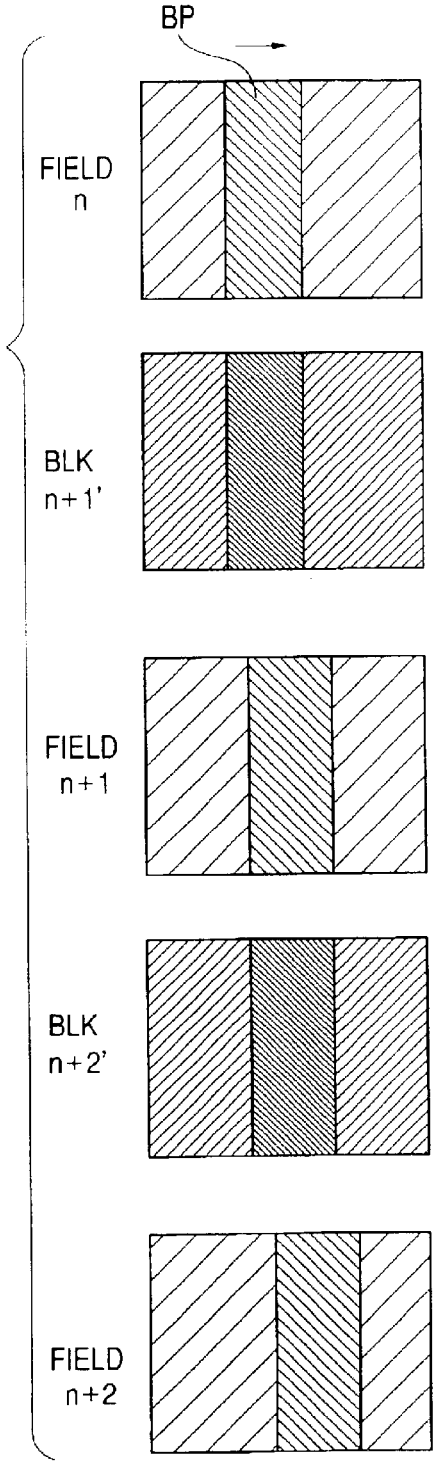
FIG. 36 is a diagram showing a method for inserting blanking data (black data) for each frame period in Embodiment 10 of the present invention.

FIG. 36 is an explanatory diagram illustrating this embodiment in which either a video data or its similar data written just before blanking data is displayed dark in a lower gradation in place of displaying the entire area of pixel array with blanking data in black during a video impulse display in which the pixel array is scanned in one frame period by the aforesaid 2-line simultaneous write-in operation and both the video data and the blanking data are displayed in sequence at the pixel array.

FIG. 36 shows a video over three continuous frame periods n, n+1, n+2 in which an elongated belt pattern BP of dark halftone is scrolled from the left side to the right side at a light halftone background, in the same manner as that of FIGS. 34A to 34D or FIG. 35. In the present embodiment, it is possible to replace a frame period with a field period in accordance with the aforesaid embodiments.

A blanking video image n+1' is displayed at a picture in a period in which each of a video image with a frame period n and a video image with a frame period n+1 is displayed at the picture, and a blanking video image n+2' is displayed at a picture in a period in which each of a video image with a frame period n+1 and a video image with a frame period n+2 is displayed at the picture. When the present embodiment is combined with the embodiment 1, the blanking video image n+1' is written into the pixel array in a frame period n together with the video image with a frame period n, and the blanking video image n+2' is written into the pixel array in a frame period n+1 together with the video image with a frame period n+1.

The blanking video n+1' displays each of a background displayed by a video image with a frame period n and a belt pattern in a lower gradation than that displayed by the video image with a frame period n. This blanking video image n+1' is generated as the so-called pseudo video data, which display a middle gradation between the image data with the frame period n and the blanking data displaying the entire picture in a low gradation (e.g., black) by superposing the blanking data on the image data with the frame period n. It is noted that this pseudo video data may be generated by either the display control circuit 114 or its peripheral circuit, or may be generated by a drain line drive circuit similar to the drain driver IC described in the embodiment 5 while the mask logic is replaced with a circuit synthesizing the aforesaid blanking data and the video data.

The blanking video n+2' displays each of a background displayed by a video image with a frame period n+1 and a belt pattern BP in a lower gradation than that displayed by the video image with a frame period n+1 in the same manner as that of the blanking video n+1'.

When the blanking video image is not displayed in uniform black, but displayed by middle data generated by combination the video data displayed before this blanking video and the blanking data as disclosed in the present embodiment, a response characteristic to apparent black displayed state is delayed and the video image is generated in a state similar to the hold display as compared with a case in which the blanking video image is displayed in uniform black. With such an operation, the video image is displayed bright in the present embodiment, so that this embodiment is effective in displaying a video image with a less amount of motion.

<Embodiment 11>

There will be described below as to an optical response of the liquid crystal display panel and its improvement in a hold drive of the liquid crystal display device in which a display picture of the liquid crystal display panel is kept in a displayed state of a video image corresponding to the video data, and an impulse drive of the liquid crystal display device (refer to the aforesaid embodiment) in which it is replaced with the blanking video displayed state (a black displayed state, for example) after being set to this video displayed state, for each frame period (or field period) of the video data inputted to the liquid crystal display device.

Figure 37B:
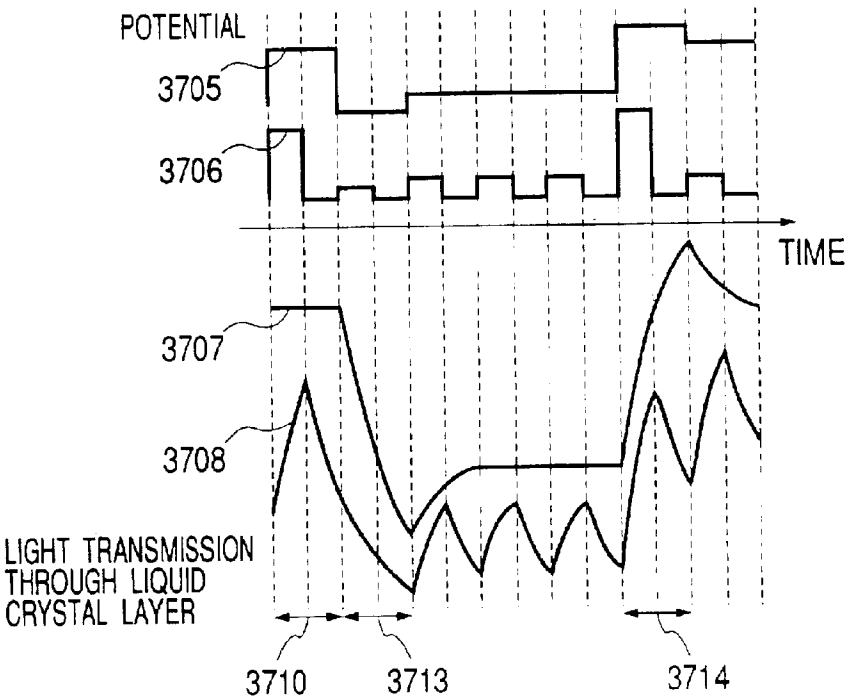
FIGS. 37A and 37B are each a diagram illustrating a relation between a gray scale voltage waveform and a liquid crystal light transmission response waveform of the liquid crystal display device in Embodiment 11 of the present invention.
Figure 37A:
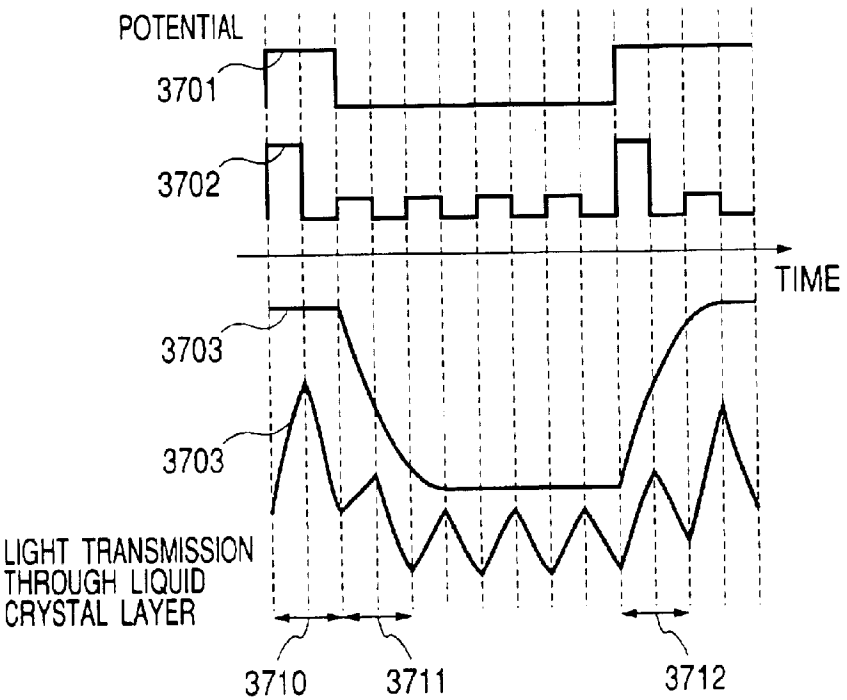

FIG. 37A shows a gray scale voltage waveform 3701 for hold driving a liquid crystal display device in accordance with video data inputted to one frame period 3710, and a gray scale voltage waveform 3702 for impulse driving the liquid crystal display device. Each of the voltage waveforms is applied to a pixel electrode of an optional electrode arranged in the liquid crystal display panel and its potential variation also indicates a variation in electrical field intensity generated at the liquid crystal layer corresponding to this pixel. A variation in light transmission of the liquid crystal layer corresponding to a pixel (a pixel electrode) to which a gray scale voltage waveform 3701 for hold driving the liquid crystal display device is applied is represented by a response waveform 3703. A variation in light transmission of the liquid crystal layer corresponding to a pixel (a pixel electrode) to which a gray scale voltage waveform 3702 for impulse driving the liquid crystal display device is applied is represented by a response waveform 3704.

These gray scale voltage waveforms and the response waveform for a light transmission are drawn for the liquid crystal display device for displaying a video image in a normally black mode. Accordingly, the potentials of the gray scale voltage waveforms 3701, 3702 are increased with a rise along the ordinate. The light transmission response waveforms 3703, 3704 in the liquid crystal layer show a high light transmission as they rise along the ordinate, thereby increasing a luminance at the picture of the liquid crystal display panel. When the light transmission of the liquid crystal layer and the video display according to its modulation are controlled in a normally black mode, the light transmission at the liquid crystal layer is theoretically increased as an electric field intensity generated in the liquid crystal layer is increased.

Each of a plurality of ordinates indicated by a solid line in FIG. 37A divides a time axis (an abscissa) for each frame period (or field period) of video data inputted to the liquid crystal display device. In addition, each of the ordinates indicated by a dotted line divides each of the frame periods defined by a pair of solid line ordinates into the front half (left side) and the rear half (right side). When the liquid crystal display device is driven by a method described in detail in the embodiment 1 in which the video data is written into the pixel array at the front half of one frame period of the original image inputted to the device and the blanking data is written into the pixel array at the rear half of one frame period, and the video image is displayed in the impulse mode at the picture, the ordinate of dotted line indicates an interface between the video data write-in period into the pixel array and a blanking data write-in period in each of the frame periods.

A potential of the gray scale voltage waveform 3701 for hold driving the liquid crystal layer is fixed to a value corresponding to the video data for each frame period to cause electric field intensity in the liquid crystal layer to be held at each of the frame periods. In contrast to this, the optical response waveform 3703 at the liquid crystal layer does not necessarily follow a potential of the gray scale voltage waveform, and the optical response waveform 3703 does not reach a low light transmission corresponding to the gray scale voltage of low-level even at the time of end of the frame period 3711 with respect to a variation from the high level (corresponding to a light halftone) of the frame period 3710 of the gray scale voltage waveform 3701 to a low level (corresponding to a dark halftone), for example. Conversely to this, the light transmission response waveform 3703 is kept at a lower light transmission than the light transmission indicated at the frame period 3710 at the time of end of the frame period 3712 where the gray scale voltage waveform 3701 is returned again to the same high-level as that of the frame period 3710 after four frame periods held at a low-level.

A potential of the gray scale voltage waveform 3702 for impulse driving a liquid crystal layer is fixed to a value corresponding to the video data at the front half for each frame period and fixed to a value corresponding to the blanking data (displaying the pixel in black, for example) at the rear half part. With such an operation, an electric field generated in the liquid crystal layer in intensity corresponding to the video data at the front half of the frame period is cancelled at the rear half of the frame period to decrease a light transmission at the liquid crystal layer (when the liquid crystal layer is driven in a normally white mode, an electric field in the liquid crystal layer is made maximum at the rear half of the frame period in opposition to the former). In contrast to this, a light transmission response waveform 3704 in the liquid crystal layer does not sufficiently follow a potential of the gray scale voltage waveform 3702 even in the frame period 3710 and it does not reach the minimum value even at the time of end of the frame period 3710.

The gray scale voltage waveform 3702 varies, similarly to the gray scale voltage waveform 3701, in such a way that the pixel is displayed in a light halftone subsequently to the frame period 3710 and frame period 3712 and the pixel is displayed in a dark halftone in four frame periods including a frame period 3711 between the frame period 3710 and the frame period 3712. Accordingly, the gray scale voltage waveform 3702 provides the aforesaid high-level or low-level gray scale voltage at the front half of each of the frame periods. In addition, the gray scale voltage waveform 3702 is kept at the lowest-level gray scale voltage lower than the aforesaid low-level at the rear half of each of the frame periods so as to display the pixel in black. Accordingly, it is expected that a light transmission of the liquid crystal layer is decreased in writing of the blanking data at the rear half of the frame period 3710 at a transition from the frame period 3710 for displaying the pixel bright to the frame period 3711 for displaying the pixel dark. However, as described above, since the light transmission response waveform 3704 in the frame period 3710 does not sufficiently follow the gray scale voltage waveform 3702 for impulse driving the liquid crystal layer, the maximum value of light transmission in the liquid crystal layer at the frame period 3711 becomes higher than that in the subsequent three frame periods. In addition, the light transmission of the liquid crystal layer cannot follow a rapid rising of the gray scale voltage waveform 3702 in the frame period 3712 for displaying the pixel displayed dark over four frame periods bright. Accordingly, the maximum value of the light transmission of the liquid crystal layer in the frame period 3712 is lowered as compared with the maximum value of the light transmission at the liquid crystal layer in the next frame period subsequent to the blanking data writing in the frame period 3712.

As described above, a light transmission at a liquid crystal layer indicates an approximately logarithmic response with a given time constant with respect to a variation of the gray scale voltage (electric field intensity in the liquid crystal layer) indicated as a rectangular wave extending along a time axis irrespective of a driving mode of the liquid crystal layer. In other words, it takes a time in which a light transmission of the liquid crystal layer indicates a value corresponding to its gray scale voltage with respect to a certain time where the gray scale voltage rapidly changes. The liquid crystal display device forces the liquid crystal molecules oriented by an initial condition to orient in a desired direction in accordance with the intensity of the electric field at the liquid crystal layer and weakens the electric field to return the liquid crystal molecules into their initial orientation so as to control the light transmission of the liquid crystal layer for displaying an image. Accordingly, the light transmission of the liquid crystal layer shows a hysteresis with respect to an increased or decreased state of the electric field intensity therein as described above and the response (variation in an orientation) to a variation of electric field intensity is made different also in accordance with an orientation of the liquid crystal molecules at a time where the electric field in the liquid crystal layer is changed. Accordingly, even in the impulse drive of the liquid crystal layer allowing a light transmission at the liquid crystal layer to drop in the writing of blanking data into the pixel array for each frame period, the data written into the pixel array before this frame period (in other words, an orientation of liquid crystal molecules due to the variation of the electric field applied in accordance with these data) appear as hysteresis in macroscopic view in the variation of a light transmission of the liquid crystal layer corresponding to each of the video data and blanking data written into the pixel array in the frame period. Therefore, the black level (blanking display color) a picture of the liquid crystal display device reaches by writing of the blanking data into the pixel array depends on the frame period.

In view of the aforesaid phenomena, even if the video data in the first frame period or its previous frame period is reset by the blanking data in the so-called video varying period or transit from the frame period (the first frame period) to the subsequent frame period (the second frame period) when the liquid crystal layer is impulse driven, its effect cannot probably be achieved sufficiently. For example, even if the picture is displayed in black in a video varying period (hereinafter called a black level reset), the bright video image displayed in the first frame period is left in a dark video image displayed in the second frame period, and, the dark video displayed in the first frame period is left in the bright video image displayed in the second frame period. In this way, a phenomenon in which the video image displayed prior to a certain frame period is generated at a video image displayed in the certain frame period is called image retention. This image retention makes a contour of an item moving in the picture blurred for each frame period, as already described in the embodiment 3 in reference to FIG. 34A, for example, deteriorating clear appearance of the moving image.

Meanwhile, a total amount of response times required for rising and decreasing of the light transmission in the liquid crystal material mass produced at present is approximately in a range of 35 ms to 40 ms. As already described in the embodiment 1 or the embodiment 7, since the frame period of the original image inputted to the liquid crystal display device with a frequency of 60 Hz is 16.7 ms, it is no exaggeration to say that many kinds of liquid crystal materials cannot indicate a sufficient response in one frame period. In particular, liquid crystal materials used in the IPS type liquid crystal display device driven in a normally black mode have a delay response to the black level reset in the aforesaid video varying period and also has a delay response for a light transmission corresponding to the halftone display, so that the aforesaid image retention may be liable to appear after a special bright video image is displayed. In the case of the impulse drive for the liquid crystal layer for generating repeatedly an electric field corresponding to the video signal for each half period of the first frame period and an electric field corresponding to the blanking signal at the liquid crystal layer including the liquid crystal material described above, a light transmission of the liquid crystal layer cannot be responded sufficiently to a gradation corresponding to the black level as well as a gradation corresponding to the video signal as indicated by the optical response waveform 3704.

In the present embodiment, the aforesaid problems are overcome by processing each of the gray scale voltage waveforms 3701, 3702 and suppressing an image retention generated at the liquid crystal display panel hold driven or the liquid crystal display panel impulse driven. FIG. 37B shows the gray scale voltage waveform 3705 generated by subjecting the gray scale voltage waveform 3701 to a time axis filter and the gray scale voltage waveform 3706 generated by subjecting the gray scale voltage waveform 3702 to a time axis filter. The frame period 3713 and the frame period 3714 shown in FIG. 37B corresponds to the frame periods 3711 and the frame period 3712, respectively, indicated in FIG. 37A. The gray scale voltage waveforms 3705, 3706 changeably display the pixel in a halftone subsequent to the frame period 3710 and the frame period 3714 in the same manner as that of the gray scale voltage waveforms 3701, 3702 in FIG. 37A and the pixel in dark halftone in four frame periods including the frame period 3713 between the frame period 3710 and the frame period 3714. The liquid crystal layer indicates a light transmission response waveform 3707 with respect to the gray scale voltage waveform 3705 for hold driving the liquid crystal layer and the liquid crystal layer indicates a light transmission response waveform 3708 with respect to the gray scale voltage wave form 3706 for impulse driving the liquid crystal layer. The solid line ordinates and the dotted line ordinates shown in FIG. 37B are also similarly defined in the same manner as that shown in FIG. 37A.

The so-called liquid crystal material with a low response speed requiring time more than one frame period for a rising and a decreasing of the light transmission shows a superior hold characteristic. However, when the liquid crystal layer including this liquid crystal material is impulse driven, the hold characteristic has generated the aforesaid image retention. Accordingly, in the present embodiment, as shown in the frame periods 3713, 3714 in FIG. 37B, there is applied the so-called video processing in which a partial potential of the gray scale voltage waveforms 3705, 3706 is set to intensify a variation of the video image and then the previous displayed video is deleted.

In the present embodiment, when brightness of the video is changed at transition from the frame period (the first frame period) to the next frame period (the second frame period), the video data displayed in the second frame period is subjected to the aforesaid video processing. For example, in the case where the video in a light halftone is displayed in the first frame period and the video image of dark halftone is displayed in its subsequent second frame period, the video signal is set to a lower low-level than the low-level corresponding to the video image of dark halftone like the gray scale voltage waveforms 3705, 3706 in the frame period 3713 in FIG. 37B. With such an operation, the gray scale voltage waveform 3705 in the frame period 3713 in FIG. 37B shows a lower potential than that in three frame periods subsequent to the frame period 3713, and the gray scale voltage waveform 3706 in the front half (the video write-in period) in the frame period 3713 shows a lower potential than that of the front half of each of three frame periods subsequent to the frame period 3713. In FIG. 37B, although the lower-level is set to be higher than the lowest-level used in the aforesaid black level reset (a potential indicated by the gray scale voltage waveform 3706 at the rear half of each of the frame periods), an effect of the present embodiment is not deteriorated even if the lower-level is equal to the lowest-level.

When the gray scale voltage waveforms 3705, 3706 are set as described above in the frame period 3713, an electric field in the liquid crystal layer varies substantially at the time of starting of the frame period 3713, so that liquid crystal molecules in the liquid crystal layer are released from the orientation to predetermined orientation and are likely to return to the initial orientated state. Although a variation in environment around the liquid crystal molecules as described above is also generated in the frame period 3711 in FIG. 37A, it does not have any force for enforcing the variation in orientation at transit in which the liquid crystal molecules are returned from the orientation forced by the electric field as described above to the initial oriented state. In contrast to this, in the present embodiment, a displacement of electric field experienced by the liquid crystal molecules is increased and a motion to return to the initial orientation state is promoted and then it makes fast a time at which the liquid crystal molecules reach the orientation showing the desired light transmission in the liquid crystal layer.

In the case where the liquid crystal layer is impulse driven, an orientation of liquid molecules at the time of finishing of the frame period 3710 approaches the initial orientation state in accordance with the blanking signal applied in the frame period 3710 before the frame period 3713. At the time of end of the frame period 3710, the liquid crystal molecules driven by an electric field with the gray scale voltage waveform 3702 in FIG. 37A are oriented in the substantial same orientation as that of the liquid crystal molecules driven by an electric field with the gray scale voltage waveform 3706 in FIG. 37B. However, the gray scale voltage waveform 3702 increases an electric field intensity in the liquid crystal layer at the front half of the frame period 3711 to a level higher than that at the time of end of the frame period 3710, so that the liquid crystal molecules tried to return to the initial orientation state start to move toward the orientation improving a light transmission of the liquid crystal layer at the time of end of the frame period 3710 (refer to the light transmission response waveform 3704 in FIG. 37A). In contrast to this, the gray scale voltage waveform 3706 in accordance with the present embodiment is suppressed in an increase at the potential at the front half of the frame period 3713 with respect to the potential at the time of end of the frame period 3710, so that an electric field in the liquid crystal layer at the front half of the frame period 3713 is suppressed to the extent in which a motion returning back to the initial orientation state of the liquid crystal molecules is decelerated. Accordingly, a light transmission of the liquid crystal layer at the front half of the frame period 3713 is gradually decreased as shown at the light transmission response waveform 3708 in FIG. 37A. Therefore, the pixel at the front half of the frame period 3713 is displayed in a dark halftone corresponding to the video data, and the pixel at the rear half of the frame period 3713 is displayed in dark (black) corresponding to the blanking data. In addition, a variation in brightness of the pixel ranging from the starting time of the frame period 3710 to the ending time of the frame period 3713 causes a user of the liquid crystal display device to recognize that the pixels displaying the light halftone at the frame period 3710 display a dark halftone fast at the frame period 3713. Accordingly, the image retention caused by the video image displayed at the frame period 3710 and prior to it cannot be recognized at last in a picture of the liquid crystal display device at the frame period 3713.

On the other hand, in the case where the dark halftone video image is displayed at the first frame period and a light halftone video image is displayed at its subsequent second frame period, the video signal is set to a higher-level than the high-level corresponding to the light halftone video as found in the gray scale voltage waveforms 3705, 3706 at the frame period 3714 in FIG. 37B. With such an operation, as shown in FIG. 37B, the gray scale voltage waveform 3705 in the frame period 3714 shows a higher potential than that in the next frame period of the frame period 3714, and the gray scale voltage waveform 3706 at the front half of the frame period 3714 shows a higher potential than that in the front half of the subsequent frame period of the frame period 3714. In FIG. 37B, although the higher-level has been set to a level lower than the highest-level displaying the pixel white (making a luminance of the pixel maximum), the effect of the present embodiment is not deteriorated even if the higher-level is set to a level equal to the highest-level.

The pixel in the frame period 3714 in FIG. 37B is displayed bright as compared with that in the previous frame period prior thereof. Therefore, it is possible to increase a rise of the gray scale voltage at the time of starting of the frame period 3714 and move the liquid crystal molecules forcedly toward the orientation indicating a desired light transmission (corresponding to the light halftone to be displayed in the frame period 3714) with a stronger electric field. In particular, since the gray scale voltage waveform 3708 for impulse driving the liquid crystal layer displays the pixels displayed in blanking before starting of the frame period 3714 bright in a rapid manner as the frame period 3714 is started, the user of the liquid crystal display device no longer recognize the image retention caused by the video image displayed prior to the frame period 3714.

As described above, some deterioration causes for motion picture quality such as image retention, shear in color and reduction in contrast or the like caused by video hysteresis at the liquid crystal display panel are reduced by intensifying (setting a variation large) a variation in brightness of video data (pixel data) accompanied by a transition of the frame period in the present embodiment as compared with that of the original image inputted to the liquid crystal display device.

Processing (the so-called video processing) of the gray scale voltage waveform in accordance with the aforesaid present embodiment can be carried out as follows by a data processing system arranged in the liquid crystal display device (a liquid crystal display module) such as the display control circuit 114 or its peripheral circuit or the like shown in FIG. 3, for example.

As already been described in the embodiment 1 or the embodiment 7, a frame memory storing the original image inputted to the liquid crystal display device (a liquid crystal display module) is connected to the display control circuit 114. The original image in the first frame period (the first original image) and the original image in the second frame period (the second original image) are inputted in sequence from the interface of the liquid crystal display device (a terminal receiving video information from outside the liquid crystal display device) into the liquid crystal display device for each continuous pair of frame periods (the first frame period and the second frame period subsequent to the first frame period). In the first frame period, the first original image is inputted to the liquid crystal display device and stored in the frame memory. In the second frame period, the second original image is inputted to the liquid crystal display device and at the same time, the first original image is readout of the frame memory and the second original image is stored in the frame memory. This process has already been described in the embodiment 1 or the embodiment 7, and in the third frame period subsequent to the second frame period, an operation for reading out the second original image from the frame memory while the third original image is being inputted to the liquid crystal display device and for storing the third original image in the frame memory is repeated for each frame period.

In view of the second frame period in this case, the first original image read out of the frame memory and the second original image stored in the frame memory can be compared with each other by a comparator installed in the display control circuit 114 around the frame memory or its peripheral circuit, for example. Therefore, it is possible to specify an area where the display gray scale varies as compared with that of the first original image, in the second original image (video data). The gray scale variation area of the second original image is subjected to enhancement by the scanning data generator circuit 102 (refer to FIG. 1) installed at the display control circuit 114 in reference to the gray scale variation area (or brightness variation area) in the second original image specified by the comparator and then the video data to be transferred to the drain line drive circuit 105 is generated. That is, if the gray scale variation area of the second original image includes data displaying the darker halftone than that in the area of the first original image corresponding to the former one, the data is replaced with the data corresponding to the further dark halftone (display color near to black). In addition, if the gray scale variation area of the second original image includes data displaying lighter halftone than that of the area of the first original image corresponding to the former one, the data is replaced with data corresponding to the further lighter halftone (display color near to white). Accordingly, if the second original image inputted to the liquid crystal display device and the second video transferred to the drain line drive circuit 105 or video data generated from the second video are compared to each other for each address (specifying the pixels of the pixel array for displaying the video or pixel group), the area having the gray scale data separating from each other (pixels or pixel group) is acknowledged.

In this way, in accordance with the present embodiment, it is possible to subject the gray scale voltage waveform outputted from the drain line drive circuit 105 to the drain line of the pixel array (a liquid crystal display panel) to correction preferable for suppressing the aforesaid image retention by a system installed in the liquid crystal display device (a liquid crystal module).

In accordance with the present invention, since the video data and the blanking data are displayed in one frame period by inserting the blanking data into the video data corresponding to one frame period, an effect of suppressing deterioration in video quality caused by the moving image blur and the like is provided. Further, in accordance with the present invention, since an increase in the number of drain driver is suppressed by selecting lines so as to cause the video data and the blanking data to be displayed at optional display elements in one frame period, an effect of suppressing a large-sized formation or a complex assembly of a structure of the display device.

What is claimed is:

1. A display device comprising:

a pixel array having a plurality of pixels arranged in rows extending in a first direction and columns extending in a second direction intersecting said first direction, each of said plurality of pixels being provided with a switching element;

a plurality of first signal lines extending in said first direction and arranged in said second direction, each of said plurality of first signal lines supplying a first signal to said switching elements in ones of said plurality of pixels belonging to a corresponding one of said rows;

a plurality of second signal lines extending in said second direction and arranged in said first direction, each of said plurality of second signal lines for supplying a second signal to at least one of said switching elements in ones of said plurality of pixels belonging to a corresponding one of said columns and supplied with said first signal such that said at least one of said switching elements determines a display state associated therewith;

a first drive circuit for supplying said first signal to each of said plurality of first signal lines;

a second drive circuit for supplying said second signal to each of said plurality of second signal lines; and a display control circuit for (i) generating a timing signal for determining a timing for said first drive circuit to output said first signal, and (ii) generating video data used for generation of said second signal by said second drive circuit, based upon video information per frame period, wherein said plurality of first signal lines are divided into a plurality of groups each comprising plural adjacent ones of said plurality of first signal lines, said frame period includes a first time interval and a second time interval, said first drive circuit supplies said first signal to said plurality of groups successively during each of said first time interval and said second time interval, all of said first signal lines of each of said plurality of groups being supplied with said first signal at one time, said second drive circuit generates said second voltage corresponding to said video data and supplies said second voltage to ones of said plurality of pixels associated with one of said plurality of groups of first signal lines supplied with said first signal during said first time interval, and said second drive circuit generates said second voltage and supplies said second voltage to ones of said plurality of pixels associated with one of said plurality of groups of first signal lines supplied with said first signal during said second time interval such that said ones of said plurality of pixels associated with said one of said plurality of groups of first signal lines supplied with said first signal produce luminance lower than that produced during said first time interval.

2. A display device according to claim 1, wherein said video information which said display control circuit receives per frame period is video information per field period transmitted in an interlaced scanning system.

3. A display device according to claim 1, wherein said video information which said display control circuit receives per frame period is video information per field period transmitted in a progressive scanning system.

4. A display device according to claim 3, wherein said display control circuit generates said video data per frame period based upon a first video information group and a second video information group alternately on successive frames from said video information, said first video information group corresponds to alternate ones of said rows of said pixels, and said second video information group corresponds to alternate ones of said rows of said pixels other than said rows of said pixels for said first video information group.

5. A display device according to claim 1, wherein said display control circuit generates said video data by using a portion of said video information corresponding to a portion in number of rows of pixels.

6. A display device according to claim 1, wherein said display control circuit generates said video data by using a portion of said video information corresponding to a portion in number of columns of pixels.

7. A display device according to claim 1, wherein said display device has said plurality of pixels formed in a liquid crystal display panel and is provided with a light source for illuminating said liquid crystal display panel, and said light source is turned on and off in each of said frame period.

8. A display device comprising:

a pixel array having a plurality of pixels arranged in rows extending in a first direction and columns extending in a second direction intersecting said first direction, each of said plurality of pixels being provided with a switching element;

a plurality of first signal lines extending in said first direction and arranged in said second direction, each of said plurality of first signal lines supplying a first signal to said switching elements in ones of said plurality of pixels belonging to a corresponding one of said rows;

a plurality of second signal lines extending in said second direction and arranged in said first direction, each of said plurality of second signal lines for supplying a second signal to at least one of said switching elements in ones of said plurality of pixels belonging to a corresponding one of said columns and supplied with said first signal such that said at least one of said switching elements determines a display state associated therewith;

a first drive circuit for supplying said first signal to each of said plurality of first signal lines;

a second drive circuit for supplying said second signal to each of said plurality of second signal lines; and a display control circuit for (i) generating a timing signal for determining a timing for said first drive circuit to output said first signal, and (ii) generating video data used for generation of said second signal by said second drive circuit, based upon video information per frame period, wherein said plurality of first signal lines are divided into a plurality of groups each comprising plural adjacent ones of said plurality of first signal lines, said frame period includes at least two scanning periods, said first drive circuit supplies said first signal to said plurality of groups successively during each of said at least two scanning periods, all of said first signal lines of each of said plurality of groups being supplied with said first signal at one time, said second drive circuit generates said second voltage corresponding to said video data and supplies said second voltage to ones of said plurality of pixels associated with one of said plurality of groups of first signal lines supplied with said first signal during at least one of said at least two scanning periods disposed at a beginning of said frame period, and said second drive circuit generates said second voltage and supplies said second voltage to ones of said plurality of pixels associated with one of said plurality of groups of first signal lines supplied with said first signal during at least one of said at least two scanning periods disposed at an end of said frame period such that said ones of said plurality of pixels associated with said one of said plurality of groups of first signal lines supplied with said first signal produce luminance lower than that produced during said at least one of said at least two scanning periods disposed at the beginning of said frame period.

9. A display device according to claim 8, wherein said second voltage generated during one of said at least one of said at least two scanning periods disposed at said beginning of said frame period is set to be higher than that generated during another of said at least one of said at least two scanning periods succeeding said one of said at least one of said at least two scanning periods disposed at said beginning of said frame period.

10. A display device according to claim 8, wherein said frame period includes two scanning periods, said first drive circuit supplies said first signal to said plurality of groups successively during each of said two scanning periods, all of said first signal lines of each of said plurality of groups being supplied with said first signal at one time, said second drive circuit generates said second voltage corresponding to said video data and supplies said second voltage to ones of said plurality of pixels associated with one of said plurality of groups of first signal lines supplied with said first signal during one of said two scanning periods disposed at a beginning of said frame period, and said second drive circuit generates said second voltage and supplies said second voltage to ones of said plurality of pixels associated with one of said plurality of groups of first signal lines supplied with said first signal during another of said two scanning periods succeeding said one of said two scanning periods, a polarity of said second voltage generated during said another of said two scanning periods being opposite from a polarity of said second voltage generated during said one of said two scanning period.

11. A display device comprising:

a pixel array having a plurality of pixels arranged in rows extending in a first direction and columns extending in a second direction intersecting said first direction, each of said plurality of pixels being provided with a switching element;

a plurality of first signal lines extending in said first direction and arranged in said second direction, each of said plurality of first signal lines supplying a first signal to said switching elements in ones of said plurality of pixels belonging to a corresponding one of said rows;

a plurality of second signal lines extending in said second direction and arranged in said first direction, each of said plurality of second signal lines for supplying a second signal to at least one of said switching elements in ones of said plurality of pixels belonging to a corresponding one of said columns and supplied with said first signal such that said at least one of said switching elements determines a display state associated therewith;

a first drive circuit for supplying said first signal to each of said plurality of first signal lines;

a second drive circuit for supplying said second signal to each of said plurality of second signal lines; and a display control circuit for (i) generating a timing signal for determining a timing for said first drive circuit to output said first signal, and (ii) generating video data used for generation of said second signal by said second drive circuit, based upon video information per frame period, wherein said plurality of first signal lines are divided into a first group and a second group, said first group comprising alternate ones of said plurality of first signal lines, and said second group comprising alternate ones of said plurality of first signal lines other than said first signal lines of said first group;

said frame period includes at least two scanning periods, said first drive circuit supplies said first signal to said alternate ones of said plurality of first signal lines successively during at least one of said at least two scanning periods disposed at a beginning of said frame period, and supplies said first signal to a respective pair of one of said first signal lines of said second group and one of said first signal lines adjacent to said one of said first signal lines of said second group successively during at least one of said at least two scanning periods disposed at an end of said frame period, said second drive circuit generates said second voltage corresponding to said video data and supplies said second voltage to ones of said plurality of pixels associated with one of said first signal lines of said first group supplied with said first signal during said at least one of said at least two scanning periods disposed at the beginning of said frame period, and said second drive circuit generates said second voltage and supplies said second voltage to ones of said plurality of pixels associated with one of said respective pairs of first signal lines supplied with said first signal during said at least one of said at least two scanning periods disposed at the end of said frame period such that said ones of said plurality of pixels associated with said one of said respective pairs of first signal lines supplied with said first signal produce luminance lower than that produced during said at least one of said at least two scanning periods disposed at the beginning of said frame period.

12. A display device comprising:

a pixel array having a plurality of pixels arranged in rows extending in a first direction and columns extending in a second direction intersecting said first direction, each of said plurality of pixels being provided with a switching element;

a plurality of first signal lines extending in said first direction and arranged in said second direction, each of said plurality of first signal lines supplying a first signal to said switching elements in ones of said plurality of pixels belonging to a corresponding one of said rows;

a plurality of second signal lines extending in said second direction and arranged in said first direction, each of said plurality of second signal lines for supplying a second signal to at least one of said switching elements in ones of said plurality of pixels belonging to a corresponding one of said columns and supplied with said first signal such that said at least one of said switching elements determines a display state associated therewith;

a first drive circuit for supplying said first signal to each of said plurality of first signal lines;

a second drive circuit for supplying said second signal to each of said plurality of second signal lines; and a display control circuit for (i) generating a timing signal for determining a timing for said first drive circuit to output said first signal, and (ii) generating video data used for generation of said second signal by said second drive circuit, based upon video information per frame period, wherein said plurality of first signal lines are divided into a plurality of groups each comprising successive N first signal lines of said plurality of first signal lines, where N is a natural number equal to or greater than 1, said first drive circuit repeats at least two scannings during one frame period, each of said at least two scannings supplying said first signal to said plurality of groups of the first signal lines successively, all of said first signal lines of each of said plurality of groups being supplied with said first signal at one time, said second drive circuit generates said second voltage corresponding to said video data and supplies said second voltage to ones of said plurality of pixels associated with one of said plurality of groups of said first signal lines supplied with said first signal during at least one of said two scannings at a beginning of said one frame period, and said second drive circuit generates said second voltage and supplies said second voltage to ones of said plurality of pixels associated with one of said plurality of groups of said first signal lines supplied with said first signal during at least one of said at least two scannings at an end of said one frame period such that said ones of said plurality of pixels associated with said one of said plurality of groups of said first signal lines supplied with said first signal produce luminance lower than that produced during said at least one of said at least two scannings at the beginning of said frame period, and said display control circuit supplies said video data divided in plural groups and in parallel with each other to said second drive circuit per frame period.

13. A display device according to claim 12, wherein said video information which said display control circuit receives per frame period is video information per field period transmitted in an interlaced scanning system.

14. A display device according to claim 12, wherein said video information which said display control circuit receives per frame period is video information per field period transmitted in a progressive scanning system.

15. A display device comprising:

a pixel array having a plurality of pixels arranged in rows extending in a first direction and columns extending in a second direction intersecting said first direction, each of said plurality of pixels being provided with a switching element;

a plurality of first signal lines extending in said first direction and arranged in said second direction, each of said plurality of first signal lines supplying a first signal to said switching elements in ones of said plurality of pixels belonging to a corresponding one of said rows;

a plurality of second signal lines extending in said second direction and arranged in said first direction, each of said plurality of second signal lines for supplying a second signal to at least one of said switching elements in ones of said plurality of pixels belonging to a corresponding one of said columns and supplied with said first signal such that said at least one of said switching elements determines a display state associated therewith;

a first drive circuit for supplying said first signal to each of said plurality of first signal lines;

a second drive circuit for supplying said second signal to each of said plurality of second signal lines; and a display control circuit for (i) generating a timing signal for determining a timing for said first drive circuit to output said first signal, and (ii) generating video data used for generation of said second signal by said second drive circuit, based upon video information per frame period, wherein said first drive circuit supplies said first signal to a plurality of first-kind groups successively at least two times during one of two successive frame periods, and supplies said first signal to a plurality of second-kind groups successively at least two times during another of said two successive frame periods, a respective one of said plurality of first-kind groups comprising plural adjacent ones of said plurality of first signal lines, a respective one of said plurality of second-kind groups comprising plural adjacent ones of said plurality of first signal lines, said respective one of said second-kind groups of first signal lines differing from said respective one of said first-kind groups of first signal lines, all of said first signal lines of each of said first-kind and second-kind groups being supplied with said first signal at one time, said second drive circuit generates said second voltage corresponding to said video data and supplies said second voltage to ones of said plurality of pixels associated with one of said first-kind and second-kind groups of the first signal lines supplied with said first signal at at least one of said at least two times of supplying said first signal at a beginning of each of said one and another of said two successive frame periods, and said second drive circuit generates said second voltage and supplies said second voltage to ones of said plurality of pixels associated with one of said first-kind and second-kind groups of the first signal lines supplied with said first signal at at least one of said at least two times of supplying said first signal at an end of each of said one and another of said two successive frame periods such that said ones of said plurality of pixels associated with said one of said first-kind and second-kind groups of the first signal lines supplied with said first signal produce luminance lower than that produced at said at least one of said at least two times of supplying said first signal at said beginning of each of said one and another of said two successive frame periods.

16. A display device according to claim 15, wherein said video information which said display control circuit receives per frame period is video information per field period transmitted in an interlaced scanning system.

17. A display device according to claim 15, wherein said video information which said display control circuit receives per frame period is video information per field period transmitted in a progressive scanning system, said display control circuit generates said video data per frame period based upon a first video information group and a second video information group alternately on successive frames from said video information, said first video information group corresponds to odd-numbered ones of said rows of said pixels, and said second video information group corresponds to even-numbered ones of said rows of said pixels.

18. A display device according to claim 15, wherein said respective one of said plurality of second-kind groups comprises N plural adjacent ones of said plurality of first signal lines, where N is a natural number equal to or greater than 2, and said respective one of said plurality of first-kind groups is displaced by n lines of said first signal lines from one of said plurality of second-kind groups which is nearest to said respective one of said plurality of first-kind groups, where n is a natural number smaller than N.

19. A display device according to claim 18, wherein said plurality of second-kind groups further comprise a group comprising one of (i) one of said first signal lines, (ii) (N−n) of said first signal lines, and (iii) (N+n) of said first signal lines.

20. A display device comprising:

a pixel array having a plurality of pixels arranged in rows extending in a first direction and columns extending in a second direction intersecting said first direction, each of said plurality of pixels being provided with a switching element;

a plurality of first signal lines extending in said first direction and arranged in said second direction, each of said plurality of first signal lines supplying a first signal to said switching elements in ones of said plurality of pixels belonging to a corresponding one of said rows;

a plurality of second signal lines extending in said second direction and arranged in said first direction, each of said plurality of second signal lines for supplying a second signal to at least one of said switching elements in ones of said plurality of pixels belonging to a corresponding one of said columns and supplied with said first signal such that said at least one of said switching elements determines a display state associated therewith;

a first drive circuit for supplying said first signal to each of said plurality of first signal lines;

a second drive circuit for supplying said second signal to each of said plurality of second signal lines; and a display control circuit for (i) generating a timing signal for determining a timing for said first drive circuit to output said first signal, and (ii) generating video data used for generation of said second signal by said second drive circuit and blanking data for producing a gray scale level lower than a gray scale level produced by said video data, based upon video information per two successive frame periods, wherein said plurality of first signal lines are divided into a plurality of groups each comprising plural adjacent ones of said plurality of first signal lines, said first drive circuit supplies said first signal to said plurality of groups successively at least two times during each of a first frame period of said two successive frame periods and a second frame period of said two successive frame periods succeeding said first frame period, all of said first signal lines of each of said plurality of groups being supplied with said first signal at one time, said second drive circuit generates said second voltage corresponding to said video data and supplies said second voltage to ones of said plurality of pixels associated with one of said plurality of groups of said first signal lines supplied with said first signal at at least one of said at least two times of supplying said first signal in a former half of each of said two successive frame periods, and said second drive circuit generates said second voltage based upon said blanking data and supplies said second voltage to ones of said plurality of pixels associated with one of said plurality of groups of said first signal lines supplied with said first signal at at least one of said at least two times of supplying said first signal in a latter half of each of said two successive frame periods such that said ones of said plurality of pixels associated with said one of said plurality of groups of said first signal lines supplied with said first signal produce luminance lower than that produced at said at least one of said at least two times of supplying said first signal in said former half of said each of said two successive frame periods, and said display control circuit compares a second one of said video information corresponding to said second frame period with a first one of said video information corresponding to said first frame period, and generate said blanking data used in said latter half of said first frame period such that said blanking data provides luminance in ones of said plurality of pixels exhibiting a difference in gray scale level between said first and second ones of said video information, different from luminance in a remainder of said plurality of pixels.

21. A display device comprising:

a pixel array having a plurality of pixels arranged in rows extending in a first direction and columns extending in a second direction intersecting said first direction, each of said plurality of pixels being provided with a switching element;

a plurality of first signal lines extending in said first direction and arranged in said second direction, each of said plurality of first signal lines supplying a first signal to said switching elements in ones of said plurality of pixels belonging to a corresponding one of said rows;

a plurality of second signal lines extending in said second direction and arranged in said first direction, each of said plurality of second signal lines for supplying a second signal to at least one of said switching elements in ones of said plurality of pixels belonging to a corresponding one of said columns and supplied with said first signal such that said at least one of said switching elements determines a display state associated therewith;

a first drive circuit for supplying said first signal to each of said plurality of first signal lines;

a second drive circuit for supplying said second signal to each of said plurality of second signal lines; and a display control circuit for (i) generating a timing signal for determining a timing for said first drive circuit to output said first signal, and (ii) generating video data used for generation of said second signal by said second drive circuit and blanking data for producing a gray scale level lower than a gray scale level produced by said video data, based upon video information per two successive frame periods, wherein said plurality of first signal lines are divided into a plurality of groups each comprising plural adjacent ones of said plurality of first signal lines, said first drive circuit supplies said first signal to said plurality of groups successively at least two times during each of a first frame period of said two successive frame periods and a second frame period of said two successive frame periods succeeding said first frame period, all of said first signal lines of each of said plurality of groups being supplied with said first signal at one time, said second drive circuit generates said second voltage corresponding to said video data and supplies said second voltage to ones of said plurality of pixels associated with one of said plurality of groups of said first signal lines supplied with said first signal at at least one of said at least two times of supplying said first signal in a former half of each of said two successive frame periods, and said second drive circuit generates said second voltage based upon said blanking data and supplies said second voltage to ones of said plurality of pixels associated with one of said plurality of groups of said first signal lines supplied with said first signal at at least one of said at least two times of supplying said first signal in a latter half of each of said two successive frame periods such that said ones of said plurality of pixels associated with said one of said plurality of groups of said first signal lines supplied with said first signal produce luminance lower than that produced at said at least one of said at least two times of supplying said first signal in said former half of said each of said two successive frame periods, and said display control circuit compares a second one of said video information corresponding to said second frame period with a first one of said video information corresponding to said first frame period, and generate said video data used in said former half of said second frame period such that said video data enhances a difference in gray scale level between said first and second ones of said video information in ones of said plurality of pixels exhibiting said difference.

22. A method of driving a display device, said display device including a pixel array having a plurality of pixels arranged in rows extending in a first direction and columns extending in a second direction intersecting said first direction, a plurality of first signal lines extending in said first direction and arranged in said second direction, and a plurality of second signal lines extending in said second direction and arranged in said first direction, said method comprising:

generating a video signal to be supplied to each of said plurality of pixels, and a scanning signal for determining a timing for supplying said video signals to said plurality of pixels, based upon video information per frame period supplied to said display device;

selecting said rows of said pixels successively during said frame period by outputting said scanning signal to respective ones of said plurality of first signal lines; and supplying said video signals to ones of said plurality of pixels belonging to said selected rows of said pixels via said plurality of second signal lines, wherein said plurality of first signal lines are divided into a plurality of groups each comprising plural adjacent ones of said plurality of first signal lines, said method includes:

at least two scanning steps for outputting said scanning signal to said plurality of groups of said first signal lines successively, during said frame period, all of said first signal lines of each of said plurality of groups being supplied with said scanning signal at one time;

supplying said video signals to ones of said plurality of pixels associated with one of said plurality of groups of first signal lines supplied with said scanning signal by at least one of said at least two scanning steps disposed at a beginning of said frame period, and supplying a voltage to ones of said plurality of pixels associated with one of said plurality of groups of first signal lines supplied with said scanning signal by at least one of said at least two scanning steps disposed at an end of said frame period such that said ones of said plurality of pixels associated with said one of said plurality of groups of first signal lines supplied with said scanning signal produce luminance lower than that produced during said at least one of said at least two scanning steps disposed at the beginning of said frame period.

* * * * *